US006652053B2

(12) United States Patent
Imanaka et al.

(10) Patent No.: US 6,652,053 B2
(45) Date of Patent: Nov. 25, 2003

(54) SUBSTRATE FOR INK-JET PRINTING HEAD, INK-JET PRINTING HEAD, INK-JET CARTRIDGE, INK-JET PRINTING APPARATUS, AND METHOD FOR DETECTING INK IN INK-JET PRINTING HEAD

(75) Inventors: Yoshiyuki Imanaka, Kasawaki (JP); Shinji Takagi, Kawasaki (JP); Ichiro Saito, Yokohama (JP); Toshiharu Inui, Yokohama (JP); Kentaro Yano, Yokohama (JP); Tetsuhito Ikeda, Tokyo (JP); Masao Kato, Utsunomiya (JP); Katsuhiko Takahashi, Yokohama (JP); Muga Mochizuki, Yokohama (JP); Kenichi Saito, Kawasaki (JP); Tomonori Sato, Kawasaki (JP); Toru Kubokawa, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 09/784,409

(22) Filed: Feb. 14, 2001

(65) Prior Publication Data

US 2001/0038396 A1 Nov. 8, 2001

(30) Foreign Application Priority Data

| | | |
|---|---|---|
| Feb. 18, 2000 | (JP) | 2000-042076 |
| Feb. 18, 2000 | (JP) | 2000-042077 |
| Feb. 18, 2000 | (JP) | 2000-042078 |
| Feb. 18, 2000 | (JP) | 2000-042079 |
| May 2, 2000 | (JP) | 2000-133895 |

(51) Int. Cl.[7] ..... B41J 2/195

(52) U.S. Cl. ..... 347/7; 347/19

(58) Field of Search ..... 347/7, 14, 19

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |

(List continued on next page.)

FOREIGN PATENT DOCUMENTS

| | | |
|---|---|---|
| EP | 0 819 531 | 1/1998 |
| JP | 54-56847 | 5/1979 |
| JP | 58-118267 | 7/1983 |
| JP | 59-123670 | 7/1984 |
| JP | 59-138461 | 8/1984 |
| JP | 60-71260 | 4/1985 |
| JP | 5-8407 | 1/1993 |
| JP | 7-256883 | 10/1995 |
| JP | 8-80619 | 3/1996 |
| JP | 11-179933 | 7/1999 |

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

The present invention allows the detection of ink in a printing head that can be widely applied to various printing systems by significantly simplifying its configuration. There are a heater for supplying an energy to eject ink, a driver for driving the heater, and a detection electrode capable of detecting a voltage variation that arises between the heater and the driver and that depends on the driving of the heater. Furthermore, an insulating film that covers the surface of the detection electrode protects the detection electrode from chemical or physical change. Furthermore, a reference element group or a reference unit that produces a signal as a reference of the detection signal avoids the influence of noise. Furthermore, an energy-generating element and another signal source improve the accuracy of ink detection. A drive pulse which is insufficient to eject ink may be supplied to the heater to improve the accuracy of ink detection.

26 Claims, 30 Drawing Sheets

U.S. PATENT DOCUMENTS

| | | | | | |
|---|---|---|---|---|---|
| 4,459,600 | A | | 7/1984 | Sato et al. | |
| 4,463,359 | A | | 7/1984 | Ayata et al. | |
| 4,558,333 | A | | 12/1985 | Sugitani et al. | |
| 4,608,577 | A | | 8/1986 | Hori | |
| 4,723,129 | A | | 2/1988 | Endo et al. | |
| 4,740,796 | A | | 4/1988 | Endo et al. | |
| 4,853,718 | A | | 8/1989 | ElHatem et al. | |
| 5,072,235 | A | | 12/1991 | Slowik et al. | |
| 5,500,657 | A | | 3/1996 | Yauchi et al. | |
| 5,638,097 | A | * | 6/1997 | Takayanagi et al. | 347/7 |
| 5,721,574 | A | * | 2/1998 | Kubbly | 347/7 |
| 5,886,713 | A | * | 3/1999 | Okada et al. | 347/14 |
| 5,992,961 | A | | 11/1999 | Ishikawa et al. | |
| 6,070,969 | A | * | 6/2000 | Buonanno | 347/64 |
| 6,116,714 | A | | 9/2000 | Imanaka et al. | |

* cited by examiner

FIG.27
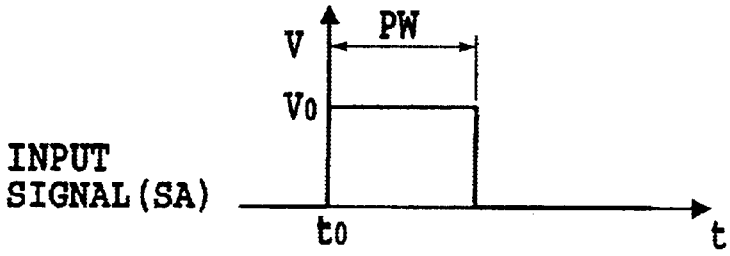
FIG.28
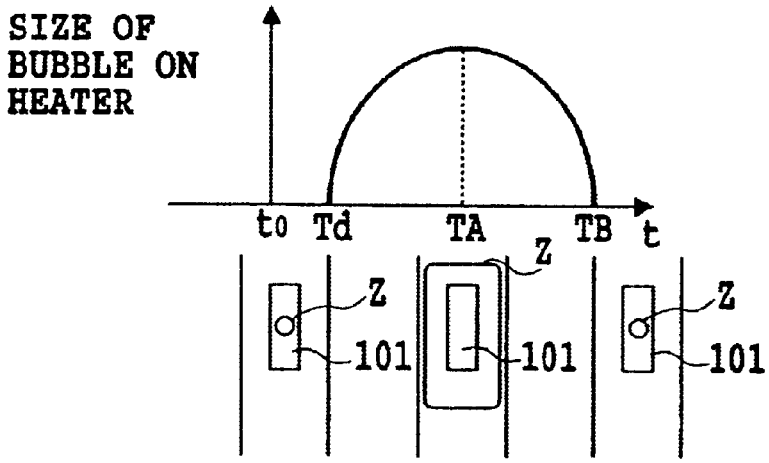
FIG.29A FIG.29B FIG.29C
FIG.30
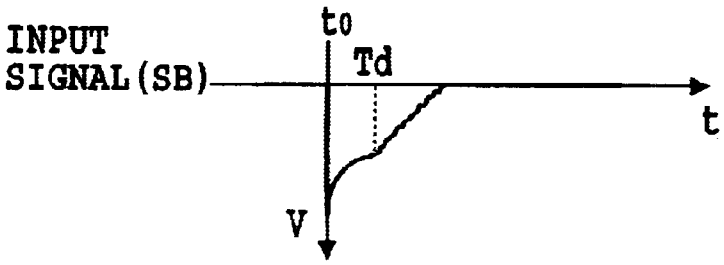

FIG.31
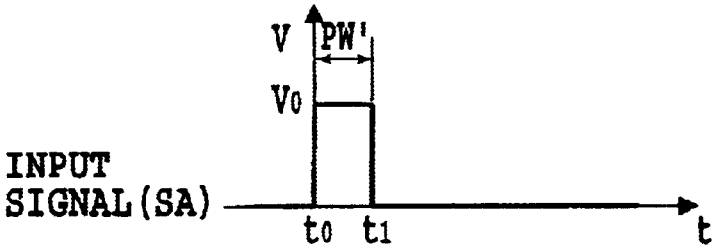
FIG.32
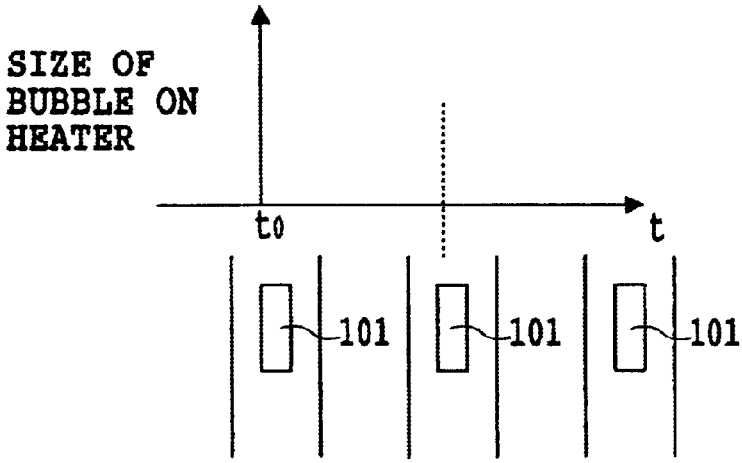
FIG.33A FIG.33B FIG.33C
FIG.34
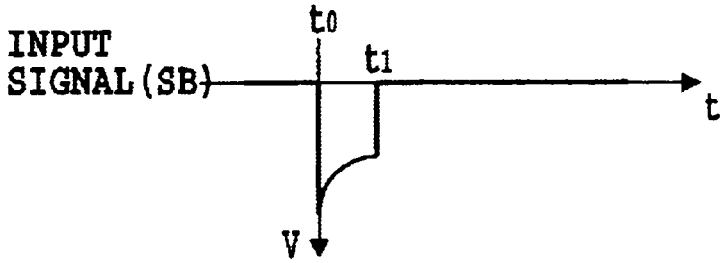

FIG.35
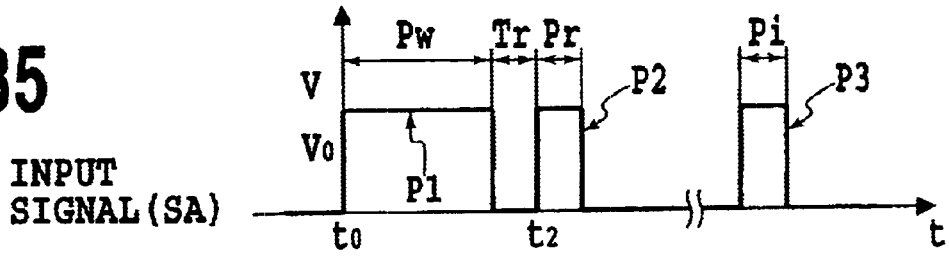
FIG.36
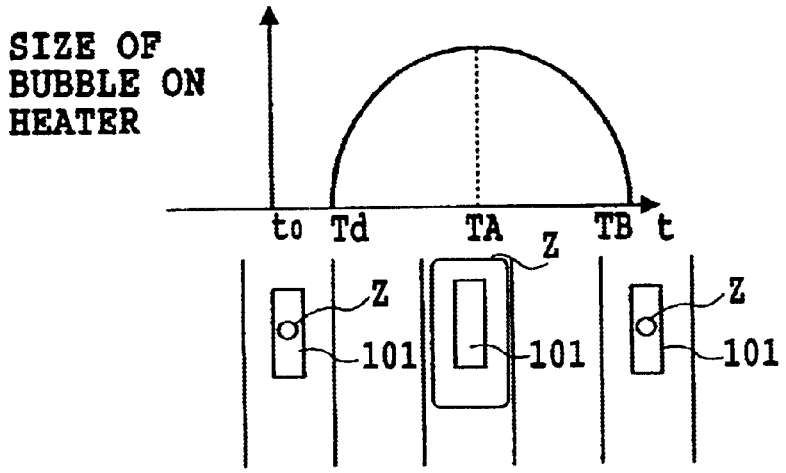
FIG.37A FIG.37B FIG.37C
FIG.38
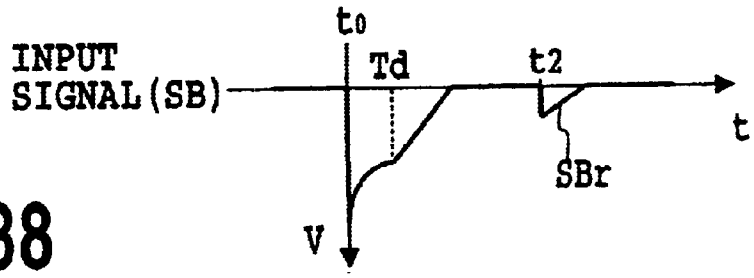

SUBSTRATE FOR INK-JET PRINTING HEAD, INK-JET PRINTING HEAD, INK-JET CARTRIDGE, INK-JET PRINTING APPARATUS, AND METHOD FOR DETECTING INK IN INK-JET PRINTING HEAD

This application is based on Japanese Patent Application Nos. 2000-42076, 2000-42077, 2000-42078, 2000-42079 filed Feb. 18, 2000 in Japan, and 2000-133895 filed May 2, 2000, the content of which is incorporated hereinto by reference.

BACKGROUND OF THE INVENTION

1. Field of the Invention

The present invention relates to an ink-jet printing head which is capable of detecting ink therein, a substrate for an ink-jet printing head (hereinafter, simply referred to as a substrate) to be used in the ink-jet printing head, an ink-jet cartridge provided as a combination of the ink-jet printing head and an ink tank, an ink-jet printing apparatus which is capable of performing a printing movement using the printing head and/or the ink-jet printing cartridge, and a method for detecting ink in the printing head.

2. Description of the Prior Art

There are various kinds of printing apparatuses. For example, there are those having the functions of printing, copying, and transmitting, and also those provided as output devices for complex systems such as computers, word processors, and work station system. Each of these printing apparatuses is configured to print an image on a sheet of printing medium such as a sheet of paper or plastic thin plate (e.g., an overhead transparency film). Depending on their methods of printing, those printing apparatuses can be grouped into one of ink-jet, wire dot-matrix, thermal, heat-transfer, or laser beam type devices.

Among the groups of the printing apparatuses, the printing apparatus of the ink-jet type (the ink-jet printing apparatus) is one that performs a printing movement by ejecting ink onto a printing medium such as a sheet of printing paper, and allows the printing means to be as compact as possible with high speed printing of a fine detailed image. Furthermore, an image can be printed on a sheet of normal paper without previously processing a surface of such a sheet with specific chemicals or the like, so that the printing movement can be performed at low running expenses. In addition, the ink-jet printing apparatus is one of non-impact printing apparatuses that make images on the paper without striking it mechanically, so that it is capable of printing with a low noise. Furthermore, the ink-jet printing apparatus has additional advantages such as the ability of smoothly printing an image in multiple colors using several colored inks.

There are several procedures that may be performed by the ink-jet printing system. One of them is a bubble-jet printing system in which a heating element that provides ink in a nozzle with thermal energy to form a bubble in the ink and concurrently ejects ink from the nozzle by energy caused by the formation of the bubble. In this case, the thermal element provided as a printing element for causing the energy for ejecting ink from the ejecting port is prepared using semiconductor production processes well known to those of skill in the art. Therefore, the ink-jet printing head that utilizes the bubble-jet printing system may be constructed by the steps of forming printing elements on a substrate made of silicon and combining the substrate and a top plate together, where the top plate is made of a resin such as polysulfone or a glass material and has grooves to be formed as ink passages.

As the substrate is provided as a silicon substrate, various functional parts may be installed on the substrate in addition to the printing elements. The functional parts may be a driver for driving the printing elements, a thermal sensor to be used when the printing elements are regulated in response to temperature variations in the printing head, a control unit for adjusting the actuating status of the thermal sensor, and soon.

In Japanese Patent Application Laid-open No. 7-256883 (1995), by way of example, a substrate for the above ink-jet printing head is disclosed. The substrate disclosed in that document is configured as shown in FIG. 9.

In FIG. 9, a component substrate 100 is provided as a substrate of the printing head, on which a plurality of heating elements 101 is mounted as printing elements for providing ink with a thermal energy for the ejecting of ink. As shown in the figure, the heat elements 101 are arranged in parallel and connected to power transistors (driver elements) 102, respectively. The power transistor 102 is responsible for driving the corresponding heat element 101. Furthermore, a shift register 104, a latch circuit 103, and a plurality of AND gates 115 are mounted on the substrate 100. Image data can be serially transferred from the outside to the shift register 104 through a terminal 106 in synchronization with a serial clock signal entered through a terminal 105, storing one line of the image data in the shift register 104. The latch circuit 103 latches one line of the image data provided as a parallel output from the shift register 104 in synchronization with a latch clock signal (a latch signal) provided as an input from the outside to the latch circuit 103 through a terminal 107. The data is transmitted to each of the power transistors 102 in parallel. The AND gates 115 are connected to their respective power transistors 102. An output signal from the latch circuit 103 can be applied on the power transistor 102 in response to an enable signal from the outside. In FIG. 9, reference. numeral 108 denotes a drive pulse width (heat pulse) input terminal for input of a control signal from the outside of the printing head portion. The control signal controls the ON time of the power transistor 102 provided as the driving element. In this case, the control signal is for controlling the time of driving the heating element 101 by feeding a current through the heating element 101. Furthermore, reference numeral 109 denotes a terminal for an input of a driving source (5V) to logic circuits including the latch circuit 103 and the shift transistor 104. A ground terminal 110, terminals 112 for activating and monitoring the sensor 114, and so on are also mounted on the substrate 100. Accordingly, the terminals 105 to 112 formed on the substrate 100 are provided as input terminals for inputs of image data and various signals from the outside, respectively.

On the substrate 100, furthermore, there is mounted a sensor 114 such as a temperature sensor for measuring the temperature of the substrate 100 or a resistance sensor for measuring the resistance of each heating element 101. The printing head includes the substrate, on which the drivers, the temperature sensor, the drive control part, and so on are mounted, so as to contribute to make the device more reliable and small.

In the printing head as constructed above, an input image data as a serial signal is converted to a parallel signal by the shift resistor 104 and maintained by the latch circuit 103 in synchronization with the latch clock signal. In this state, a drive pulse signal for driving the heating element 101 (i.e., an enable signal for the AND gate 115) is sent to the input terminal 107 to switch the power transistor 102 on in response to the image data. Subsequently, the switched-on power transistor 102 feeds a current through the corresponding heating element 101 to generate a thermal energy from the heating element 101. The top plate (not shown) is fixed on the substrate 100 to form liquid passages (i.e., nozzles) for ejecting ink and a common liquid chamber that communicates with these liquid passages. The printing head is configured in this manner, so that ink stored in the ink tank (i.e., ink-reserving part) is supplied to each nozzle through the common liquid chamber, resulting in a stable supply of ink. Subsequently, as described above, the ink in the liquid passage (nozzle) is heated by thermal energy generated by driving the heating element to eject ink as a liquid droplet from an ejecting port formed on the tip of the nozzle.

One of the important points for performing printing movement to produce printed matter with stability is the stable existence of ink in the common liquid chamber and each nozzle of the printing head during the printing movement. If the amount of ink in the ink tank is decreased, or air is trapped in the inside of the nozzle from the tip thereof, or a bubble generated in the common liquid chamber moves to the inside of the nozzle, or any other undesired event is caused, an image of poor quality is generated because the printing head has difficulty ejecting ink. For instance, if one of a plurality of nozzles in the printing head becomes difficult to ejecting ink with stability, such a specific nozzle is defined as a faulty nozzle. In this case, the faulty nozzle misses its image formation, so that a stripe portion is formed on a portion where an image formation is missed during the process of printing the image on the printing medium. If the amount of ink in the common liquid chamber is decreased, there may be cases where ink is supplied to only some of the nozzles. In this case, just as in the case described above, an image of poor quality is formed as a result of the faulty nozzle.

Conventionally, for detecting a partial ejecting failure of the printing head caused by its failed nozzle, several methods have been proposed for the purpose of detecting the condition of ink in the inside of the common liquid chamber or nozzle, especially for detecting the presence or absence of the ink.

Japanese Patent Application Laid-open No. 58-118267 (1983) proposes the method for detecting the presence or absence of ink in each of nozzles arranged in the ink jet printing head. According to this method, an additional element is arranged in the inside of the nozzle in addition to the printing element. The additional element changes its resistance in response to variations in temperature. If ink in the ink tank is used up, the rate of increasing the temperature around the nozzle increases as the heating element (i.e., the printing element) produces heat. Such variations in the temperature are detected by the temperature-sensing element to determine the presence or absence of ink.

Regarding the structure of the printing head disclosed in Japanese Patent Application Laid-open No. 58-118267 (1983) described above, there is a need to provide each nozzle with a sensor or an element capable of detecting temperature. In addition, a driving element for actuating the sensor or the element should be also arranged in the nozzle or on the substrate used for fabricating the printing head. Thus, the printing head design disclosed in the above document can be efficiently applied to a printing head having large-sized nozzles arranged in comparatively less density.

In recent years, however, there is the growing need for performing a high-speed printing and forming an image with extraordinary definition. Thus, several attempts have been made year after year to meet the requirements. These attempts include an increase in the number of nozzles to be arranged in the ink-jet printing head and an arrangement of nozzles in high density to provide a high printing density.

Attempts have been made to arrange nozzles much more densely on the substrate of the ink-jet printing head. However, it becomes much more difficult to place a temperature-sensing element or sensor that corresponds to each of printing elements on the inside of a nozzle or an area adjacent thereto and also to place a driving element for actuating such an element or sensor. Likewise, the number of nozzles to be formed on the substrate is increased as the number of temperature-sensing elements or the like is increased. Therefore, it leads to a large-sized chip of the substrate for ink-jet printing head; a multiple layered structure of wiring layers for electrically connecting sensor elements, their related circuits, and so on; resulting in an intricate arrangement of components on the substrate and a high cost of chip manufacture.

In Japanese Patent Application Laid-open No. 58-118267 (1983), furthermore, no description is provided regarding the configuration of a terminal for electrically connecting the temperature-sensing element to the outside of the printing head. If terminals for their respective temperature-sensing elements are mounted on the substrate, the total number of various terminals required for the printing head can be increased. For establishing the electrical connection between the printing head and the printing apparatus, furthermore, flexible printed wiring or the like can be increased. In the printing apparatus, furthermore, the number of elements for individually controlling signals passing through the wiring can be increased. Therefore, it results in upsizing of various parts of the printing apparatus and leads to higher costs.

As described above, Japanese Patent Application Laid-open No. 58-118267 (1983) discloses the method for detecting the variations in temperature of the printing head. For that, such a method restricts a system of image formation to an ink-jet printing system in which a heating element that generates a thermal energy is used as a printing element.

SUMMARY OF THE INVENTION

A first object of the present invention is to provide a substrate for an ink-jet printing head, an ink-jet printing head, an ink-jet printing cartridge, and an ink-jet printing apparatus, which comprise means capable of detecting ink in the printing head by its considerably simple design and applicable to a wide variety of printing systems A second object of the present invention is to provide a substrate for an ink-jet printing head, an ink-jet printing head, an inkjet printing cartridge, and an ink-jet printing apparatus, which comprise means capable of detecting ink in the printing head by its considerably simple design in a stable manner for the long term and applicable to a wide variety of printing systems.

A third object of the present invention is to provide a substrate for an ink-jet printing head, an ink-jet printing head, an inkjet printing cartridge, and an ink-jet printing apparatus, which comprise means capable of detecting the amount of ink in a nozzle, especially detecting the presence or absence of ink for every nozzle with a high degree of precision and with considerable simplicity of design.

A fourth object of the present invention is to provide an ink-jet printing apparatus and a method for detecting ink in an ink-jet printing head, which are applicable to various printing systems and capable of detecting ink in the ink-jet printing head with a high degree of precision and with a simplified design.

In a first aspect of the present invention, there is provided a substrate for an inkjet printing head to be provided as one of components that make up an ink-jet printing head that performs a printing movement by ejecting ink from an ejecting port, comprising:

a printing element for supplying energy for ejecting ink from the ejecting port;

a driving element for driving the printing element; and a detection electrode provided at a position remote from the printing element communicating with a voltage monitor for detecting a voltage change between the printing element and the driving element via conductive ink on the substrate for the printing head, where the voltage change occurs in response to the driving of the printing element.

In a second aspect of the present invention, there is provided an ink-jet printing head, comprising:

the substrate for an ink-jet printing head of the first aspect, and a top plate that forms nozzles corresponding to a predetermined number of printing elements when the substrate for the printing head is connected to the top plate.

In a third aspect of the present invention, there is provided an ink-jet cartridge comprising:

the ink-jet printing head of the second aspect; and an ink tank that stores ink to be supplied to the ink-jet printing head and is connectable with the ink-jet printing head.

In a fourth aspect of the present invention, there is provided an ink-jet printing apparatus comprising:

a means on which one of an ink-jet printing head of second aspect and an ink-jet cartridge of third aspect is mountable to perform a printing movement on a printing medium.

In a fifth aspect of the present invention, there is provided a substrate for an ink-jet printing head to be provided as one of components that make up an ink-jet printing head that performs a printing movement by ejecting ink from an ejecting port, comprising:

a printing element for supplying energy for ejecting ink from the ejecting port;

a driving element for driving the printing element;

a detection electrode provided at a position remote from the printing element, communicating with a voltage monitor, for detecting a voltage change between the printing element and the driving element via conductive ink on the substrate for the printing head, where the voltage change occurs in response to the driving of the printing element; and a protective film that covers a surface of the detection electrode.

In a sixth aspect of the present invention, there is provided an ink-jet printing head comprising:

a substrate for an ink-jet printing head of fifth aspect; and a top plate which is bonded to the substrate for the printing head to form nozzles, where each nozzle corresponds to a predetermined number of the printing elements.

In a seventh aspect of the present invention, there is provided an ink-jet cartridge comprising:

the ink-jet printing head of the sixth aspect; and an ink tank that stores ink to be supplied to the ink-jet printing head and is connectable with the ink-jet printing head.

In an eighth aspect of the present invention, there is provided an inkjet printing apparatus comprising:

a means on which one of the ink-jet printing head of the sixth aspect and the ink-jet cartridge of the seventh aspect is mountable to perform printing on a printing medium.

In a ninth aspect of the present invention, there is provided a substrate for an ink-jet printing head to be provided as one of components that make up an ink-jet printing head that performs a printing movement by ejecting ink from an ejecting port, comprising:

a printing element for supplying energy for ejecting ink from the ejecting port;

a driving element for driving the printing element;

a detection electrode which is placed a predetermined distance from both the printing element and the driving element via an insulating film; and a reference element group which is different from a detection element group comprising the printing element, the driving element, and the detection electrode, where the reference element group has the same relationship as that of the printing element, the driving element, and the detection electrode.

In a tenth aspect of the present invention, there is provided an ink-jet printing head having a plurality of nozzles for ejecting ink, comprising:

a printing element installed in each of the nozzles for generating energy for ejecting ink;

a driving element for driving the printing element;

a detection means for detecting a change in voltage occurring at the printing element and/or the driving element at the time of driving the printing element by the driving element;

a reference element group which is provided as another element group which is different from a detection element group comprising the printing element and the driving element, where the reference element group has the same relationship as that of the printing element and the driving element; and a detecting means that constitutes a reference unit together with the reference element group, wherein a detecting means of the reference unit detects a voltage change that occurs in the reference element group by driving of the reference element group at the time of driving the reference element group in the same way as that of the detection element group, where the voltage change that occurs in the reference element group is considered as a voltage change that occurs when ink is in a predetermined state.

In an eleventh aspect of the present invention, there is provided an ink-jet cartridge constructed as a combination of an inkjet printing head having a plurality of nozzles for ejecting ink and an ink tank capable of storing ink to be supplied to the ink-jet printing head, comprising:

a printing element installed in each of the nozzles for generating an energy to eject ink;

a driving element for driving the printing element;

a detection means for detecting a change in voltage occurring at the printing element and/or the driving element at the time of driving the printing element by the driving element;

a reference element group which is provided as another element group which is different from a detection element group comprising the printing element and the driving element, where the reference element group has the same relationship as that of the printing element and the driving element; and a detecting means that constitutes a reference unit together with the reference element group, wherein a detecting means of the reference unit detects a voltage change occurring in the reference element group at the time of driving the reference element group by the same way as that of the detection element group, where the voltage change occurring in the reference element group is considered as a voltage change that occurs when ink is in a predetermined state.

In a twelfth aspect of the present invention, there is provided an ink-jet printing apparatus that uses an ink-jet printing head having a plurality of nozzles for ejecting ink and performs a printing movement on a printing medium by ejecting ink from the nozzles, comprising:

an inkjet printing head of tenth aspect; and a means for detecting the presence or absence of ink in the nozzle on the basis of a comparison between a detection signal from the detecting means of the detection element group and a detection signal from the detecting means of the reference unit.

In a thirteenth aspect of the present invention, there is provided an ink-jet printing apparatus that uses an ink-jet printing head having a plurality of nozzles for ejecting ink and performs a printing movement on a printing medium by ejecting ink from the nozzles, comprising:

an ink-jet printing head of eleventh aspect; and a means for detecting the presence or absence of ink in the nozzle on the basis of a comparison between a detection signal from a detecting means of the detection element group and a detection signal from a detecting means of the reference unit.

In a fourteenth aspect of the present invention, there is provided a substrate for an ink-jet printing head to be provided as one of components that make up an ink-jet printing head that performs a printing movement by ejecting ink from ejecting ports, comprising:

an energy-generating element for supplying an energy to be used for ejecting ink;

a driving element for driving the energy-generating element;

an insulating protective film which is formed to cover at least one selected from the energy-generating element, the driving element, and a wiring between the energy-generating element and the driving element;

a signal source connected to the energy-generating element and placed on a position covered by the protective film; and a detection electrode capable of detecting a potential change between the signal source and the driving element to be generated in response to the driving of the energy-generating element via ink on the substrate for the printing head.

In a fifteenth aspect of the present invention, there is provided an ink-jet printing head comprising:

a substrate for an ink-jet printing head of fourteenth aspect.

In a sixteenth aspect of the present invention, there is provided an ink-jet cartridge comprising:

an ink-jet printing head of fifteenth aspect; and an ink tank that stores ink to be supplied to the ink-jet printing head and is able to make a connection to the ink-jet printing head.

In a seventeenth aspect of the present invention, there is provided an ink-jet printing apparatus comprising:

a means on which an inkjet printing head of fifteenth aspect is mountable to perform a printing movement on a printing medium.

In an eighteenth aspect of the present invention, there is provided an ink-jet printing apparatus comprising:

a means on which an ink-jet printing cartridge of sixteenth aspect is mountable to perform a printing movement on a printing medium.

In a nineteenth aspect of the present invention, there is provided an ink-detecting method for detecting ink in an ink-jet printing head which is capable of ejecting ink from a plurality of ejecting ports, wherein a substrate for an inkjet printing head mounted on the ink-jet printing head, comprises:

an insulating protective film which is formed to cover at least one selected from the energy-generating element, the driving element, and a wiring between the energy generating element and the driving element;

a signal source connected to the energy-generating element and placed on a position covered by the protective film; and a detection electrode capable of detecting a potential change between the signal source and the driving element to be generated in response to the actuation of the energy-generating element via ink on the substrate for the printing head, wherein a signal in response to the driving of the energy-generating element is generated from the signal source, and ink in the printing head is detected in response to a voltage change between the signal source and the driving element, which is detected by the detection electrode.

In a twentieth aspect of the present invention, there is provided an ink-jet printing apparatus for printing an image on a printing medium using an ink-jet printing head which is capable of ejecting ink by an energy generated by a printing element, comprising:

a detecting means that allows a detection of ink in the printing head in response to a detection signal obtained at the time of detecting a drive signal of the printing element via ink in the printing head; and a supplying means for supplying an ink-ejecting drive signal with a level insufficient to ejecting ink to the printing element.

In a twenty-first aspect of the present invention, there is provided an ink-detecting method for detecting ink in an ink-jet printing head which is capable of ejecting ink by an energy to be generated from the printing element, in an ink-jet printing apparatus for printing an image on a printing medium using such a printing head, comprising the steps of:

supplying an ink-detection drive signal to the printing element, where a level of the ink-detection drive signal is insufficient to eject ink; and detecting ink remaining in the printing head on the basis of a detection signal when the ink-detection drive signal is detected via ink in the printing head.

According to the present invention, changes in voltage between the printing element and the driving element occur when the printing element is driven or suspended. Such changes in voltage are transmitted with alternating current through ink. An insulation material such as a protective film provides electrical isolation between ink and a voltage-generating area where voltage is generated between the printing element and the driving element.

Concretely, the detection electrode detects changes in voltage to be transmitted with alternating current through ink. The presence or absence of ink is detected through voltage changes as the amount of remaining ink varies. Therefore, for example, a transmission part of the voltage-generating area to be transmitted with alternating current is provided so that it is electrically separated from each printing element. Then, the presence or absence of ink can be detected for every nozzle through the use of changes in electrical resistance.

According to the present invention, a signal source of ink-detecting signals is a printing element itself. As in the case of the conventional example described above, heat of the printing element is not utilized. Therefore, the detection electrode may be shared with all of the printing elements on the substrate. If the printing element is a heating element, furthermore, the detection electrode can be formed on the heating element concurrently with the formation of a anti-cavitation film thereon.

In the present invention, the detection of ink does not utilize heat, so that it can be applied to various printing systems using various printing elements because of its features in which changes in voltage occur when the printing element is driven.

In the present invention, a protective film such as an insulating film covers the surface of the detection electrode, so that the detection electrode can be prevented from incurring any physical or other change by making contact with ink. If the detection electrode is soaked in ink, the erosive action, adhesion, or the like of any constituent of the ink may be incurred depending on the type of the ink. Therefore, there is a fear of causing any change in a detection signal by such contact. The present invention permits the protection of the detection electrode without regard to the type of ink by coating the detection electrode with the protective film such as the insulating film, so that ink can be detected with a high degree of precision and a high accuracy of ink detection can be maintained for a long time.

According to the present invention, furthermore, if the printing element in the nozzle is driven by the driving element, the presence of ink can be detected as follows. That is, for example, changes in voltage occur in ink on the protective film provided as an insulating film on the top of the printing element and so on. Such changes in voltage can be detected by a detecting means such as an electrode through ink. In this configuration, a cluster of reference elements or a reference unit is mounted on a predetermined place in the same fashion as the above detecting means. Then, a difference between a signal detected by the above detecting means and a signal detected by the cluster of reference elements or the reference unit is calculated. The resulting difference allows a judgement of whether ink is present or absent at the predetermined portion where the detection has been performed. Accordingly, the impact of noise upon the above detection can be removed by the above difference.

As a result, it becomes possible to detect the amount of ink in the nozzle, especially the presence or absence of ink in each of the nozzles with precision by the simplified configuration of the ink-jet printing head.

According to the present invention, furthermore, a potential difference between the signal source and the driving element arises according to the activation of the energy-generating element. The changes in potential are detected by the detection electrode through ink in the printing head, so that the condition of supplying ink can be detected with respect to the temperature of the inside of a nozzle. Comparing with that of the prior art, there is no need to fabricate temperature sensors or the like. Therefore, the ink-jet printing head can be constructed more compactly and more cheaply. According to the present invention, furthermore, a protective film is formed on the signal source, which is different from the energy-generating element, so that a signal to be detected by the detection electrode can be amplified to detect the signal with a high degree of precision.

If the wiring for electrically connecting between the energy-generating element and the driving element is formed on a layer below the signal source formed on the substrate, the printing head can be protected from the impact of noise generated from the wiring or the like, resulting in an improvement in S/N.

Furthermore, all compositions except the energy generating element and the driving element may be covered with an organic film. In this case, the detection signal may be protected from noise consisting of signals from various logic circuits, wiring, and so on, resulting in detection with an even higher degree of precision.

According to the present invention, still furthermore, the ink-detection driving signal of an intensity insufficient to eject ink can be supplied to the printing element of the printing head. In this case, the ink-detection driving signal is detected through ink in the printing head to generate a detection signal. Then, the presence or absence of ink can be determined in response to the detection signal. Therefore, ink in the printing head can be detected with a high degree of precision by a considerably simple structure while the ink is kept under a stable environmental condition.

The above and other objects, features and advantages of the present invention will become more apparent from the following description of embodiments thereof taken in conjunction with the accompanying drawings.

BRIEF DESCRIPTION OF THE DRAWINGS

FIG. 27 is an explanatory diagram for explaining an input signal for ink ejecting capable of applying a current to the heater in accordance with the nineteenth preferred embodiment of the present invention;

FIG. 28 is an explanatory diagram that illustrates the changes in the shape of a bubble which is generated when the input signal is applied to the heater as shown in FIG. 27;

FIGS. 29A, 29B, and 29C are explanatory diagrams that illustrate the bubble sizes at different points in time shown in FIG. 28, respectively;

FIG. 30 is an explanatory diagram of the detection signal at the time of applying an input signal to the heater of FIG. 27;

FIG. 31 is an explanatory diagram for explaining an input signal to be applied to the heater in accordance with the twentieth preferred embodiment of the present invention;

FIG. 32 is an explanatory diagram that illustrates the changes in the shape of a bubble which is generated when the input signal is applied to the heater as shown in FIG. 31;

FIGS. 33A, 33B, and 33C are explanatory diagrams that illustrate the bubble sizes at different points in time shown in FIG. 32, respectively;

FIG. 34 is an explanatory diagram of the detection signal at the time of applying an input signal of FIG. 31 to the heater;

FIG. 35 is an explanatory diagram that illustrates the transmission of an input signal to be applied to the heater in accordance with the twenty-first preferred embodiment of the present invention;

FIG. 36 is an explanatory diagram that illustrates the changes in the shape of a bubble which is generated when the input signal is applied to the heater as shown in FIG. 35;

FIGS. 37A, 37B, and 37C are explanatory diagrams that illustrate the bubble sizes at different points in time shown in FIG. 36, respectively;

FIG. 38 is an explanatory diagram of the detection signal at the time of applying an input signal of FIG. 35 to the heater.

DETAILED DESCRIPTION OF THE PREFERRED EMBODIMENTS

Hereinafter, we will describe preferred embodiments of the preset invention with reference to the attached drawings.

First Preferred Embodiment

Figure 1:
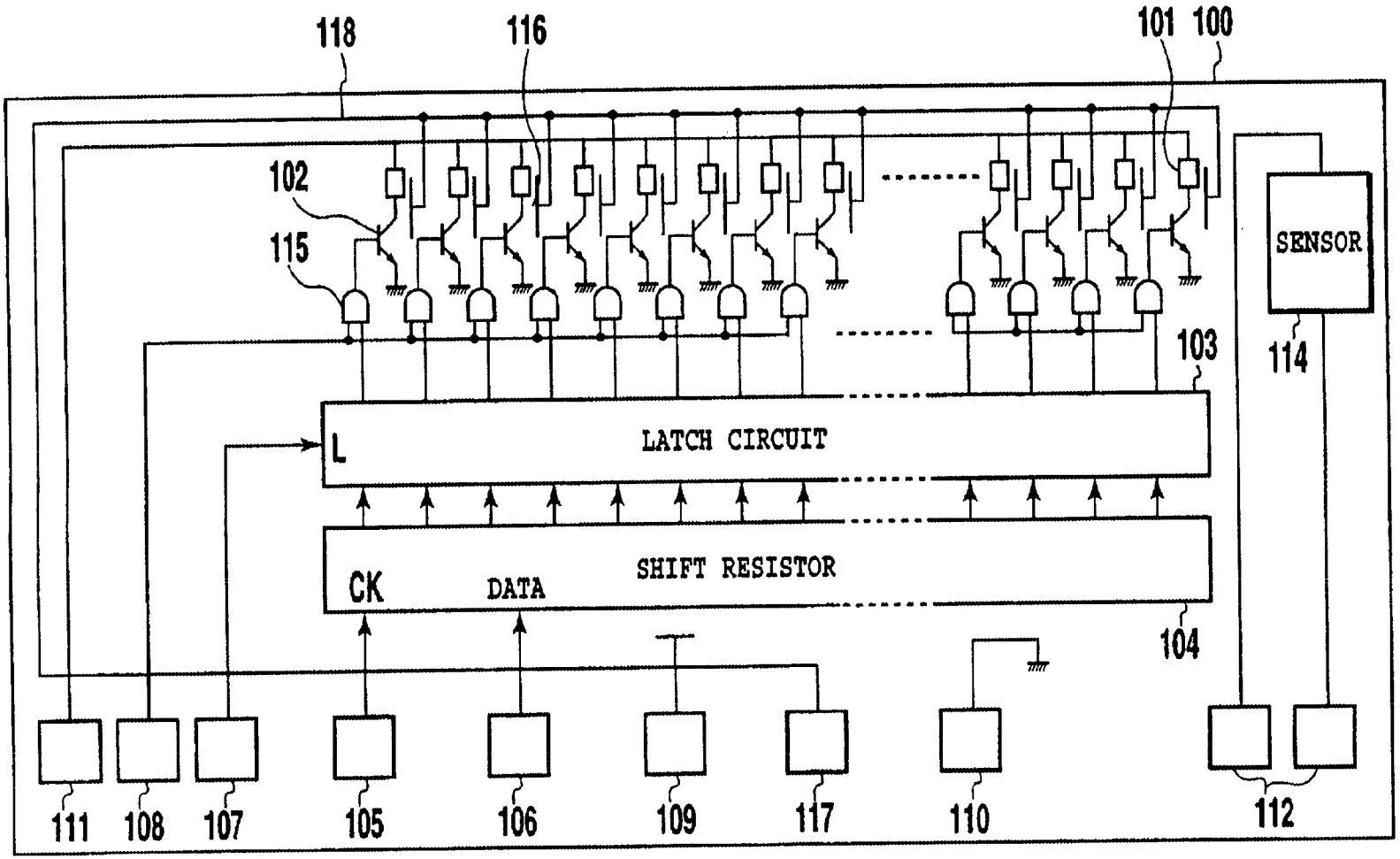
FIG. 1 is a schematic circuit diagram that illustrates a general electrical configuration of the substrate for the printing head as the first preferred embodiment of the present invention.

FIG. 1 is an explanatory illustration showing a construction of a substrate for an ink-jet printing head according to the present invention. FIG. 1 illustrates the major construction necessary for explaining the present invention. In the present invention, the construction and the number of elements and electrodes are not limited to those of FIG. 1.

Figure 9:
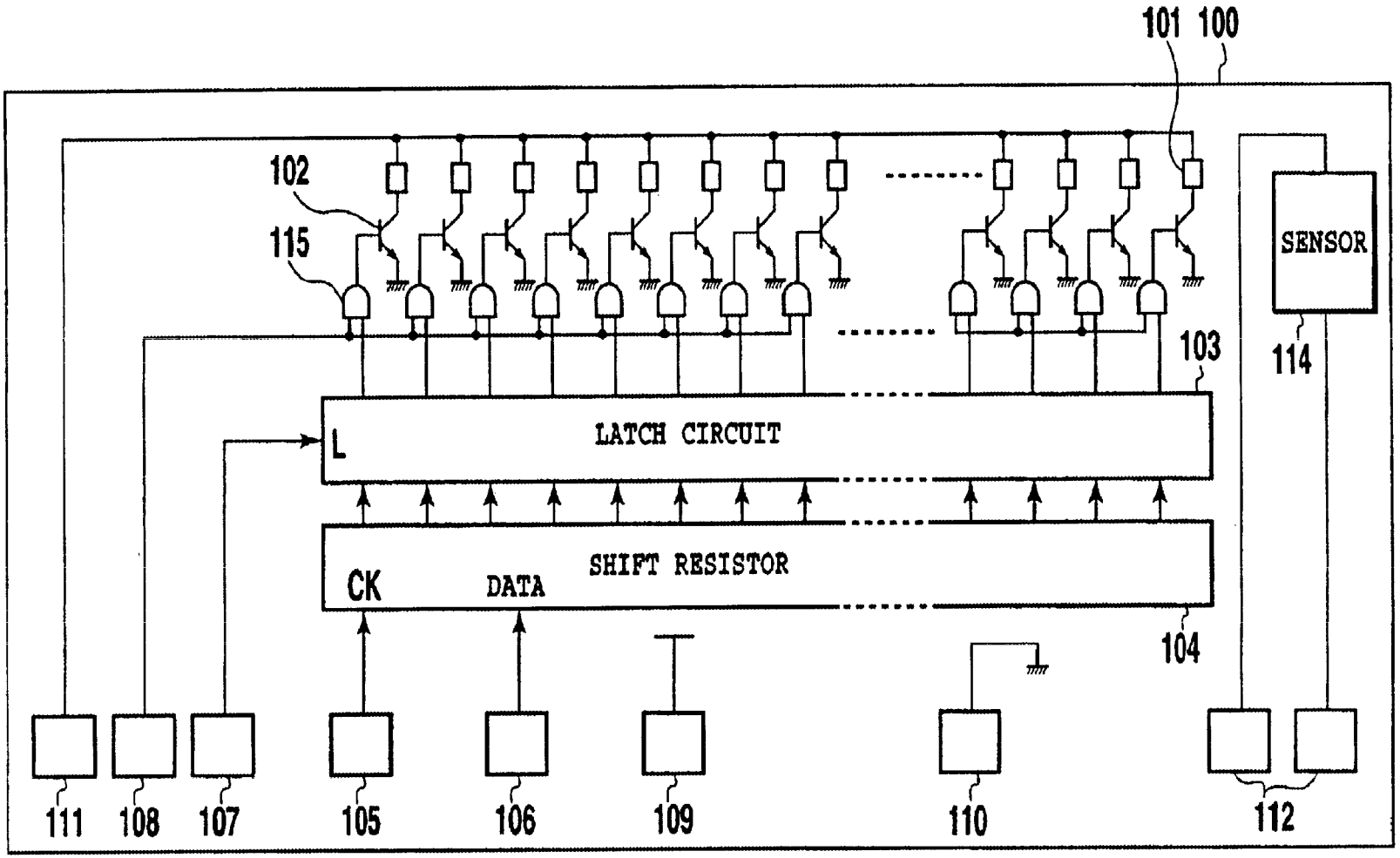
FIG. 9 is a schematic circuit diagram that briefly illustrates an electrical configuration of the conventional ink-jet printing head substrate.

Referring now to FIG. 1, basic components that makes up a substrate for an ink-jet printing head of the present invention are just as in the case of the conventional substrate shown in FIG. 9, except that the substrate of present embodiment further includes a detection electrode 118 for detecting the presence or absence of ink with respect to the substrate 100 of the printing head. Comparing with the conventional design, as shown in the figure, the present embodiment is designed specifically for detecting the presence or absence of ink without requiring a substantially more complicated structure. As disclosed later, the detection electrode 118 is coupled to a driving circuit of heater 101 through a protective film 405, an anti-cavitation film 205, and ink in the inside of a nozzle with alternating current. In FIG. 1, the reference numeral 116 denotes a coupled portion with alternating current to be provided as a capacitor in an equivalent circuit.

Figure 11:
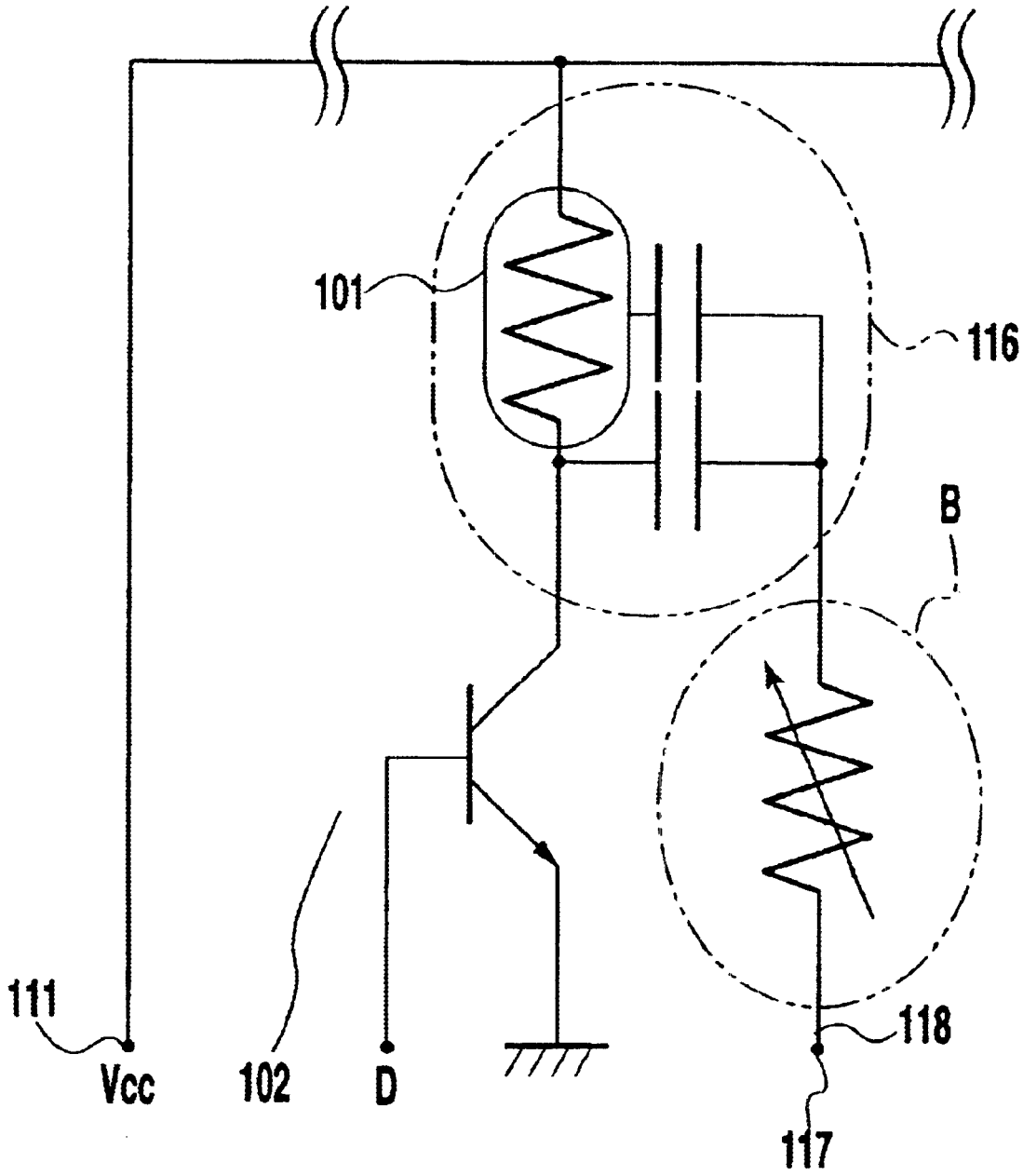
FIG. 11 is schematic circuit diagram that briefly illustrates an ink detection circuit formed on the substrate for the printing head in accordance with the preferred embodiment of the present invention.

FIG. 11 illustrates an equivalent circuit for detecting the amount of ink in a nozzle, with a particular emphasis on the above coupled portion. A protective film formed on a heater 101 and a driver 102 is provided as an electrically insulating layer for the anti-cavitation film and ink, so that it serves the function of a capacitor. In the figure, therefore, the protective film is marked as a capacitor. In this circuit, furthermore, the variations in potential with respect to components (such as the driver 102) of a driving system will be represented by the variations in potential with respect to the anti-cavitation film and the ink through the above capacitor with alternating current.

In FIG. 11, a portion surrounded by a broken line B is one where the ink is present in a normal condition. That is, as described later, it is a portion where the variations in electrical resistance occur in response to the remaining amount of ink. In FIG. 11, by the way, an alphabetical letter "D" denotes a driving signal from AND gate 115 (see FIG. 1).

Referring now to FIG. 2, FIG. 3, FIG. 4, and FIG. 7, a basic configuration of the present invention and the operating principles of detecting ink in each nozzle are described.

Figure 2:
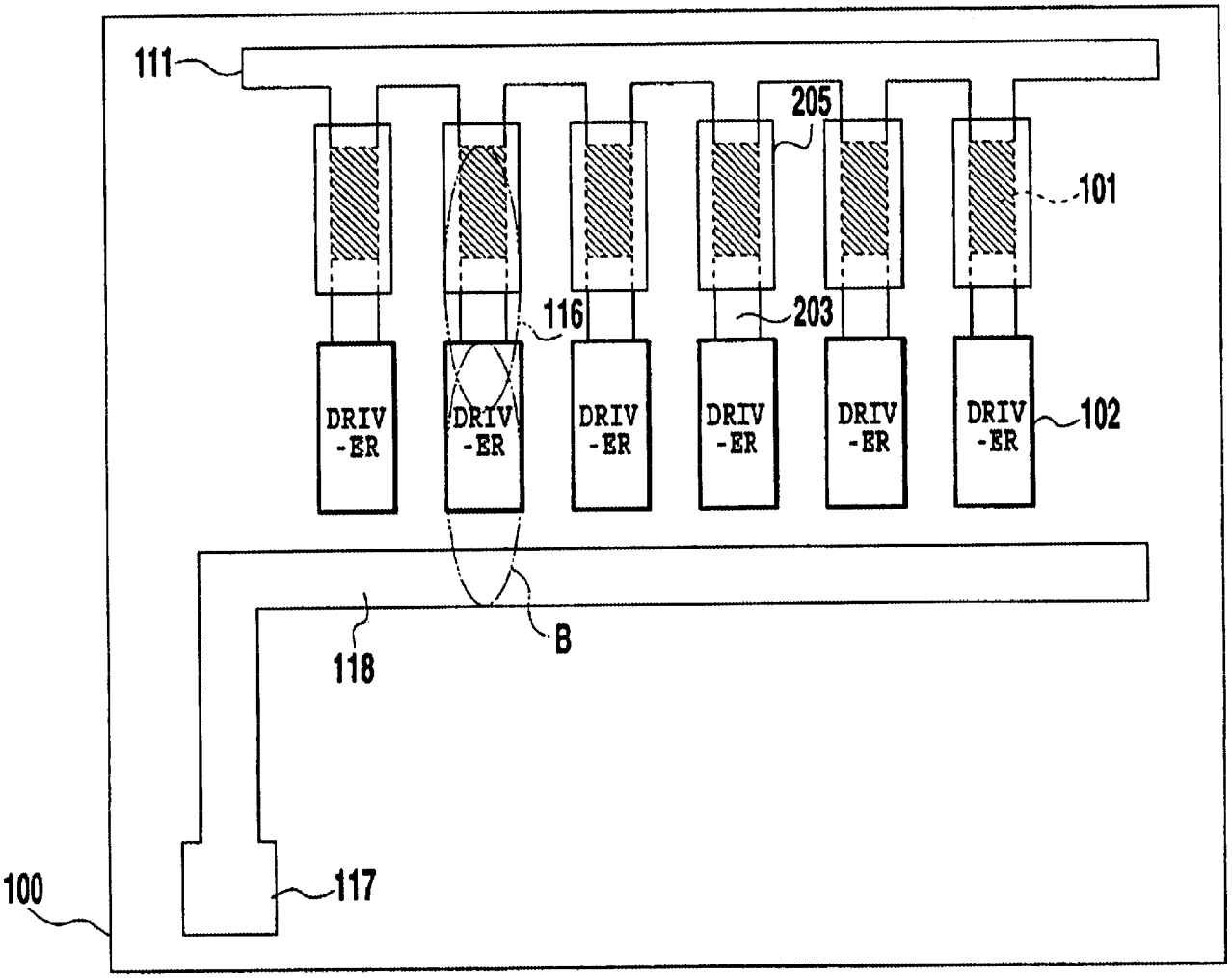
FIG. 2 is a plane view that briefly illustrates the prime constituents of the substrate for the printing head shown in FIG. 1.
Figure 3:
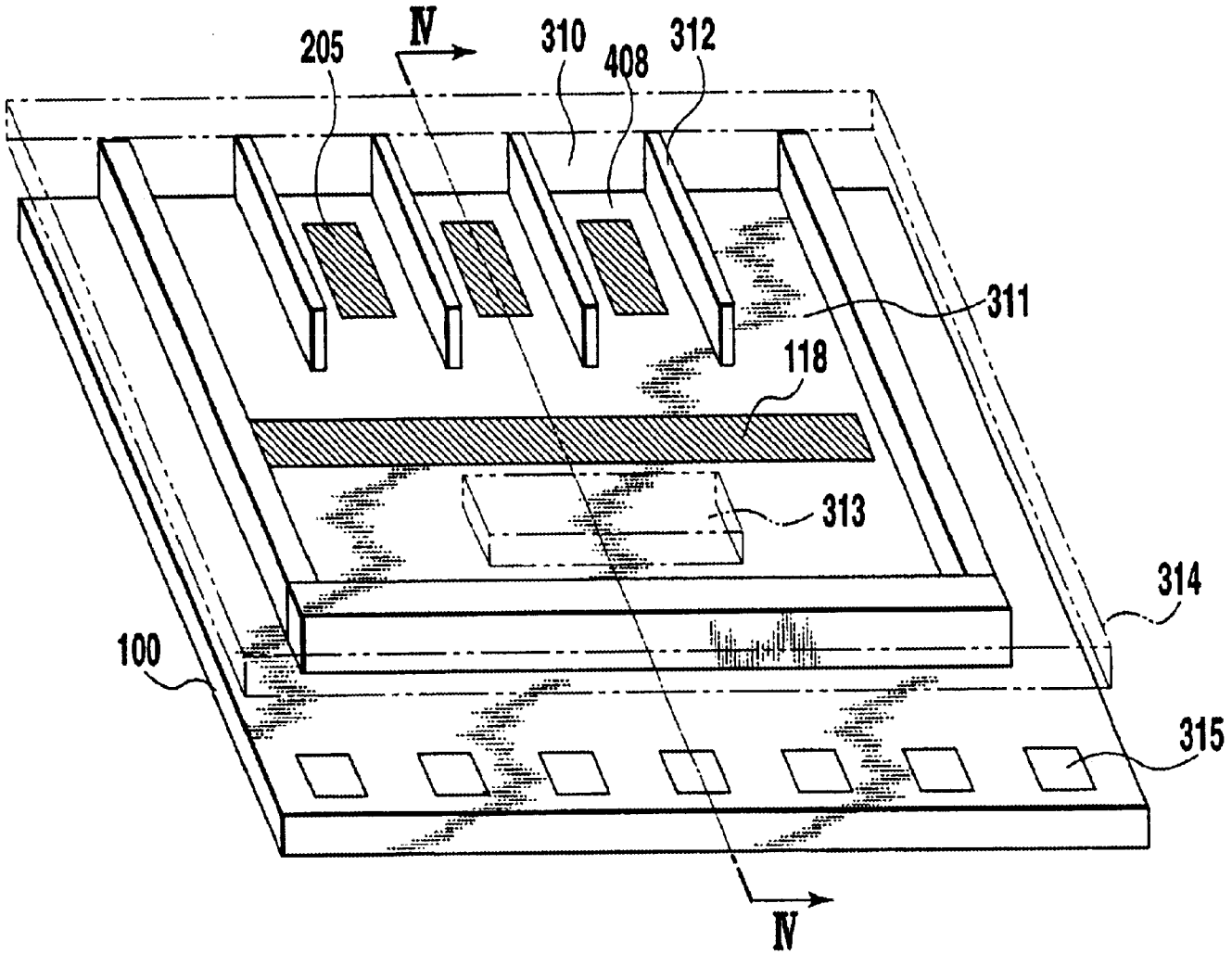
FIG. 3 is a schematic perspective diagram that illustrates the substrate for the printing head shown in FIG. 1 on which a top plate (indicated by dashed line) is attached to form a plurality of nozzles.
Figure 4:
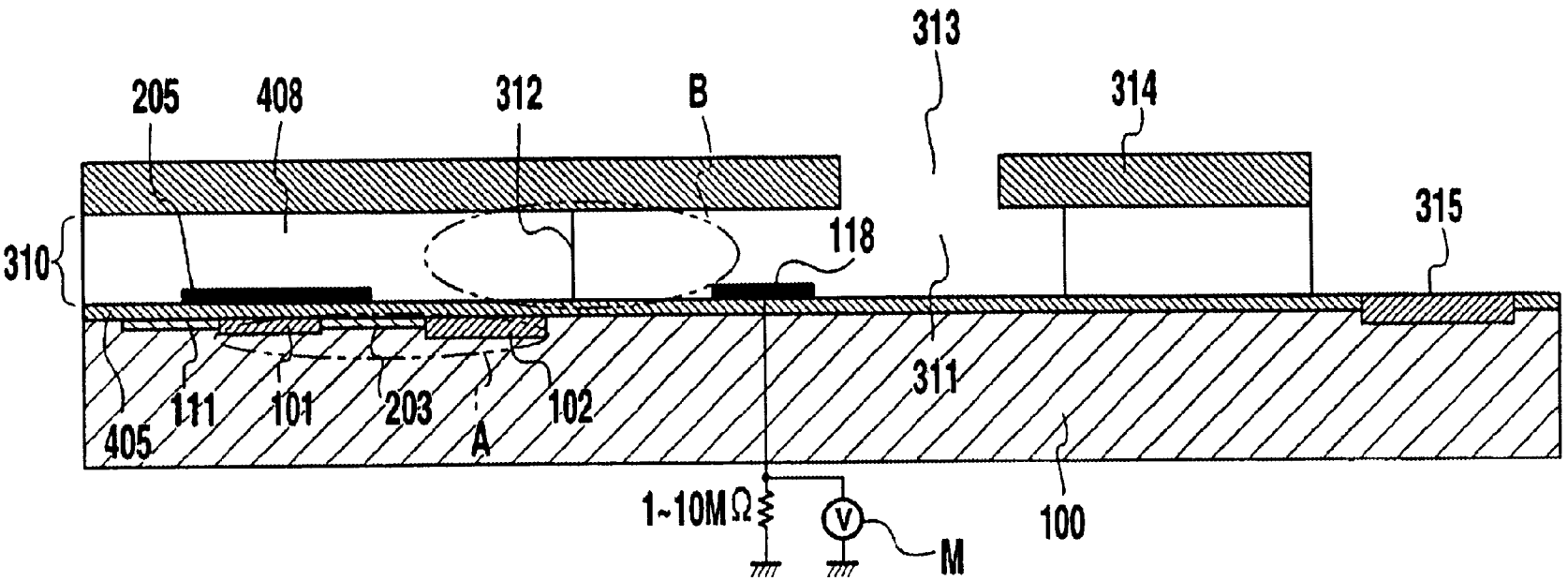
FIG. 4 is a cross-sectional diagram of the periphery of a nozzle in the inkjet printing head along line IV–IV of FIG. 3.
Figure 7:
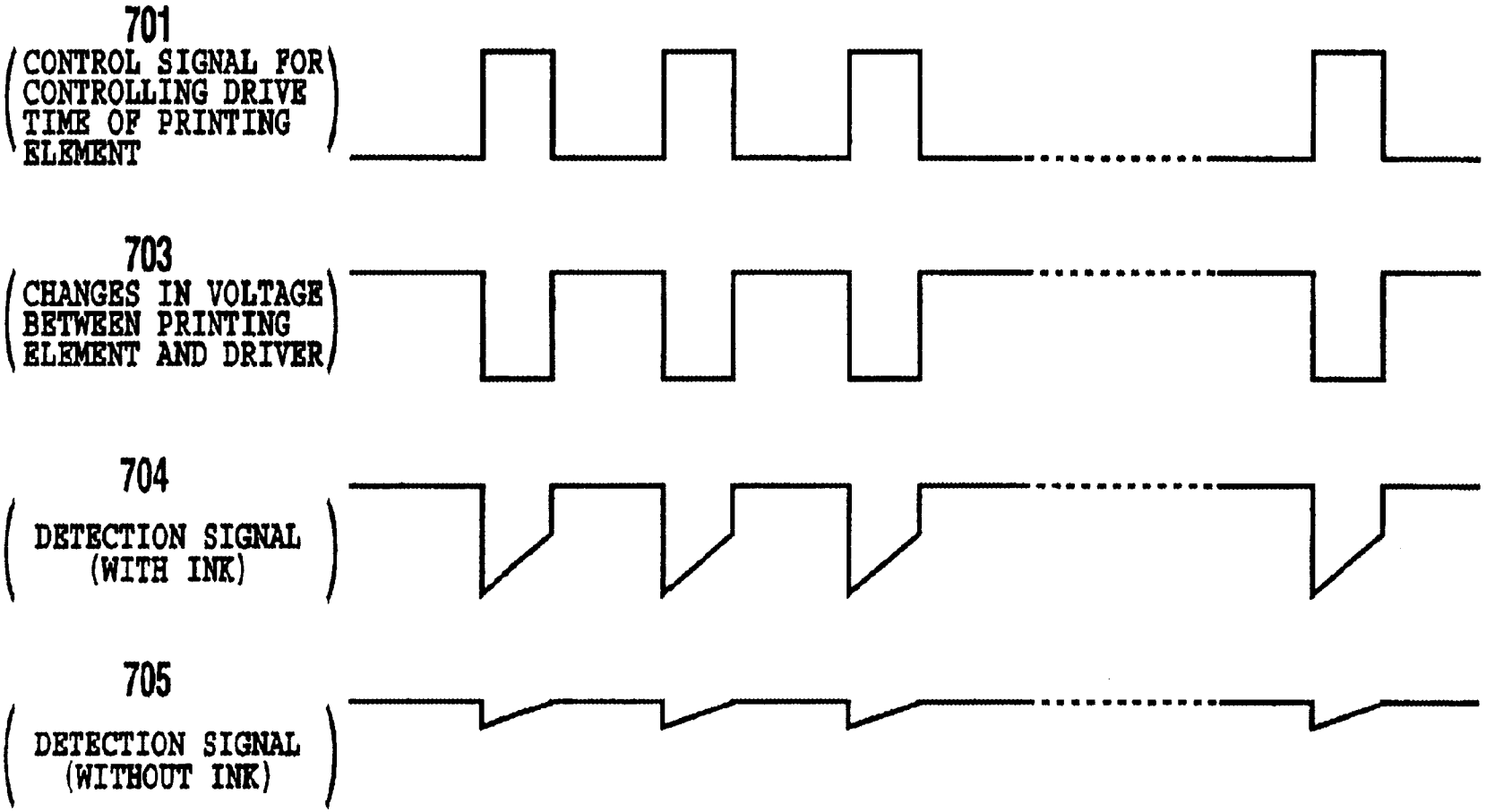
FIG. 7 is a time chart for illustrating the ink detection operation of the ink-jet printing head in accordance with the first preferred embodiment of the present invention.

FIG. 2 is a plane view that illustrates a general configuration of the substrate for the ink-jet printing head shown in FIG. 1. In this figure, an arrangement of elements, electrodes, and terminals on the substrate is illustrated. FIG. 3 is a schematic perspective view that illustrates an assembled structure in which a top plate and the substrate shown in FIGS. 1 and 2 are connected together to construct ejecting ports and nozzles. FIG. 4 is a cross-sectional view along a line a—a in FIG. 3 and shows the substrate and nozzles formed thereon in the assembled structure in which a top plate and the substrate are connected together. Furthermore, FIG. 7 illustrates the condition of the voltage at each part on the substrate for the printing head at the time of driving the thermal element as the printing element.

Referring again to FIG. 2, specific components of the substrate for the printing head in accordance with the present embodiment are illustrated by means of a plane view shown from above. As with FIG. 1, the reference numeral 101 in FIG. 2 is an electrical heating element (hereinafter, referred to as a heater) to be used as a printing element and driven by a driver 102 provided as a driving element. The reference numeral 203 denotes wiring for connecting between one end of the heater 101 and the driver 102. The reference numeral 111 denotes wiring for supplying power-supply voltage to the other end of the heater 101. In addition, as shown in FIG. 4, the electrically insulated protective film (protective layer) 405 is formed on the heater 101, so that an anti-cavitation film 205 is formed above the heater 101 through the protecting film 405. By the way, the protective film 405 is not represented graphically in FIG. 2 for the purpose of explaining an arrangement of the heater 101, the driver 102, and so on. Furthermore, the ink-jet printing head applied in the present embodiment is based on the so-called bubble jet system in which a bubble is formed in ink in the nozzle by a thermal energy generated by driving the heater 101 and then ink is ejected from the ejecting port 310 (see FIGS. 3 and 4) by the pressure generated by the growing bubble. The anti-cavitation film 205 described above is made of a high-melting metal such as tantalum and provided for the purpose of preventing the heater 101 and the protective film 405 from the impact of a shrinkage of the bubble generated at the time of ink ejecting. The reference numeral 118 denotes electrode wiring, 117 denotes an outer terminal for electrically connecting the electrode wiring 118 to the outside of the substrate.

One of the specific configurations of the substrate for the printing head of the present embodiment is that the anti-cavitation film 205 is divided into pieces to protect the heaters (printing elements) 101 in a one-to-one relationship. Another specific configuration of the substrate for the printing head is that the detection electrode 118 is positioned at a place not only far from the driver 102 but also far from the wiring between the heater 101 and the driver 102. The detection electrode 118 can be formed as a wiring pattern.

In the configuration of the substrate for the printing head shown in FIG. 2, the procedure for detecting the presence or absence of ink in the nozzle will be described below with reference to FIG. 3 and FIG. 4.

As described above, FIG. 3 is a schematic perspective view that illustrates the state of mating the substrate 100 for the printing head and the top plate 314 together. The binding between the top plate 314 and the substrate 100 forms the nozzle portions 408 (see FIG. 4) and the common liquid chamber 311. In FIG. 3, by the way, the configuration of the upper wall member of the top plate 314 is represented by a broken line for explaining the configuration of the nozzle portions 408 and the common liquid chamber 311. In addition, as shown in FIG. 2, the reference numeral 205 denotes an anti-cavitation film. As described above, furthermore, the heater 101 provided as the printing element is positioned below the anti-cavitation film 205, while the insulating protective film 405 is positioned on the top of the heater 101. Therefore, the heater 101 is not represented in FIG. 3. The driver 102 for driving the heater 101 may be also not represented in FIG. 3 because of the same reason.

In the present embodiment, the important thing is the relation among the portion of heater 101 (not shown in FIG. 3) including the anti-cavitation film 205 being divided for every nozzle, the driver 102 (not shown in, FIG. 3), the nozzle portion 408 formed by the nozzle walls 312, and the detection electrode 118 for the ink detection.

In FIG. 4, the driving electric power to be supplied from the power source through a power source wiring 111 is fed to the heater 101 by a switching operation of the driver 102 to generate a heat energy. Therefore, the thermal energy permits the generation of a bubble in a nozzle to eject ink from the ejecting port 310.

At the stage before driving the heater 101 by switching the driver 102 (i.e., when the driver 102 is switched off), the potentials of the respective portions are related to each other as follows. That is, potential of the heater 101, potential of the wire 203 between the heater 101 and the driver 102, potential of partial wiring on the driver 102 (ranging from a portion acting as a switch in the driver 102 and a portion on the side of heater 101) becomes identical with potential of the heater power-supply wiring 111, respectively. In addition, ink (in general, the ink composition includes ions, so that the ink has electric conductivity) is electrically floated. That is, the ink is in the state of high impedance with direct current with respect to GND (ground). Therefore, the potential of the anti-cavitation film 205 on the protective film 405 to be an electrically insulating film is electrically floated, that is, the anti-cavitation film 205 is in a state of high impedance with direct current with respect to GND. Similarly, the potential of the detection electrode 118 is fundamentally floated with direct current, so that the potential of the detection electrode 118 can be almost determined by an input impedance of the device being connected for the purpose of detecting the potential of the detection electrode 118. In the present embodiment, for detecting the potential of the detection electrode 118, a resistance of 1 M to 10 MΩ and a voltage monitor are connected in parallel between the detection electrode 118 and the GND. Therefore, the detecting voltage is 0 volt at the stage before driving the heater 101.

On the other hand, the current passes through the heater 101 as a matter of course when the heater 101 is driven (i.e., the driver 102 is switched on to make a connection between the wire 203 and the GND). In this case, the potential decreases as the heater 101 is located closer to the driver 102, while the potential of the wiring between the heater 101 and the driver 102 and the potential of the part of wiring on the driver 102 are sharply decreased to almost GND level. In FIG. 4, an area surrounded by a broken line "A" represents an area where a sudden voltage drop at the time of driving the heater 101 is observed. If the voltage has suddenly dropped, the protective film 405 acts as the insulating film. The protective film 405 has acted as a dielectric film of a capacitor in terms of a direct current. It is clear that the changes in potential are transmitted to the anti-cavitation film 205 which is placed on a portion of the protective film 405 extending from the heater 105 to the driver 102 and also transmitted to ink located on that portion in terms of an alternating current.

Thus, if the ink is in both the nozzle portion 408 and the common liquid chamber 311, the changes in potential are consequently transmitted to the detection electrode 118. On the other hand, if the ink is absent from the nozzle portion 408 and/or the common liquid chamber 311, the changes in potential are transmitted to the portion of the anti-cavitation film 205. However; electrical resistance of the nozzle portion 408 between that portion (the portion of the anti-cavitation film 205) and the detection electrode 118 and/or the common liquid chamber 311 is extremely increased. In the latter case (case of ink absence), furthermore, the changes in potential to be transmitted to the detection electrode 118 are markedly lowered or reduced almost to nil. In this way, the changes in potential can be varied in response to the amount of ink in the nozzle portion 408 and/or the common liquid chamber 311, or in extreme cases in response to the presence or absence of ink. Therefore, by the changes in potential, the amount of ink or in extreme cases the presence or absence of ink between the portion of the driving heater 101 and the detection electrode 118 can be detected.

In FIG. 2 and FIG. 4, an area surrounded by a broken line "B" indicates an area where the electrical resistance varies depending on the remaining amount of ink. That is, such an area exerts a large influence upon the changes in potential of the detection electrode 118. Furthermore, an area surrounded by a broken line 116 corresponds to a coupled portion shown in FIG. 1 and FIG. 11 in terms of an alternating current.

FIG. 7 is a timing chart for explaining an ink-detecting operation using the above operating principles of detecting ink. In the figure, the reference numeral 701 denotes an enable signal that determines a driving timing and a driving time (i.e., an elapsed time) of driving the heater 101. The heaters 101 are independently driven one by one in synchronization with the enable signals in response to driving-control signals (not shown) for the drivers 102. The reference numeral 703 denotes the potential of the wiring 203 between the heater 101 and the driver 102. Similar to the changes in potential 703, the potential of a portion of the heater 101 near the driver 102 and the potential of a portion of wiring on the driver 102 (i.e., a portion extending from a part that acts as a switch in the driver 102 to the heater 101) are also varied. An area including these portions, where the changes in voltage can be observed, is referred to as a voltage-changing area. On the heater 101, by the way, the changes in potential vary with the location of such an area and the potential increases as the distance between the area and the driver 102 is reduced. In addition, the surface potential of the insulating protective film 405 may be almost equal to the potential of the voltage-changing area under this film 405. The reference numerals 704 and 705 denote ink-detecting signals to be obtained by the changes in potential of the detection electrode 118. The detecting signal 704 is generated when the ink is present in the area "B" in FIG. 4, while the signal 705 is generated when no ink is present. If the ink is present in the area "B", the changes in potential to be detected by the detection electrode 118 and also the level of the detection signal 704 become large because of a small electric resistance of the area "B". If no ink is present in the area "B", on the other hand, the changes in potential to be detected by the detection electrode 118 and also the level of the detection signal 704 become small because of a large electric resistance of the area "B". Accordingly, it is found that the detection signal to be detected by the detection electrode 118 varies in response to the presence or absence of ink in the area "B". In this case, it is needless to say that the detection signal to be detected by the detection electrode 118 varies in response to the remaining amount of ink in the area "B".

The detecting signal from the detection electrode 118 is subjected to a time-division in response to a driving timing of the heater 101 to detect the remaining amount of ink (or in extreme cases the presence or absence of ink) in each driving nozzle. The detecting signal 704 in FIG. 7 is generated when ink is present in all of the driving nozzles. Similarly, the detection signal 705 in FIG. 7 is generated when no ink is present in all of the driving nozzles. Therefore, for example, if no ink is present in one of the driving nozzles, a detection signal corresponding to such a driving nozzle is only generated as a detection signal 705 of small variations and detecting signals corresponding to the other driving nozzles are generated as a detection signal 705 of large variations in the detection signal.

In the present embodiment, by the way, the changes in potential for every nozzle can be detected with reliability in response to the presence of absence of ink without any influence of the adjacent nozzle because the anti-cavitation films 205 are separated so as to individually correspond to each heater 101. In the present embodiment, furthermore, the anti-cavitation films 205 are separated so as to individually correspond to each heater 101 while the electrode 118 on the detection side is used as a common electrode of all nozzles. Thus, the presence or absence of ink in each of a plurality of nozzles can be detected using a detection signal from a single detection electrode 118 by driving each of the nozzles one by one with a time-division.

Furthermore, the heater 101 itself may be used as a signal source of ink-detecting signals, so that the detection of ink remaining in each nozzle can be performed using a logic circuit which is conventionally mounted on the printing head for constructing a sift register and so on. According to the present invention, therefore, the detection of remaining ink can be performed by an extremely simplified structure.

Figure 8:
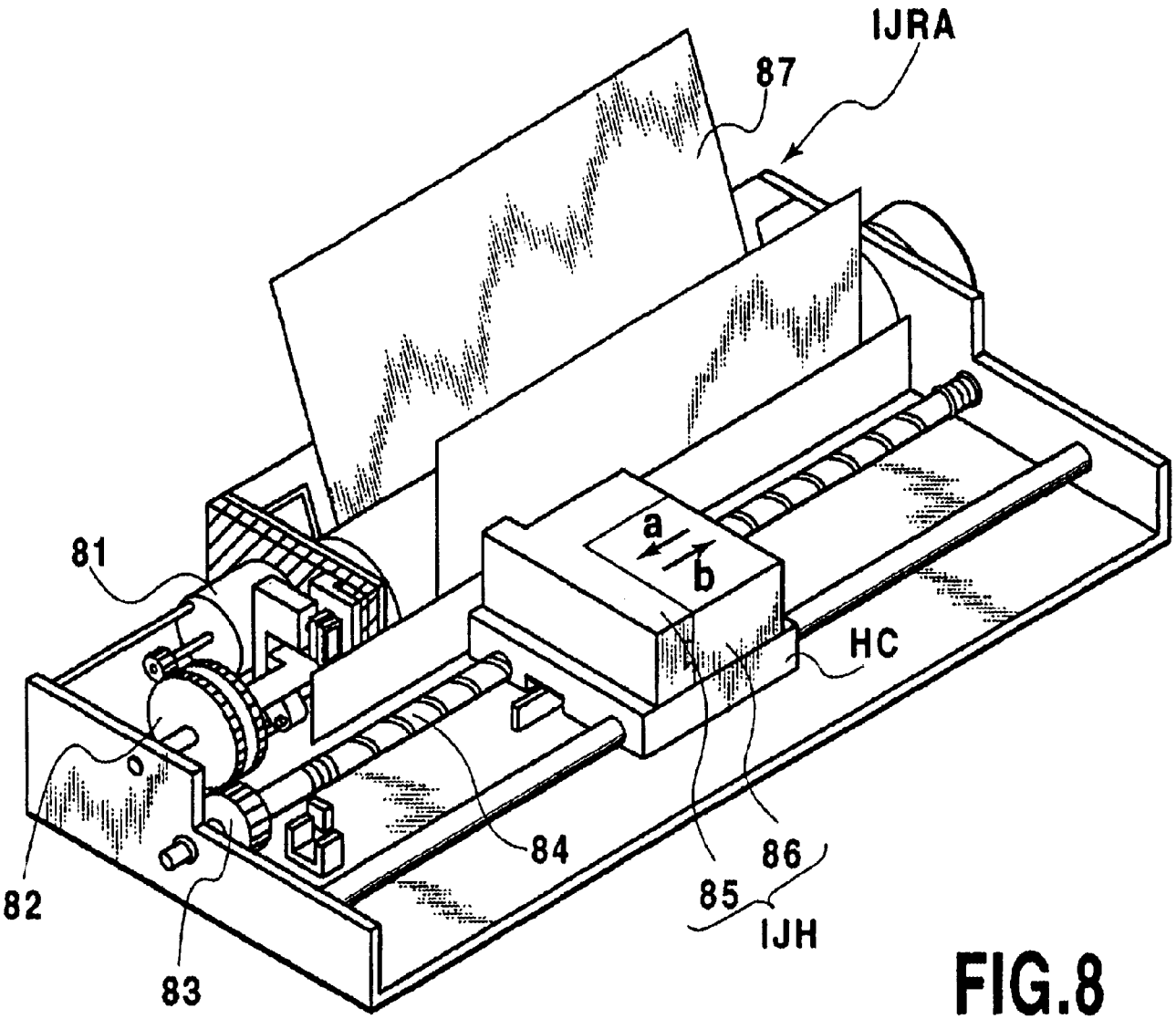
FIG. 8 is a perspective diagram that illustrates a general configuration of the ink-jet printing apparatus which is applicable to the present invention.

FIG. 8 is a schematic perspective view of an ink-jet printing apparatus (IJRA) to which the present invention can be applied.

As shown in the figure, a driving motor 81 imparts a rotary motion to a lead screw 84 in the normal and reverse directions through driving-force transmitting gears 82, 83. A carriage HC has a pin (not shown) engaged in a spiral groove formed on the peripheral surface of the lead screw 84. Thus, the carriage HC is able to reciprocate along the lead screw 84 in the directions of arrows "a" and "b" in response to the rotation direction of the lead screw 84. Furthermore, an ink-jet printing head 85 and an ink tank 86 are combined together to form a head cartridge IJH. The head carriage IJH can be removably mounted on the carriage HC. By the way, the ink-jet printing apparatus IJRA is the so-called serial printer that performs a printing movement on the whole surface of a printing sheet 87 (printing medium) by repeating a main-scanning movement of the carriage HC in the directions of the arrows "a" and "b" and a sub-scanning movement of the printing sheet 87 in an alternating sequence.

The ink-jet printing head 85 together with the carriage HC returns to its home position on the left side of FIG. 8 as necessary, so that it is subjected to a recovery procedure by a recovery-process portion (i.e., recovery means) 88 for recovering the ejecting condition of ink. The recovery-process part 88 comprises a cap member 88A that covers the surface of the printing head 85 on which a plurality of ink-ejecting ports are formed. Thus, ink which is not involved in the image formation can be drained by suction from the ink-ejecting ports by introducing negative pressure into the cap member 88A after capping the ink-ejecting ports. Accordingly, the ejecting condition of ink can be recovered by draining ink by suction from the ink-ejecting ports, for example draining ink together with air introduced into the nozzle from the ink-ejecting port or the common liquid chamber. If air is present in the nozzle, the volume of ink in the nozzle is lowered by about the same volume of air in the nozzle. It means that the volume of air in the nozzle can be detected by the same way as that of the method for detecting ink in the nozzle as described above. In addition, the recovering procedure is able to drain not only ink but also concentrated ink, contaminants, or the like out of the nozzle. Furthermore, the ejecting condition of ink can be recovered by ejecting ink from the ink ejecting ports to the cap 88, or equivalently, by ejecting ink which is not involved in the image formation from the ink-ejecting ports (hereinafter, also referred to as "primary ejecting"). Consequently, the recovery procedure is performed on the printing head at the recovery-process part 88 by performing the primary ejecting or the draining of ink which is not involved in the image formation.

A means for introducing a negative pressure into the cap member 88A includes pumping means such as a tube pump or a piston pump. Also, the ink or the like drained from the ink ejecting ports by suction is evacuated to the waste ink tank.

Figure 10:
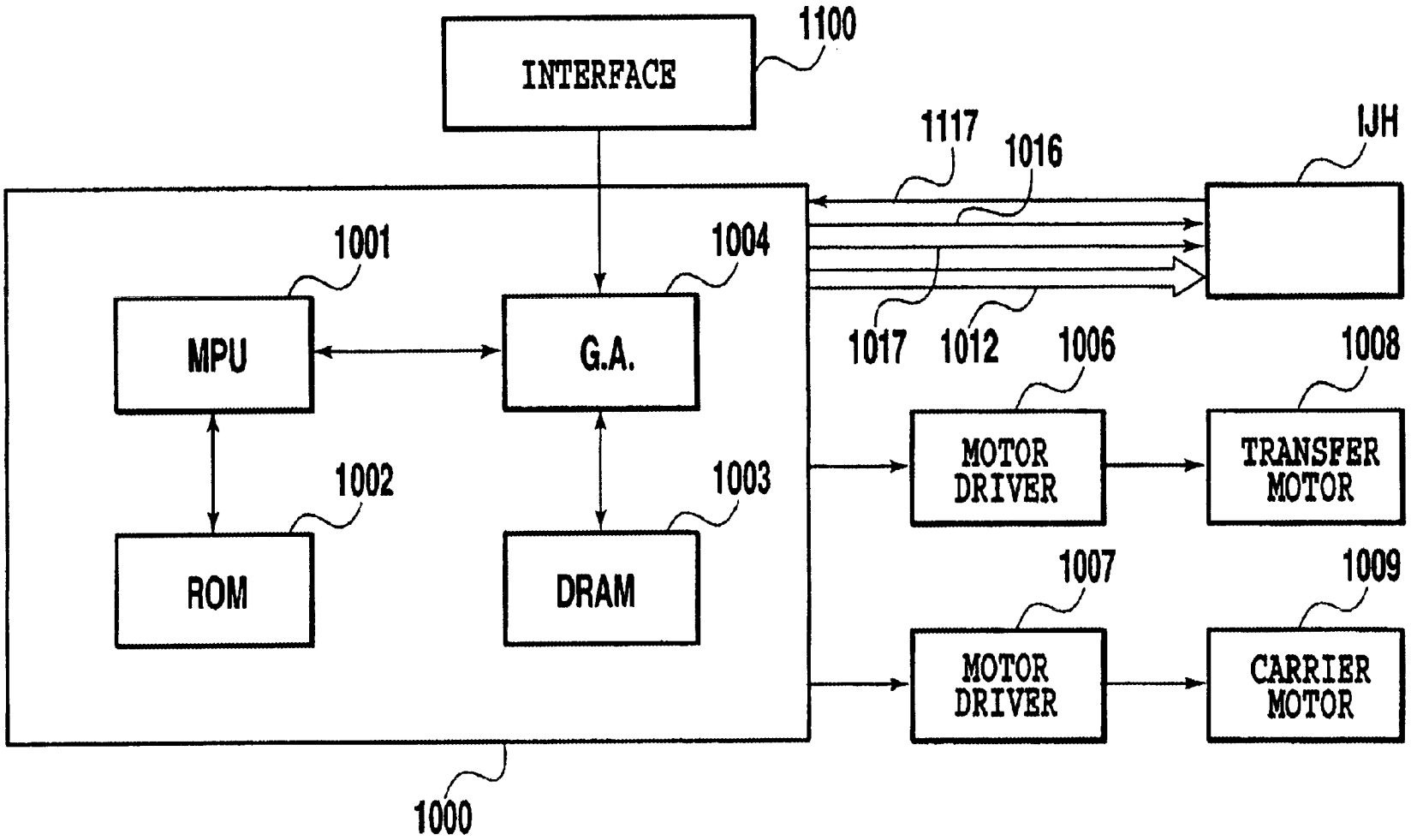
FIG. 10 is a block diagram that illustrates a control system of the ink-jet printing apparatus shown in FIG. 8.

FIG. 10 is a block diagram that illustrates the prime constituents of the control unit for controlling a printing movement of the inkjet printing apparatus shown in FIG. 8.

In FIG. 10, the reference numeral 1000 denotes a control circuit, and 1100 denotes an interface. The interface 1100 receives data transmitted from a host device or the like connected to the outside of the printing apparatus IJRA. The reference numeral 1001 denotes a microprocessor unit (MPU), 1002 denotes a program read-only memory (ROM) in which control programs to be performed by the MPU 1001 are stored, and 1003 denotes a dynamic random-access memory (RAM) for storing various kinds of data (such as printing signals described above and printing data to be supplied to the printing head). The reference numeral 1004 denotes a gate array (G.A.) for controlling the supply of printing data to the head cartridge IJH and also controlling the data transfer among the interface 1100, the MPU 1001, and the RAM 1003. The reference numeral 1009 denotes a carrier motor for moving the carriage HC (FIG. 8) on which the head cartridge IJH is mounted. The carrier motor 1009 corresponds to the driving motor 81 in FIG. 8. The reference numeral 1008 denotes a feed motor for feeding a sheet of printing paper 87 as a printing medium to the predetermined position. Furthermore, the reference numerals 1006 and 1007 denote motor drivers for the feed motor 1008 and the carrier motor 1009, respectively.

Referring again to FIG. 10, the reference numeral 117 denotes a signal line to be connected to the terminal 117. The detection electrode 118 of the substrate 100 for the printing head and the control circuit 1000 can be electrically connected together through the terminal 117. At the time of the ink detection, the amount of change in voltage in response to changes in the amount of ink is provided as an input signal into the control circuit 1000 in a main body of the printing apparatus from the terminal 117 through the signal line 1117. The reference numeral 1012 denotes a signal line for outputting various kinds of signals including an enable signal for driving the heater 101 provided as the printing element, a clock signal to be incident to a logic circuit of the substrate 100, and a latch signal. In addition, the reference numeral 1016 denotes a signal line for supplying a driving power from the power source (not shown) to the head cartridge IJH, where the driving power is responsible for driving the heater 101 provided as the printing element. The reference numeral 1017 denotes a signal line for supplying an electric power to the logic circuit of the substrate 100 mounted on the head cartridge IJH.

The control portion constructed as described above drives the heater 101 with any timing and receives a detection signal incident from the detection electrode 118 on the substrate 100 through the signal line 1117 and the terminal 117. Then, the presence or absence of ink in the nozzle can be detected by monitoring the detection signal. The timing of detecting the presence or absence of ink is optional, for example the presence or absence of ink in each nozzle can be detected by driving each of the nozzles one by one when the printing movement is not performed on the printing medium. In general, it is familiar with a primary ejecting for preliminary ejecting ink (i.e., the ejecting of ink which is not involved in the image formation) performed for recovering the ejecting condition of the ink-jet printing head. Thus, information concerning the presence or absence of ink in each nozzle can be individually obtained using the preliminary ejecting operation. In addition, however, it is also possible to detect ink during the printing movement.

Regarding the monitoring of a signal obtained by the detection electrode 118 can be performed by the MPU 1001 provided as a control means on the control circuit 1000. The control circuit 1000 performs an A/D (analog to digital) conversion of the ink-detecting signal incident from the detection electrode 118 and then determines the presence or absence of ink. In this case, the determination target may be a value obtained by integrating a voltage waveform as an ink-detecting signal, or the determination target may be a value of voltage instantly generated with a specific timing of the ink-detecting signal. Therefore, the ink-detecting signal is of no limited application. Also, the control circuit 1000 controls the ink-detection timing in addition to determine the results of the ink detection. Furthermore, the presence or absence of ink in each of the nozzles arranged in a predetermined pattern can be detected by corresponding the driving heater 101 with the potential variation. As a result, it is possible to specify a nozzle in a state that it is not able to eject ink because of the absence of ink or in a state that the nozzle has the potential for disabling the ink ejecting.

In the case of the substrate for the printing head of the embodiment, the anti-cavitation films 205 are isolated from each other with respect to their respective heaters 101. Thus, a potential change in each nozzle in response to the presence or absence of ink can be properly detected without any influence of the adjacent nozzle. In addition, the detection electrode 118 is provided as a common electrode for all of the nozzles and a detection signal from the detection electrode 118 are brought into correspondence with driving timing of each nozzle, so that the presence or absence of ink in each of the nozzles can be detected using the detection signal from one detection electrode 118. Furthermore, an ink-detecting signal source may be the heater 101 itself, so that the presence or absence of ink in each nozzle can be detected using a logic circuit which is conventionally mounted on the printing head for constructing a shift register and so on. According to the present invention, therefore, the detection of the presence or absence of ink can be performed by an extremely simplified structure.

Various systems may be adapted to driving the nozzles. Depending on the system of driving the nozzle, the presence or absence of ink in each of driving nozzles can be detected by bringing detecting signals from the detection electrode 118 into a correspondence with their respective driving nozzles. The system for driving the nozzles include a block-driving system well known in the art where a predetermined number of nozzles is grouped in one block and then the nozzles are driven on a block basis. In this case, the presence or absence of ink in the nozzle is determined on a block basis using a detection signal from one detection electrode 118. Furthermore, a single anti-cavitation film 205 may be applied to two or more nozzles (i.e., a predetermined number of nozzles) at once. If the nozzles are driven on a block basis, for example, two or more nozzles in the same block or a predetermined number of nozzles in the different block may be covered with a single anti-cavitation film 205 at once. In the preferred embodiment described above, the detection electrode 118 is used as a common electrode for a plurality of nozzles formed on the substrate 100. However, several detection electrodes 118 may be provided so that each of them corresponds to a predetermined number of nozzles.

The substrate 100 and the top plate 314 may be designed so that a nozzle is formed on each of the printing elements or formed on every two or more printing elements. Furthermore, the ink-jet printing apparatus may take advantage of an ink-detecting signal for example to control its printing movement in response to such a signal.

Second Preferred Embodiment

A second preferred embodiment of the present invention will be now described with reference to FIG. 15A.

In the first embodiment described above, as shown in FIG. 4, the detection electrode 118 is positioned at a location some distance from the driver 102. In the area "A", the potential varies with driving of the heater 101. In the configuration shown in FIG. 4, the protective film 405 is evenly formed on the substrate 100. According to the present invention, it is not limited to the configuration shown in FIG. 4. It is possible to make another configuration. For example, any modification may be made to a portion to be used as a signal source that brings about changes in potential by driving the heater 101.

Figure 5A:
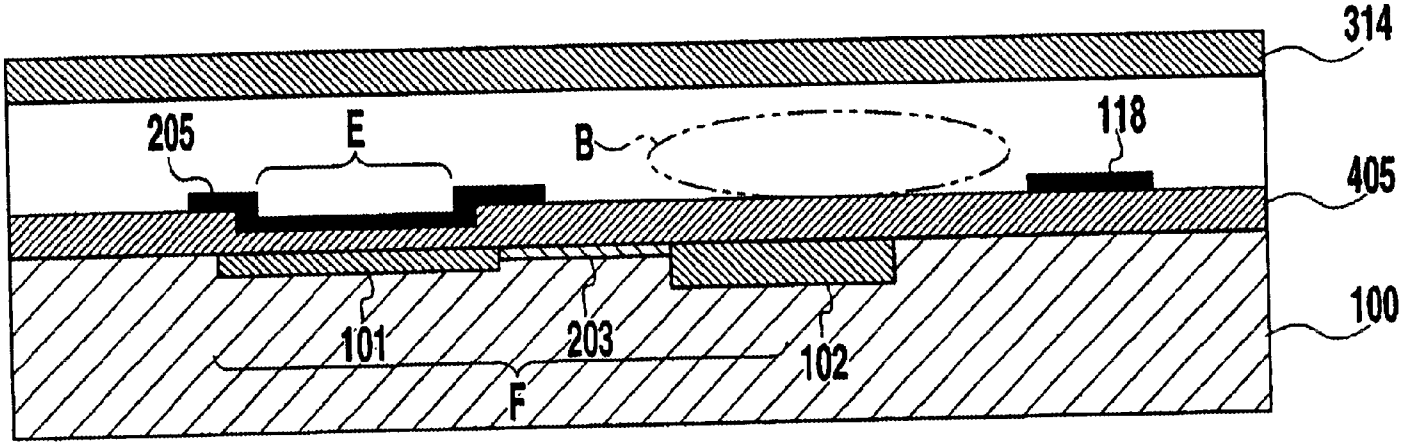
FIG. 5A is a cross-sectional diagram of the periphery of a nozzle in the ink-jet printing head in accordance with the second preferred embodiment of the present invention.

Referring now to FIG. 5A, there is shown the present embodiment which is different from the one shown in FIG. 4 in that the thickness of the protective film 405 positioned at a portion "E" on the heater 101 is less than that of the other portions. The configuration, shown in FIG. 5A allows the increase in capacitance of the portion "E" with a less thickness. It eventually enlarges the changes in potential to be transmitted to ink in the nozzle, so that it increases the sensitivity of detecting ink by the detection signal from the detection electrode 118. As the portion "E" has a large capacitance, therefore, the portion "E" can be provided as an extremely strong part in a signal source "F" for generating ink-detecting signals. The signal source "F" includes a portion of the heater 101 close to the driver 102, wiring 203, and a part of wiring on the driver 102 (a part of the driver 102, extending from a portion that acts as a switch to a portion on the heater's side) to form a voltage-variation area. Consequently, the present embodiment allows the detection of the presence or absence of ink in the portion "B" between the portion "E" and the detection electrode 118 in the nozzle.

Third Preferred Embodiment

Figure 5B:
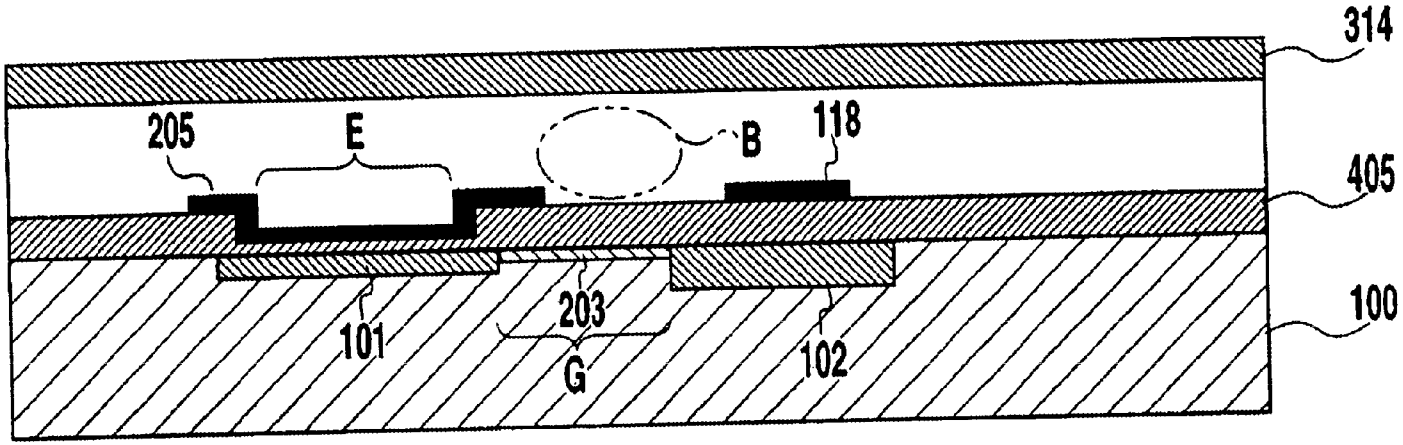
FIG. 5B is a cross-sectional diagram of the periphery of a nozzle in the ink-jet printing head in accordance with the third preferred embodiment of the present invention.

In FIG. 5B, the present embodiment is almost the same as the first and second embodiments except that the thickness of the protective film 405 positioned at a portion "E" on the heater 101 is less than that of the other portions and the detection electrode 118 is positioned above the driver 102. In addition, the thickness of the protective film 405 at the portion "E" is less than that of the second embodiment shown in FIG. 5A. The configuration shown in FIG. 5B allows an increase in capacitance of the portion "E" with less thickness. A capacitance at the portion "E" can be adjusted so as to be larger than a capacitance at a wiring portion 203 between the heater 101 and the driver 102. An alphabetical letter "G" in FIG. 5B denotes a signal source comprising the wiring portion 203. If the detection electrode 118 is positioned above the driver 102 and the detection electrode 118 is brought nearer to the portion "E", the presence or absence of ink in the portion "B" localized between them can be detected.

Fourth Preferred Embodiment

Figure 6:
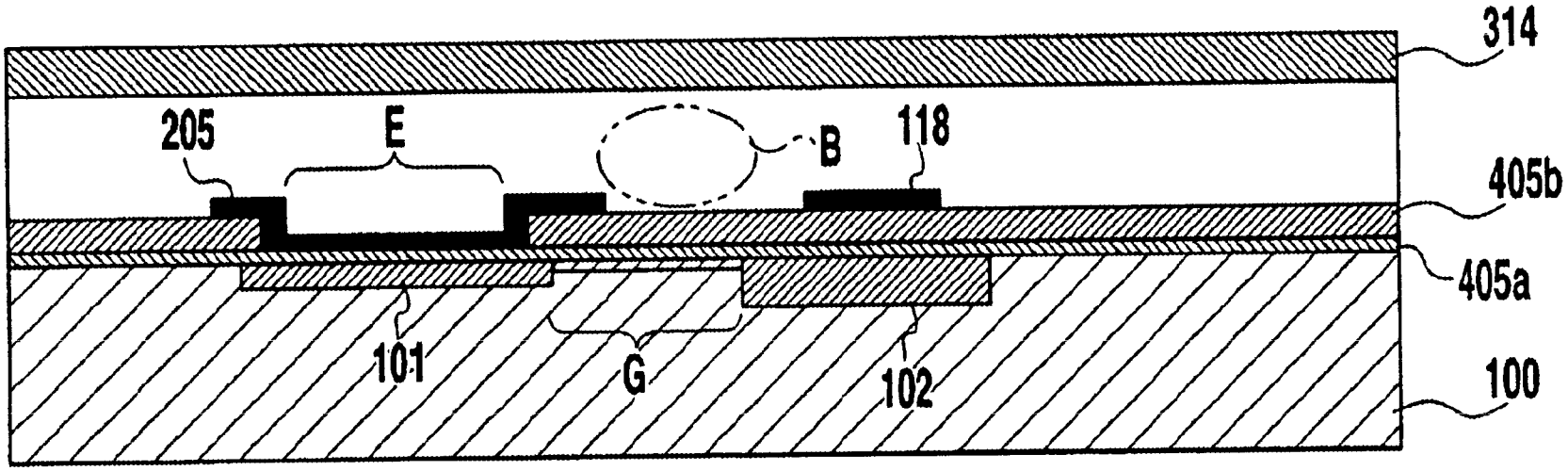
FIG. 6 is a cross-sectional diagram of the periphery of a nozzle in the ink-jet printing head in accordance with the fourth preferred embodiment of the present invention.

In FIG. 6, according to the present embodiment, the thickness of the protective film 405 positioned at a portion "E" on the heater 101 is less than that of the other portions and also the protective film 405 comprises two different protective films 405*a*, 405*b*. In addition, the anti-cavitation film 205 located above the heater 101 is formed on the protective film 405*a*. The protective films 405*a*, 405*b* have different relative dielectric constants, respectively. More specifically, the protective film 405*a* is made of a material having a relative dielectric constant larger than that of the protective film 405*b*. Consequently, the portion "E" becomes a much stronger signal source since the protective film 405*b* on the heater 101 is prepared as a thin film having a high dielectric constant, so that the sensitivity of detecting ink can be further increased.

Accordingly, the present embodiment makes it possible that an increase in the efficiency of energy-transfer in the protective film on the heater can be attained by decreasing the thickness of a portion of the protective film above the heater 101 and increasing a dielectric constant of that portion. The present embodiment is constructed as described above, so that the heater portion strongly acts as a signal source. Therefore, the position to be provided as a signal source can be inevitably limited to a specific position on the heater. Furthermore, the other portions except the upper side of the heater are modified in such a manner that the heater does not act as the signal source and that the influence of noise that leads to error detection can be reduced. As a result, the sensitivity to detect ink can be increased and thus the detection of the presence or absence of ink can be performed with a precision never before possible. As described above, furthermore, the signal source is located within a restricted area, so that the detection electrode can be flexibly installed on a desired place such as the driver.

By the way, each of the embodiments described above has been described with respect to a bubble-jet printing system that allows the ejecting of ink using the heating element provided as the printing element. However, there are other printing systems in which a voltage-change occurred by actuating the printing elements can be detected through ink. According to the present invention, therefore, one of these printing systems may be applied in the present invention instead of the bubble-jet printing system. An example of such printing systems is the one using a piezoelectric element as a printing element. The accuracy of detecting ink can be increased when a driving signal with an insufficient strength for the ink ejecting is supplied to the piezoelectric element. In other words, if a driving signal with a sufficient strength for the ink ejecting is supplied to the piezoelectric element at the time of detecting ink in the nozzle, significant changes in the volumetric capacity of the nozzle and ink meniscus in an ink-ejecting port occur. These changes may cause an unstable detecting signal and thus the accuracy of detecting ink may be decreased. According to the present invention, however, a stable detecting signal can be obtained and the accuracy of detecting ink can be also increased because of supplying a driving signal with an insufficient strength for ejecting ink to the piezoelectric element at the time of detecting ink in the nozzle. Accordingly, the present invention allows the detection of ink with a high precision using a driving signal of one selected from various kinds of printing elements as a driving source while ink is kept under stable surrounding conditions. Thus, the present invention can be widely adapted to printing heads having various kinds of printing elements.

In the configuration of each of the above embodiments, the exemplified substrate for the ink-jet printing head is the one having the anti-cavitation film formed above the heater for protection from the impact caused when a bubble begins to shrink and disappears. According to the present invention, however, the operating principles of detecting ink can be applied on the ink-jet printing head using electrical-conductive ink without having the anti-cavitation film.

Fifth Preferred Embodiment

Figure 12:
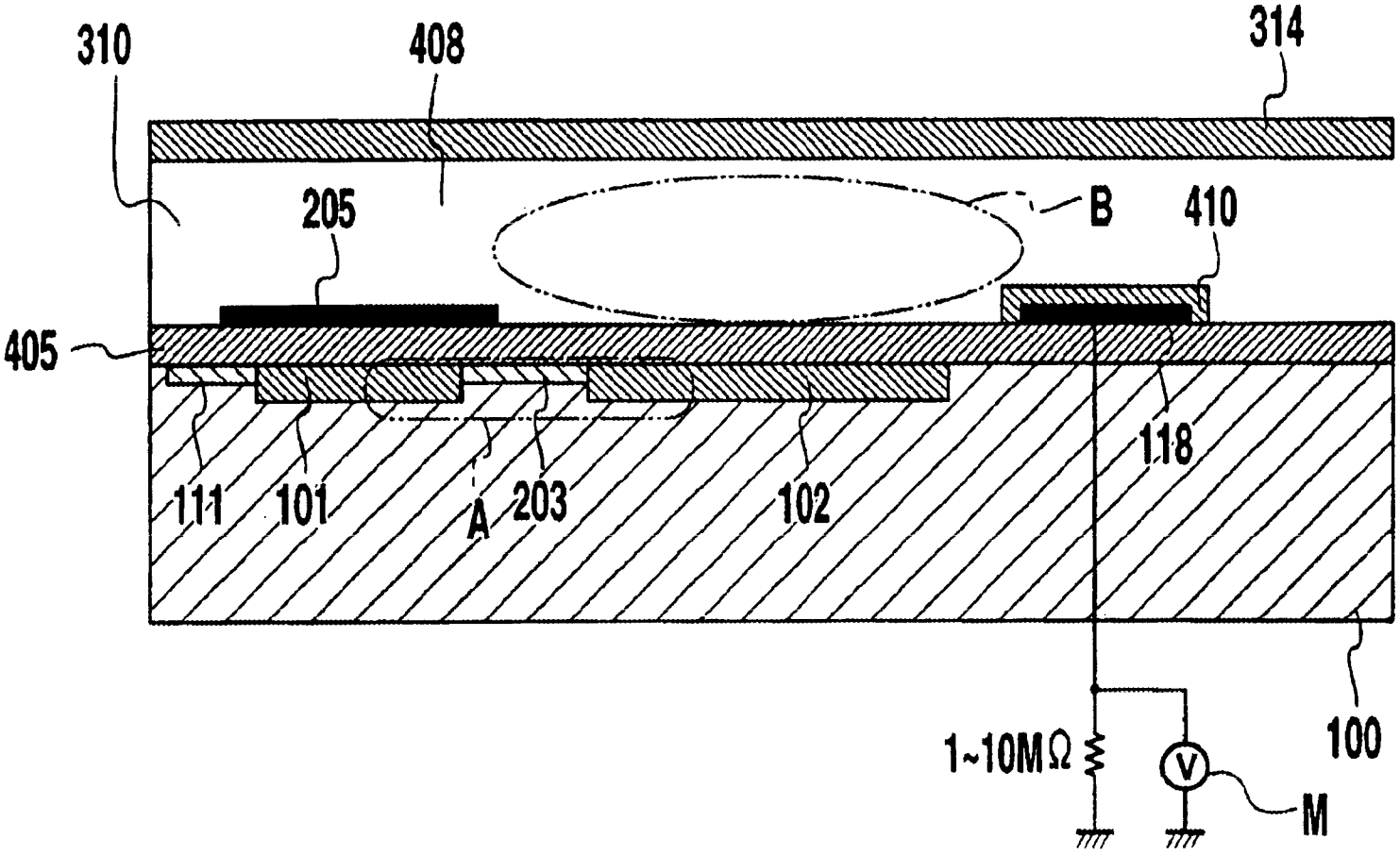
FIG. 12 is a cross-sectional diagram of the periphery of a nozzle in the ink-jet printing head in accordance with the fifth preferred embodiment of the present invention.

In FIG. 12, the present embodiment is almost the same as the above embodiments except that the detection electrode 118 is covered with an insulating film 410 provided as a protective film. The insulating film 410 prevents the detection electrode 118 from a chemical or physical change to be caused by directly immersing the detection electrode 118 in ink. Therefore, it allows the stable detection of ink for the long term. The insulating film may be formed by one of the conventional methods well known in the art, including vacuum deposition, sputtering, chemical vapor deposition (CVD), and spin coating. Also, the insulating film may be made of a SiN or SiO film.

Sixth Preferred Embodiment

In the fifth embodiment shown in FIG. 12, the insulating film 410 is provided as the protective film and layered only on the detection electrode 118. In the present invention, on the other hand, the protective film such as the insulating film 410 may be also layered on other components mounted on the substrate.

Figure 13:
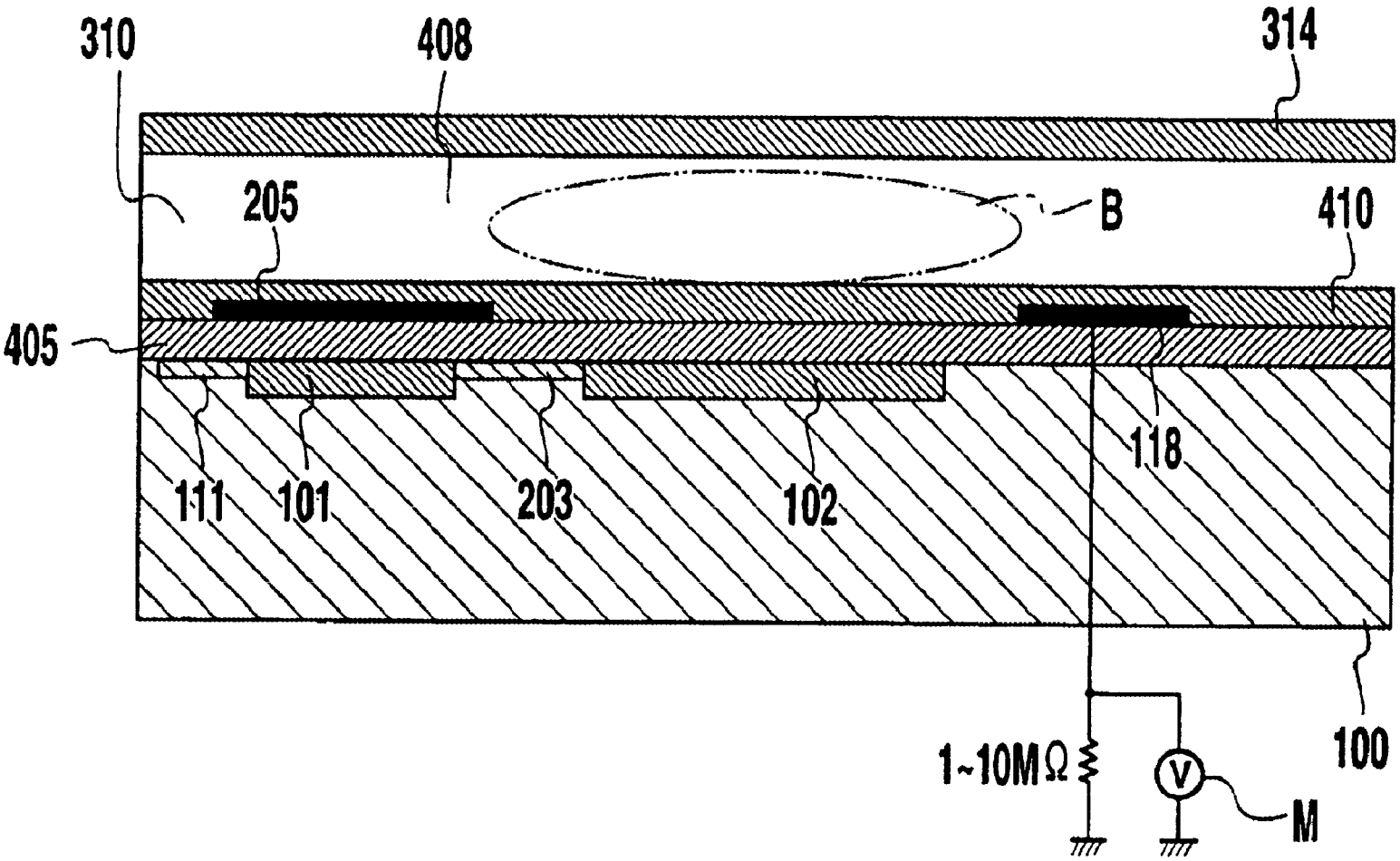
FIG. 13 is a cross-sectional diagram of the periphery of a nozzle in the ink-jet printing head in accordance with the sixth preferred embodiment of the present invention.

Referring now to FIG. 13, an ink-jet printing head of the present embodiment is constructed just as in the case of the fifth embodiment shown in FIG. 12 except as follows. In this embodiment, contrasted with the fifth embodiment, the insulating film 410 provided as the protective layer extends over the anti-cavitation film 205 so that the detection electrode 118 and the anti-cavitation film 205 can be continuously covered with the insulating film 410. Thus, the insulating film is also formed on the protective film 405 so that it is located above the electric source wiring 111, the heater 101, the wiring 203, and the driver 102 through the protective film 405. The insulating film 410 may also offer the function of the protective film 405. In this case, there is no need to provide the protective film 405, so that the insulating film 410 may be directly arranged on the electric source wiring 111, the heater 101, the wiring 203, and the driver 102.

Seventh Preferred Embodiment

Figure 14:
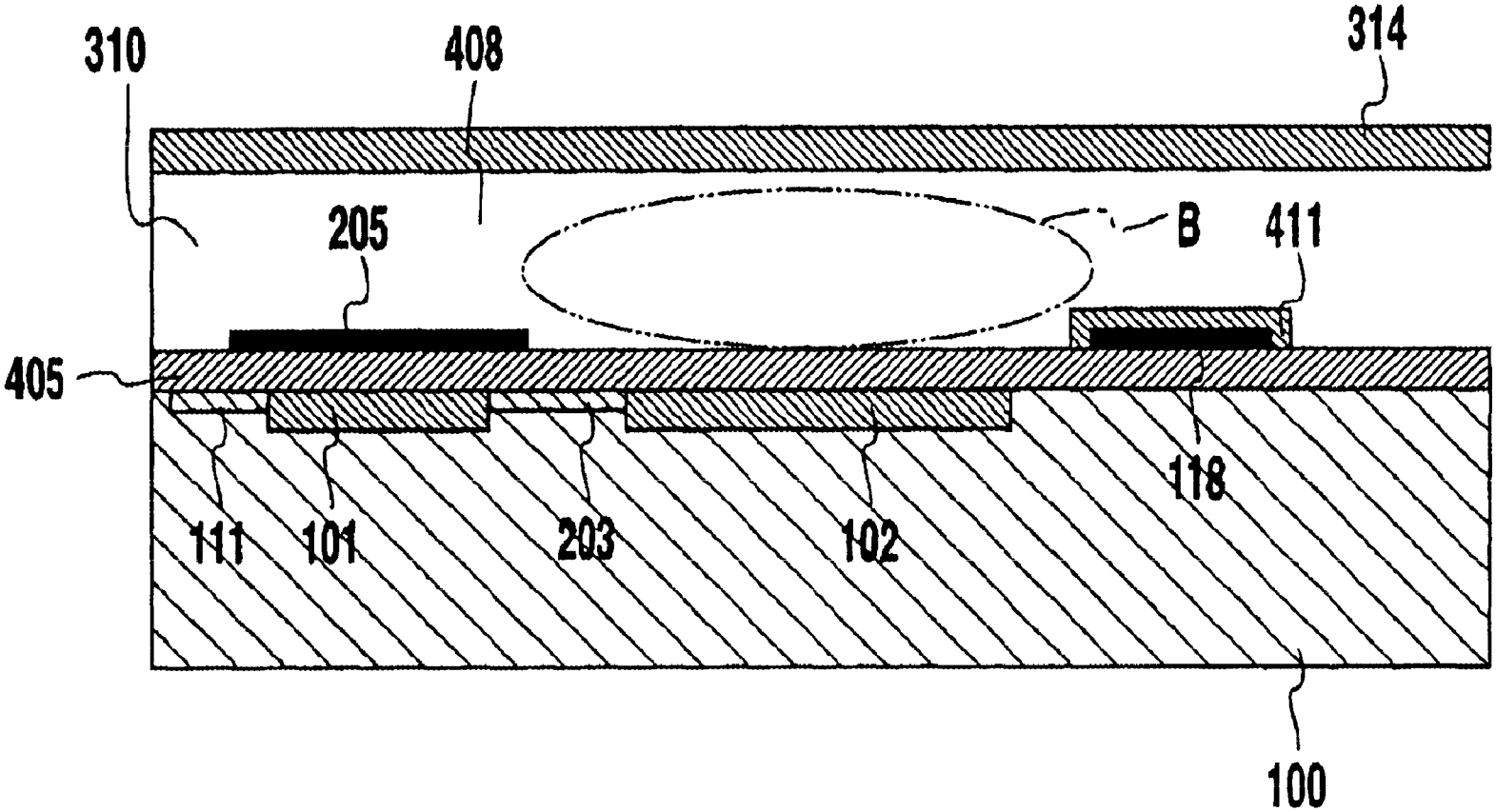
FIG. 14 is a cross-sectional diagram of the periphery of a nozzle in the ink-jet printing head in accordance with the seventh preferred embodiment of the present invention.

In the fifth embodiment shown in FIG. 12, the insulating film 410 is provided for the detection electrode 118. In this embodiment, on the other hand, an oxide film 411 is formed on the detection electrode 118 instead of the insulating film 410, as shown in FIG. 14. Therefore, the oxide film 411 can be formed without the steps of forming and patterning the insulating film on the detection electrode 118. Thus, the process of making the protective film for covering the detection electrode 118 can be simplified. Concretely, the oxide film 411 can be formed by surface treatment dipping the detection electrode 118 in anodization solution or thermal oxidation solution. Furthermore, the detection electrode 411 and the anti-cavitation film 205 may be prepared from the same material to further simplify the manufacturing process.

Eighth Preferred Embodiment

Figure 15:
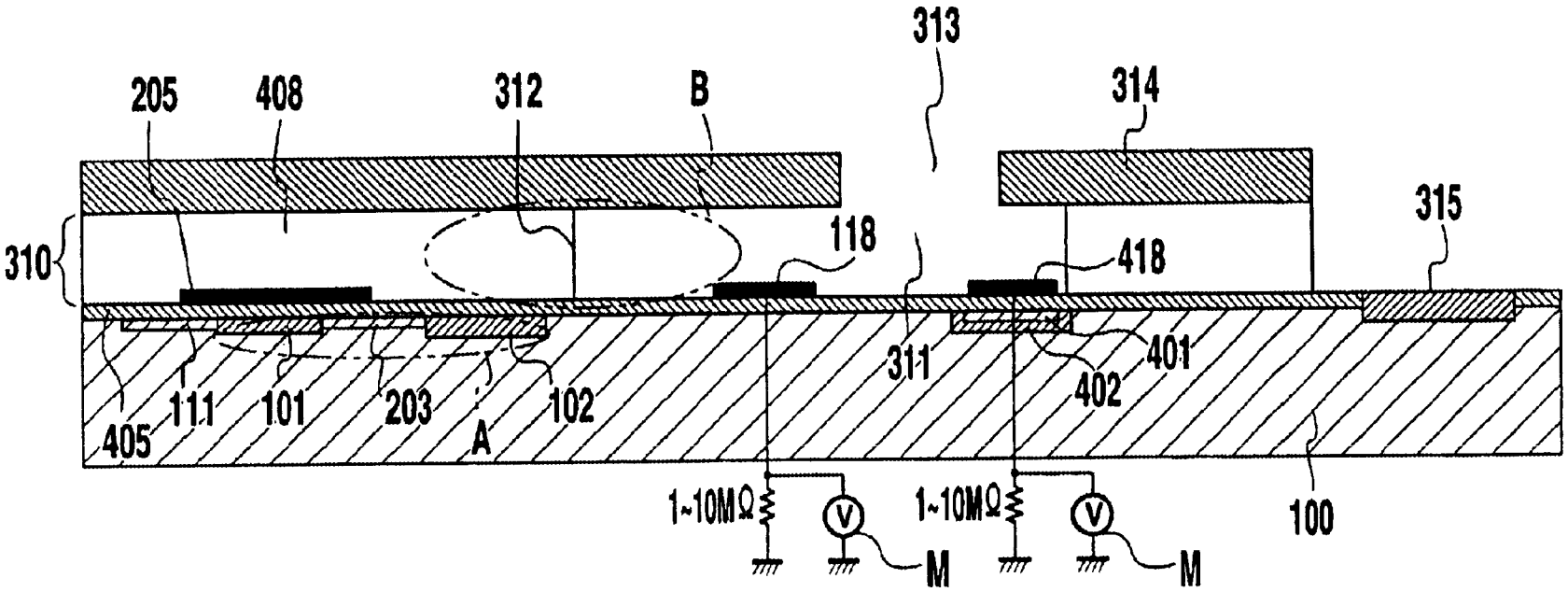
FIG. 15 is a vertical cross-sectional view of the printing head in accordance with the eighth preferred embodiment of the present invention.

In FIG. 15, the present embodiment is almost the same as the above embodiment, except for a reference unit. That is, the reference unit is provided on the substrate in addition to a detection unit. The detection unit consists of a signal-output system such as the heater 101 and the driver 102 and a signal detecting system such as the detection electrode 118. In this embodiment, therefore, the difference among detecting signals from these units is defined as a detection signal to be used. Thus, it is possible to increase the accuracy of detecting ink by removing the influence of noise at the time of ink detection.

The configuration shown in FIG. 15 and the configuration shown in FIG. 4 are different from each other with respect to the reference unit formed on the rear end of the common liquid chamber. The rear end of the common liquid chamber has a tendency to keep ink even though the nozzle becomes empty of ink by consumption of ink. In addition, there is a portion in which ink remains even though the nozzle cannot eject ink as a result of becoming empty of ink. Such a portion is located in the corner of an area near the wall of that rear end. Thus, the reference unit may be placed on that portion. In the present embodiment, the reference unit is located at a position where ink is kept as much as possible even though the nozzle is in a state that the ejecting of ink is disabled. In other words, if there is a portion where some remaining ink is expected to remain, even though the nozzle is in a state that the ejecting of ink is disabled, it is preferable that the reference unit is located at such a position. Alternatively, the shape of the inside of the common liquid chamber may be changed to form a portion where ink remains even though the nozzle is in a state that the ejecting of ink is disabled, and locate the reference unit thereon.

As shown in the FIG. 15, several components are arranged on the back side of the protective film 405 at the rear end of the common liquid chamber. These components include a reference-resistance element 401, a reference driver 402, and electrode wiring for driving the elements 401 and 402 in the same fashion as the heater 101 of the above detection unit. Furthermore, a reference detection electrode 418 is located on a portion at a predetermined distance from the top side of those components. In FIG. 15, for example, the reference resistance element 401, the reference driver 402, and the reference detection electrode 418 are arranged in the direction perpendicular to the surface of the figure, so that they are graphically expressed as if they are on the same position or plane. Furthermore, the reference resistance element 401 of the present embodiment is different from the heater which is provided for the detection of ink and also provided as the printing element. That is, the resistance element 401 has no function of generating a bubble by heating ink even though it is driven. Thus, the reference resistance element 401 may be a heater with a comparatively small area of heating body or a resistor that does not act as a heating element.

Figure 16:
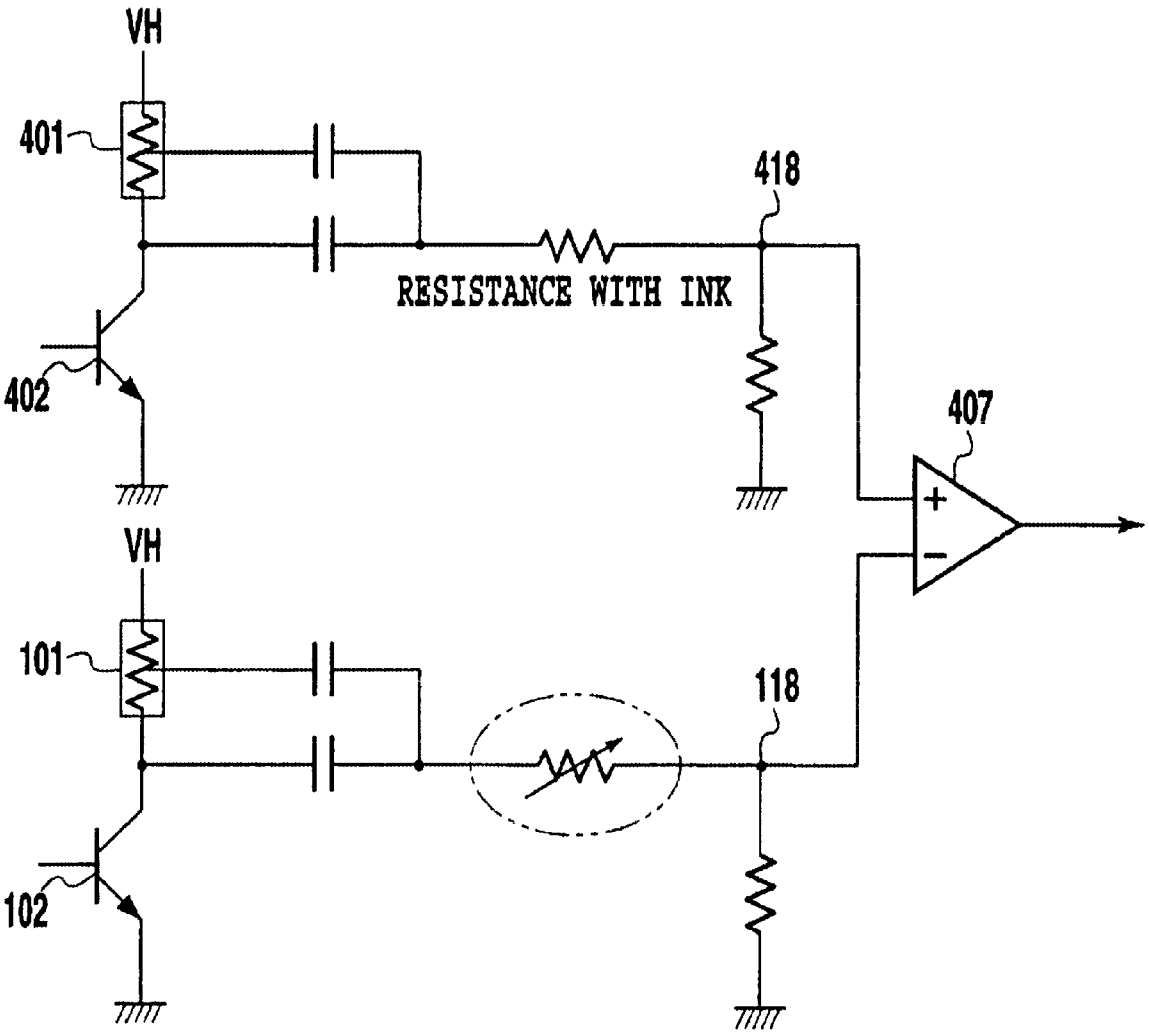
FIG. 16 is a schematic circuit diagram that partially illustrates an equivalent circuit for the ink detection in accordance with the eighth preferred embodiment of the present invention.

FIG. 16 illustrates an equivalent circuit of a portion associated with the detection of ink in the printing head of the present embodiment. A basis form shown in FIG. 16 is the same as that in FIG. 11.

The procedure of a differential detection for detecting ink in accordance with the present invention will be described below with reference FIG. 16.

First, a heater 101 of the nozzle to be subjected to the ink detection is driven to obtain a detection signal. Simultaneously, the reference resistance element 401 is driven by switching the reference driver 402 on. As a result, the actuation of the resistance element 401 leads to a potential change in ink at the rear end of the common liquid chamber by the same operating principles as those of the basic configuration described above. At this time, ink is surely present between the components such as reference resistance element 401 and the reference driver 402 and the reference detection electrode 418, so that the detection electrode 418 detects a signal similar to the detection signal 704 shown in FIG. 7. In this case, by the way, a level of the output signal may be increased in response to resistance of the resistance element 401 or the like at the time of obtaining such a detection signal. Thus, a level of the output signal from the reference unit may be adjusted, for example, by decreasing an area of the resistor (i.e., an area of the resistance element 401) as compared with the heater 101 for detecting ink, or by increasing a thickness of a portion of the protective film 405 corresponding to the resistance element 401.

The above output signals obtained from the detection unit and the reference unit are subjected to differential circuit 407 to obtain the difference between the signals. Detecting signals based on the difference may be of the following two signals, respectively.

(1-a) Potential difference based on the difference is minimally produced when ink is present in the target portion of the target nozzle for detecting the presence or absence of ink therein. That is, it can be represented by the following formula:

[detecting signal of reference unit (detecting signal+noise)]−[detecting signal of detection unit (detecting signal+noise)]=0

(2-a) A signal of the reference unit is produced as a potential difference based on the difference when ink is not present in the target portion of the target nozzle for detecting the presence or absence of ink therein. That is, it can be represented by the following formula:

[detecting signal of reference unit (detecting signal+noise)]−[detecting signal of detection unit (noise)]=detecting signal In either of these two cases (1-a) and (2-a), the influence of noise can be eliminated from the original detecting signals by obtaining their difference. As a result, adverse effects of noise on the detection signal can be avoided. For instance, the difficulties that arise when both detecting signals are only minimally distinguished from each other can be averted. The problem solved is that the difference between the voltage change with the presence of ink and the voltage change without the presence of ink decreases on account of noise in the detection signals. Consequently, an error judgment that ink is present even though no ink in fact remains can be avoided by eliminating noise interference.

It is possible to increase the sensitivity of detecting the presence or absence of ink by amplifying the obtained difference using an amplifier.

Furthermore, for example, the detection signal may be attenuated by noise on an electrically connecting portion between the substrate and the body of the printing apparatus before the detection signal reaches to the body of the printing apparatus. Also, for example, noise or induction noise may be caused by a coupling capacitance depending on the changes in voltage or current in wiring of the flexible substrate with a wiring cluster. There may be cases that the noise affects the detection signal. Furthermore, the detection signal is also influenced by another signal related to the actuation. For instance, it is conceivable that an enable signal exerts a large influence on the detection signal because an enable signal generates both voltage noise and current at the time of driving the heater when the voltage change of the driving signal is detected.

Ninth Preferred Embodiment

In this embodiment, the reference unit is provide d on a portion where ink cannot be found without exception. That is, the voltage change in the absence of ink is used as a standard detecting signal. The portion where ink cannot be found may be a joint portion (wall member) between the substrate of the ink-jet printing head and the top plate. More specifically, for example, a printing head for ejecting two or more different color inks has nozzles for different color inks being arranged on the same substrate. In this case, in general, a wall member between the different color ink nozzles is thicker than a wall member between the same color ink nozzles. Therefore, the components that make up the reference unit, such as the resistance element and the driver, and also the detection electrode may be provided on the wall member between the different color ink nozzles. In this case, furthermore, these components and the detection electrode are mounted together through the protective film or the comparable film to be provided as the insulating film. As a matter of course, therefore, the changes in voltage of them can be detected by the same principle as that of the detection unit.

Figure 17:
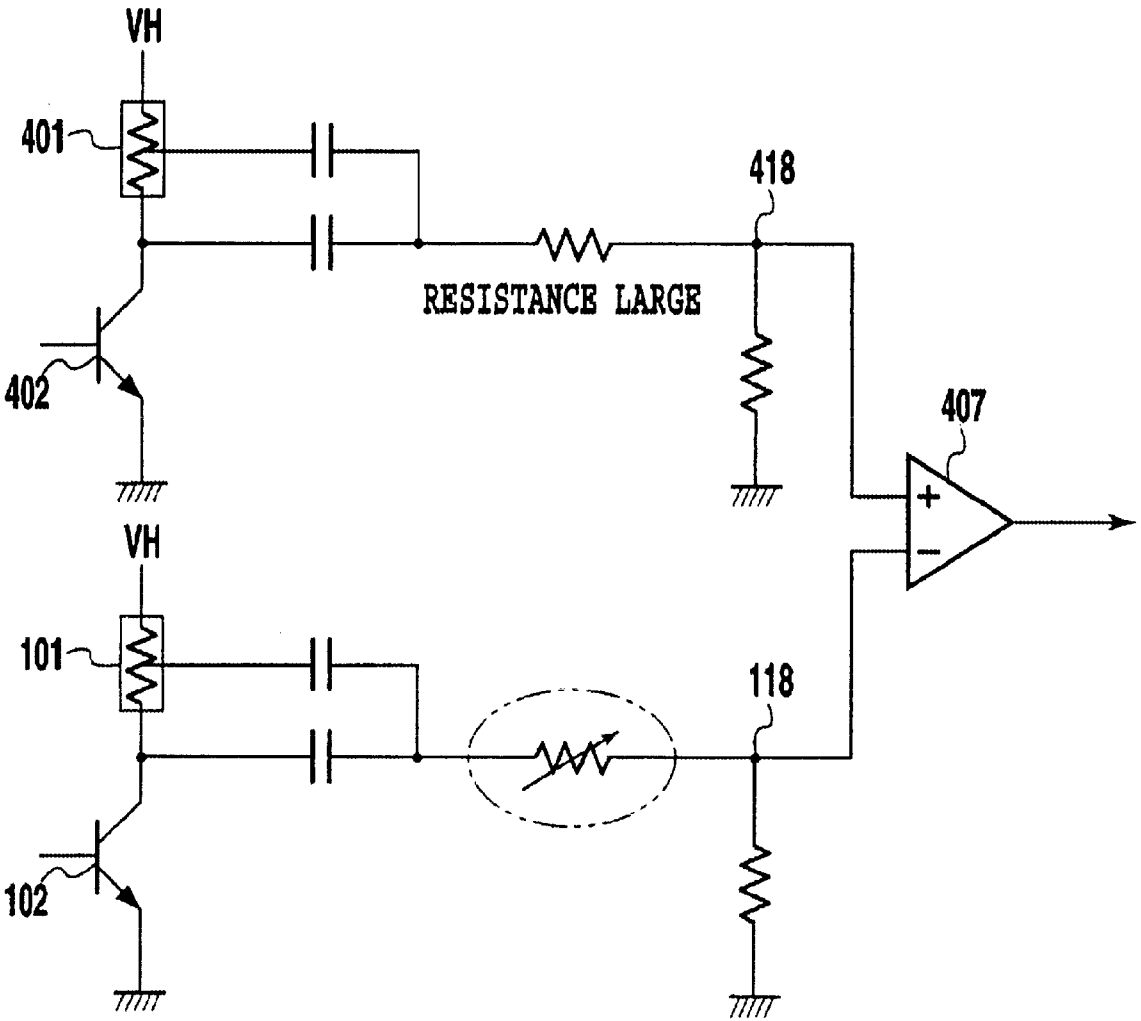
FIG. 17 is a schematic circuit diagram that partially illustrates an equivalent circuit for the ink detection in accordance with the ninth preferred embodiment of the present invention.

FIG. 17 shows an equivalent circuit of the portion responsible for the ink detection of the printing head in accordance with the present embodiment.

This circuit accurately performs the ink detection, in which a nozzle is adequately removed, by the same principle as that of the eighth embodiment. That is, a detection signal is obtained from the detection electrode 118 by driving the detecting heater 101. Simultaneously, the reference resistance element 401 is driven by switching of the reference driver 402 on. At this time, the ink detection is performed in the absence of ink in the portion where the reference unit is provided as described above, so that a signal similar to the detection signal 705 shown in FIG. 7 can be produced. Thus, the detection signals obtained from the detection unit and the reference unit are subjected to a differential circuit 407 to obtain the difference between these signals. Detecting signals based on the difference may be of the following two signals, respectively.

(1-a) If ink remains in the target nozzle, a signal from the detection unit is produced as a voltage difference based on the difference. That is, it can be represented by the following formula.

[detecting signal of reference unit (noise)]−[detecting signal of detection unit (detecting signal+noise)]=−[detecting signal of the detection unit]

(2-a) If no ink remains in the target nozzle, a voltage difference based on the difference is hardly produced. That is, it can be represented by the following formula.

[detecting signal of reference unit (noise)]−[detecting signal of detection unit (noise)]=0

As is evident from the results regarding the above difference, the detection signal provided as the difference is the one from which noise is removed just as in the case of the eighth embodiment. Therefore, the detection signal that reflects the presence or absence of ink in the nozzle can be favorably obtained.

As with the eighth embodiment, it is possible to increase the sensitivity of detecting the presence or absence of ink by amplifying the obtained difference using an amplifier.

Tenth Preferred Embodiment

Figure 18:
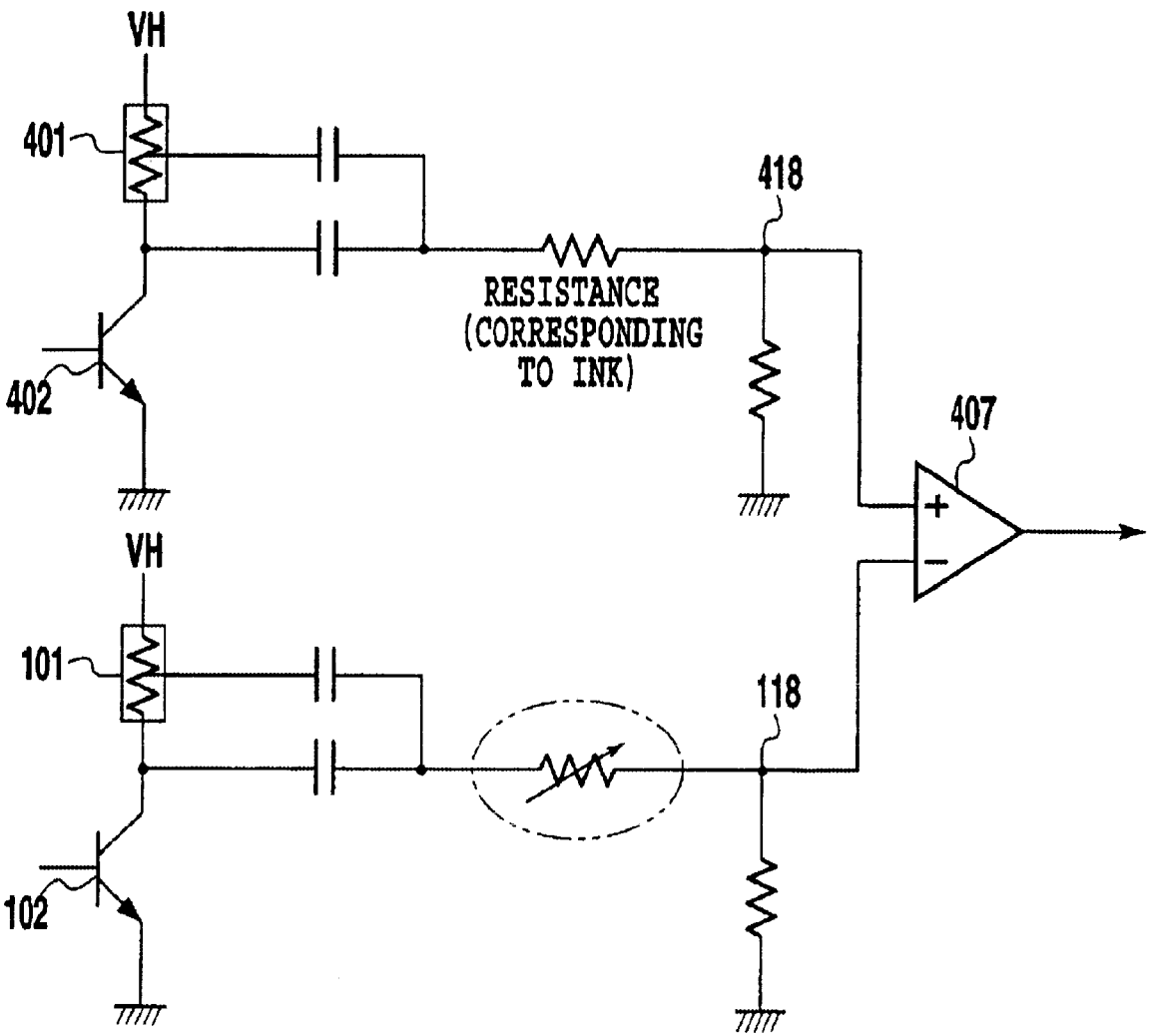
FIG. 18 is a schematic circuit diagram that partially illustrates an equivalent circuit for the ink detection in accordance with the tenth preferred embodiment of the present invention.

FIG. 18 shows an equivalent circuit of a portion involved in the detection of ink in the printing head in accordance with the present invention, In this embodiment, just as in the case of the eighth embodiment, a detection signal from the reference unit is detected in the presence of ink. In this embodiment, however, the detection unit may be placed on a portion where ink does not remain, so that the detection electrode 418 may be directly connected to an electric conductor on the protective film without the presence of ink.

In the equivalent circuit shown in FIG. 18, a detection signal similar to the detection signal 704 (see FIG. 7) can be always obtained when the reference resistance element 401 is driven. In this embodiment, by the way, it is conceivable that a detection signal from the reference unit will be larger than a detection signal from the detection unit. Thus, it is preferable to adjust the detection signals by decreasing the size of the electrodes, incorporating a resistor corresponding to the remaining amount of ink, increasing a thickness of the protective film, or the like to obtain an appropriate difference between these detection signals.

Eleventh Preferred Embodiment

Figure 19:
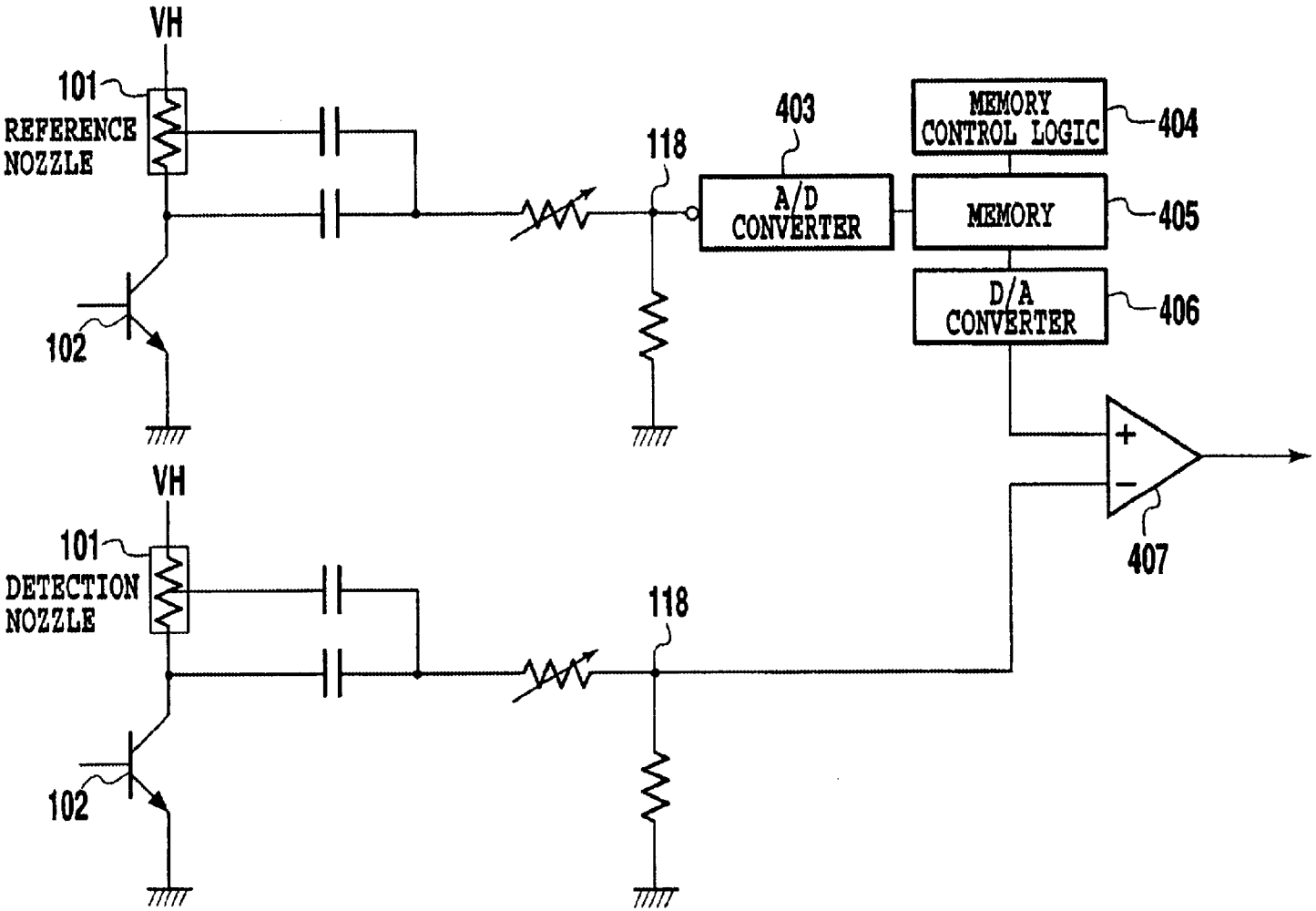
FIG. 19 is a schematic circuit diagram that partially illustrates an equivalent circuit for the ink detection in accordance with the eleventh preferred embodiment of the present invention.

In this embodiment, another detection unit for another nozzle is used as a reference unit. FIG. 19 is an equivalent circuit of a portion involved in the detection of ink in the printing head in accordance with the present embodiment.

In this embodiment, at first, one of the nozzles is selected as one to be used for reference purposes (hereinafter, referred to as a reference nozzle). Then, the detection of ink remaining in the printing head or the like is performed using the difference between the detection signals just as in the case with any embodiment described above.

The reference nozzle of the present embodiment must be the one that generates a detection signal in the presence of ink as with the eighth embodiment. Therefore, the reference nozzle must be selected from nozzles in which ink certainly remains without exception. For instance, the process of determining the reference nozzle may be performed according to the following operating principles.

The operating principles are disclosed in Japanese Patent Application Laid-open No. 8-80619 (1996). If ink remains in the nozzle, a signal level of predetermined output signal which is detected when a plurality of nozzles eject ink at the same instant becomes larger than a signal of predetermined output signal which is detected when a single nozzle ejects ink. That is, if three nozzles are selected on the precondition that ink remains in all of the nozzles, an output difference can be measured between an output signal obtained when two of three nozzles concurrently eject ink and an output signal obtained when the remainder of three nozzles ejects ink. Consequently, the presence of ink in the nozzle can be confirmed on the basis of the resulting output difference in those output signals. Such a confirmation procedure is surely different from the ink-detecting method of each embodiment of the present invention. That is, the above reference does not disclose how to detect the amount of ink remaining in each nozzle with a high precision, so that the contents of the above reference is much different from the present invention.

In this embodiment, three nozzles to be used for defining a reference nozzle are not always filled with ink. Thus, the present embodiment makes a distinction among three nozzles by designating them as nozzle A, nozzle B, and reference-possible nozzle. Combinations of two nozzles for simultaneously ejecting ink are replaced and then an output signal obtained by driving a pair of the nozzles and an output signal obtained by driving an unpaired nozzle are compared with each other. Consequently, the presence or absence of ink in the unpaired nozzle (i.e., the reference-possible nozzle) can be determined by the results of the comparison between these signals. Concretely, the comparison is made by the following procedure.

Step 1: Nozzles A and B are simultaneously driven while the remaining reference-possible nozzle is driven alone to eject ink.

Step 2: The arithmetic operation of subtraction:

[Output signal at the time of driving the reference possible nozzle]−[Output signal at the time of simultaneously driving both nozzles A+B] is performed.

Then, the results of the subtraction may be classified under the following four conditions characterized by the output patterns.

(i) If an output difference is obtained, it corresponds to a condition in which "ink remains in the reference-possible nozzle, while no ink remains in the nozzles A, B".

(ii) If there is no difference, it corresponds to a condition in which "no ink remains in all of the reference-possible nozzle and the nozzles A, B", "ink remains in the reference-possible nozzle and the nozzle A, and no ink remains in nozzle B", or "ink remains in the reference-possible nozzle and the nozzle B, and no ink remains in nozzle A".

(iii) If an output difference of reversed sign is obtained, it corresponds to a condition in which "ink remains in all of the reference-possible nozzle and the nozzles A, B", "ink remains in the nozzle A, while no ink remains in both the reference-possible nozzle and the nozzle B", or "ink remains in the nozzle B, while no ink remains in both the reference-possible nozzle and the nozzle A".

(iv) If a comparatively large output difference of reversed sign is obtained, it corresponds to a condition in which "ink remains in both the nozzles A, B, while no ink remains in the reference-possible nozzle".

In summary, the procedure progresses further to the following items with respect to the above conditions.

If it is under condition (i), the reference-possible nozzle is used as a reference nozzle.

If it is under condition (iv), the reference-possible nozzle is replaced with another one and the recovery operation is performed.

If it is under condition (ii), the decision is made by the sub-step (3-1) in Step 3 described below.

If it is under condition (iii), the decision is made by the sub-step (3-2) in Step 3.

Step 3: The nozzle A and the reference-possible nozzle are simultaneously driven while the remaining nozzle B is driven alone to eject ink. Sub-step (3-1): The arithmetic operation of subtraction:

[Output signal at the time of simultaneously driving both nozzle A and the reference-possible nozzle]–[Output signal at the time of driving the nozzles B] is performed.

Then, the results of the subtraction may be classified under the following two conditions characterized by the output patterns.

(i) If an output difference is obtained, it corresponds to a condition in which "ink remains in both the nozzle A and the reference-possible nozzle".

(ii) If there is no difference, it corresponds to a condition in which "ink remains in both the reference-possible nozzle and the nozzle B" or "no ink remains in all of the reference-possible nozzle and the nozzles A, B".

In summary, the procedure progresses further to the following items with respect to the above conditions.

If it is under condition (i), the reference-possible nozzle is used as a reference nozzle.

If it is under condition (ii), the decision is made by the sub-step (4-1) in Step 4 described below. Sub-step (3-2): The arithmetic operation of subtraction:

[Output signal at the time of simultaneously driving both nozzle A and the reference-possible nozzle]–[Output signal at the time of driving the nozzles B] is performed.

Then, the results of the subtraction maybe classified under the following two conditions characterized by the output patterns.

(i) If an output difference of reversed sign is obtained, it corresponds to a condition in which "ink remains in the nozzle B".

(ii) If an output difference is obtained, it corresponds to a condition in which "ink remains in the reference-possible nozzle" or "ink remains in nozzle A".

In summary, the procedure progresses further to the following items with respect to the above conditions.

If it is under condition (i), the reference-possible nozzle is replaced with another one and the recovery operation is performed.

If it is under condition (ii), the decision is made by the sub-step (4-2) in Step 4 described below.

Step 4: The nozzle B and the reference-possible nozzle are simultaneously driven while the remaining nozzle A is driven alone to eject ink. Sub-step (4-1): The arithmetic operation of subtraction:

[Output signal at the time of simultaneously driving both nozzle B and the reference-possible nozzle]–[Output signal at the time of driving the nozzle A] is performed.

Then, the results of the subtraction may be classified under the following two conditions characterized by the output patterns.

(i) If an output difference is obtained, it corresponds to a condition in which "ink remains in both the nozzle B and the reference-possible nozzle".

(ii) If there is no difference, it corresponds to a condition in which "no ink remains in all of the reference-possible nozzle and the nozzles A, B".

In summary, the procedure progresses further to the following items with respect to the above conditions.

If it is under condition (i), the reference-possible nozzle is used as a reference nozzle.

If it is under condition (ii), the reference-possible nozzle is replaced with another one and the recovery operation is performed. Sub-step (4-2): The arithmetic operation of subtraction:

[Output signal at the time of simultaneously driving both nozzle B and the reference-possible nozzle]–[Output signal at the time of driving the nozzle A] is performed.

Then, the results of the subtraction may be classified under the following two conditions characterized by the output patterns.

(i) If an output difference is obtained, it corresponds to a condition in which "ink remains in all of the reference-possible nozzle, the nozzle A and the nozzle B".

(ii) If an output difference of reversed sign is obtained, it corresponds to a condition in which "no ink remains in both the nozzle B and the reference-possible nozzle".

In summary, the procedure progresses further to the following items with respect to the above conditions.

If it is under condition (i), the reference-possible nozzle is used as the reference nozzle.

If it is under condition (ii), the reference-possible nozzle is replaced with another one and the recovery operation is performed.

Step 5: If the reference-possible nozzle is replaced with another one, the new nozzle is used as a reference-possible nozzle and then the above steps 1 to 4 are repeated.

Consequently, the above steps make it possible to define a reference nozzle. If a heater 101 of the reference nozzle is driven, as described above, a detection signal similar to that of the detection signal 704 shown in FIG. 7 can be obtained. The obtained signal is used as a reference detection signal. Then, the difference between the reference detection signal and a detection signal obtained at the time of driving a heater of the detection nozzle is used to obtain a final detection signal without a noise component.

As shown in FIG. 11, more concretely, a heater 101 of the reference nozzle is driven and a potential variation of detection signal is subjected to analog-digital (A/D) conversion at an A/D converter 403, followed by being stored in a memory 405. The memory 405 is controlled so that another data is not stored until the previous stored data is pulled out of the memory 405 under the control of memory-control logic 404.

Subsequently, an output signal is obtained by driving the heater 101 of the detection nozzle. If the output signal (detection signal) from the nozzle is transmitted to a differential circuit, in synchronization with the transmission of such a signal, the detection signal of the reference nozzle stored in the memory 405 is subjected to analog-digital (A/D) conversion at an A/D converter 406, followed by passing the signal to the differential circuit 407.

Consequently, the difference between a detection signal from the reference nozzle and a detection signal from the detection nozzle can be obtained. After the step of obtaining the difference between these signals, the same procedure as that of the eighth embodiment or the like may be performed, so that the details will be omitted from the following discussion.

In FIG. 11 that illustrates the present embodiment, only the reference unit is connected to any component downstream from the A/D converter. In this configuration, however, any nozzle can be connected, for example it can be attained by switching one nozzle to another by a switching design (not shown). Consequently, as described above, appropriate response to the replacement of a reference-possible nozzle will be possible.

Twelfth Preferred Embodiment

Figure 20:
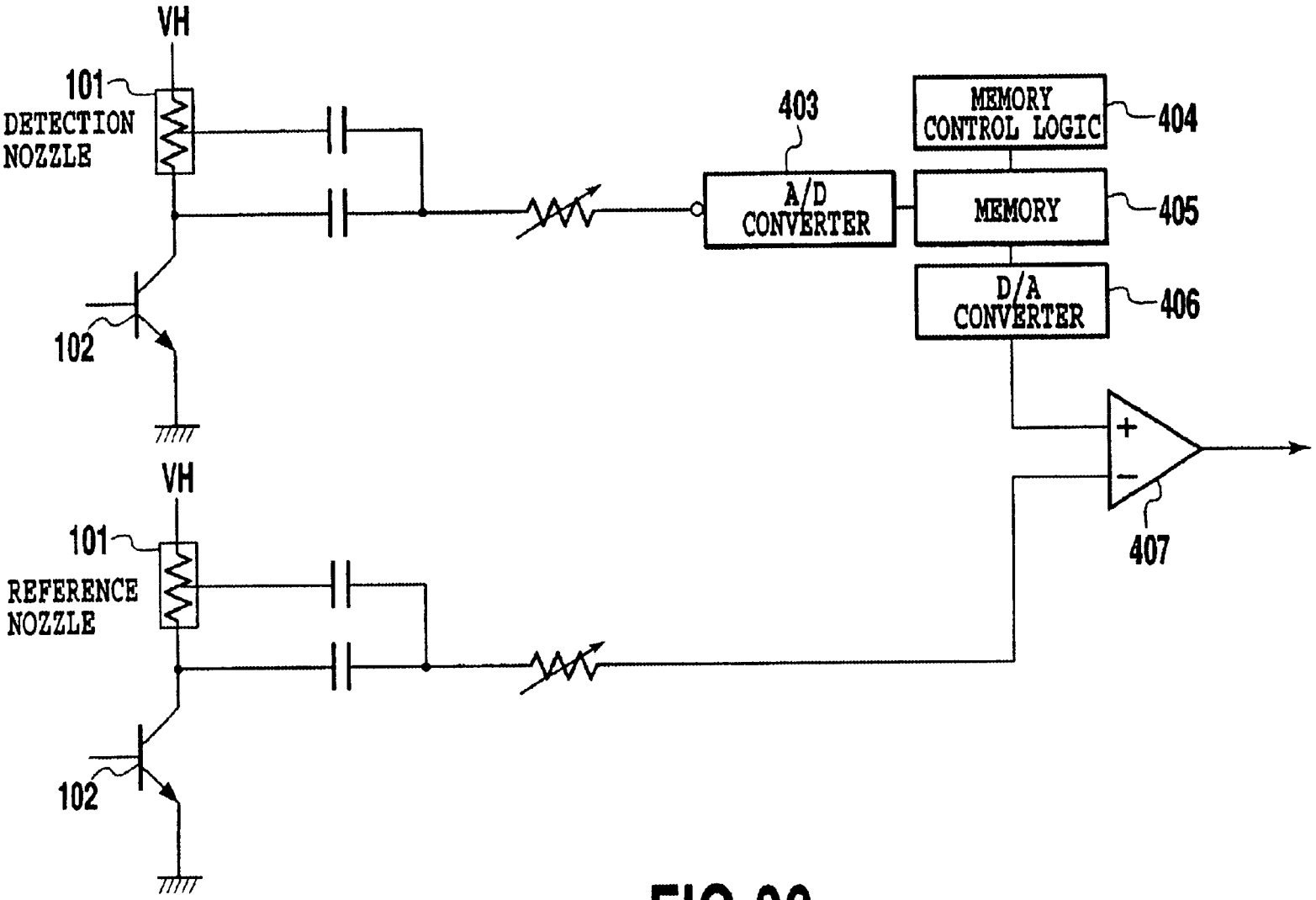
FIG. 20 is a schematic circuit diagram that partially illustrates an equivalent circuit for the ink detection in accordance with the twelfth preferred embodiment of the present invention.

In the eleventh embodiment, but not limited thereto, the heater 101 of the reference nozzle is driven at first. In the present embodiment shown in FIG. 20, on the other hand, a heater 101 of the detection nozzle is driven at first and then the obtained detection signal is stored in the memory 405.

Thirteenth Preferred Embodiment

As another configuration of the eleventh and twelfth embodiments, the same nozzle is used as both the detection nozzle and the reference nozzle. An equivalent circuit of the present embodiment is briefly illustrated in FIG. 21.

Fourteenth Preferred Embodiment

In the above embodiments, the differential detection is performed by obtaining the difference (or its amplified form) between a detection signal of the detection unit and a detection signal from the reference unit. If the amplitude of these signals is insufficient, an output-level correction circuit or the like may be incorporated prior to obtain the difference.

Fifteenth Preferred Embodiment

Figure 22:
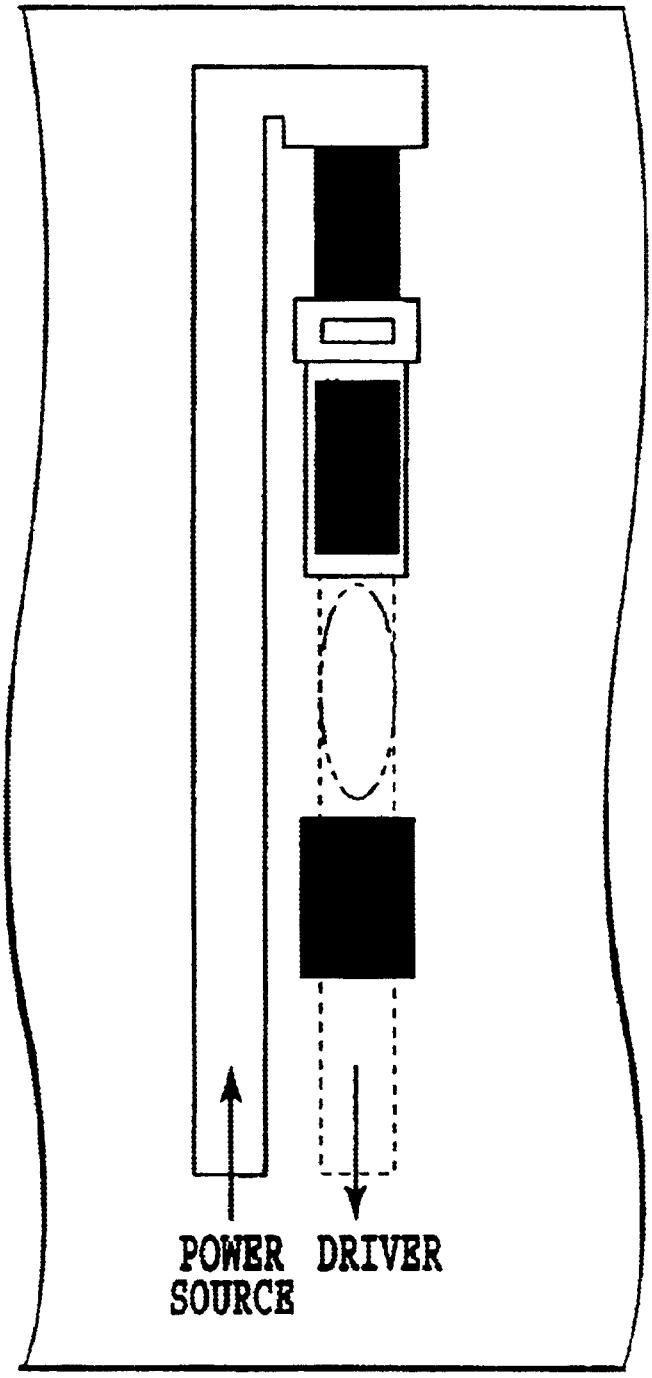
FIG. 22 is a plane diagram of the substrate for the printing head in accordance with the fifteenth preferred embodiment of the present invention.
Figure 23:
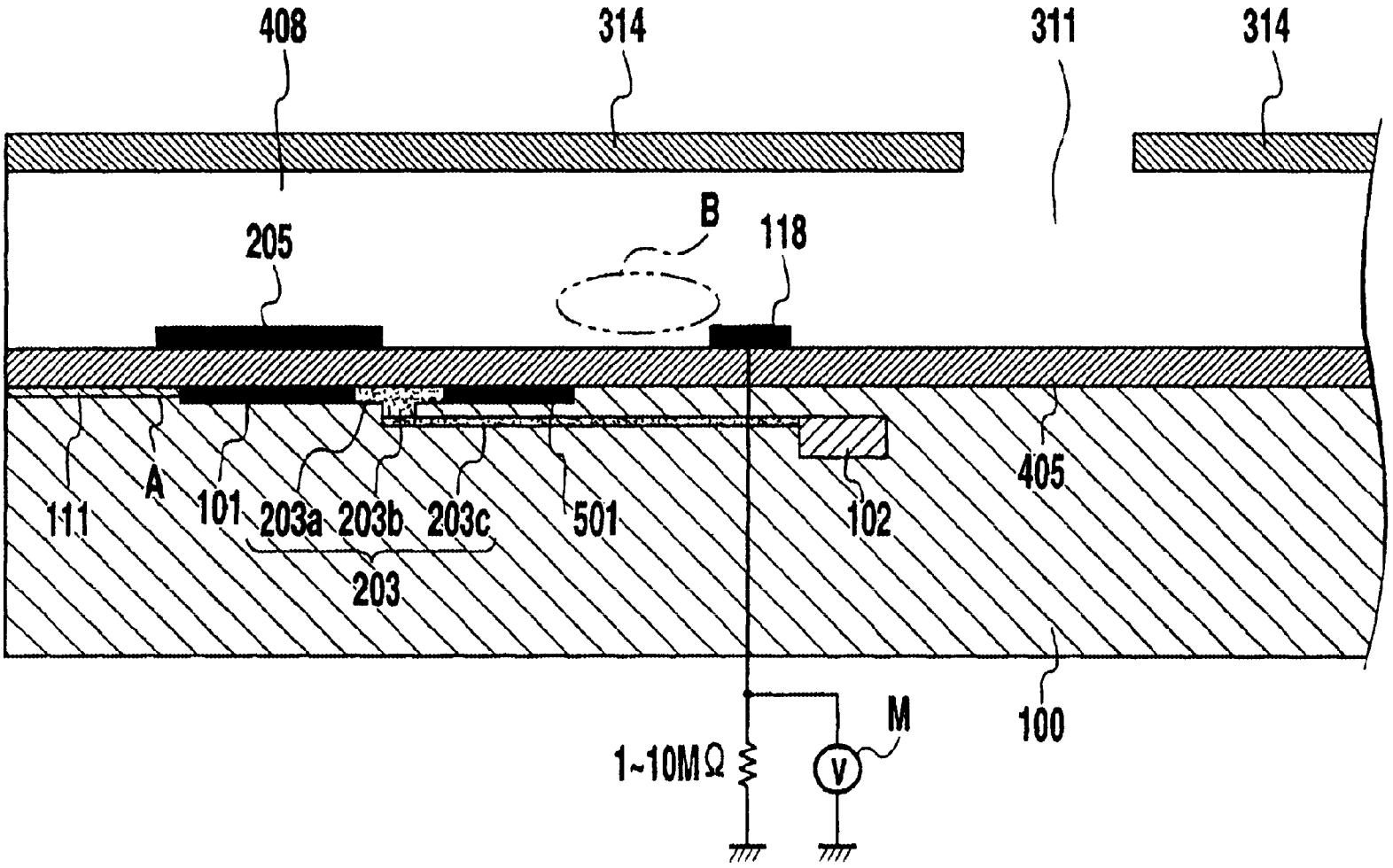
FIG. 23 is a cross-sectional side view of the substrate for the printing head shown in FIG. 22.

Referring now to FIG. 22 and FIG. 23, the fifteenth preferred embodiment of the present invention is described. FIG. 22 is a plane view of a substrate for an ink-jet printing head of the present invention, and FIG. 23 is a vertical cross-sectional view of the substrate shown in FIG. 22.

In each of the embodiments described above, the heater 101 has the function of a signal-supplying source for detecting the presence or absence of ink. In this embodiment, on the other hand, the ink-jet printing head comprises a signal-supplying source for the detection of ink, which is provided in addition to the heater 101. In this embodiment, furthermore, the same reference numerals denote the same or almost the same components just as in the case with the other embodiments. Thus, repeated explanation of each component will be omitted from the following description.

In the fifth embodiment shown in FIG. 22 and FIG. 23, the basic configuration of the present embodiment is the same as that of each embodiment described above. That is, the heater 101 formed on the substrate 100 is connected to the power source wiring 111 and also connected to the driver through the heater-driver wiring 203. In this embodiment, however, an additional signal source (made of an electrical conductor) 501 different from the heater 101 is connected to the heater-driver wiring 203. Furthermore, the heater-driver wiring 203 and the driver 102 are arranged on a layer below the additional signal source 501. Accordingly, the configuration of the present embodiment differs considerably from those of the embodiments described above.

In this embodiment, furthermore, the heater-driver wiring 203 comprises an upper-side connecting portion to be connected to the heater 101 and the individual signal source 501, a protrusion that extends downwardly from a center of the upper-side connecting portion, and a lower-side connecting portion extending from the protrusion parallel to the insulating film. The lower-side connecting portion is opposite to the individual signal source 501 with a predetermined space.

Furthermore, the individual signal source 501 is opposite to an area of the top of the insulating protective film 405. In this case, the area is located between the anti-cavitation film 205 and the detection electrode 118 and extends along the side of the heater-driver wiring 203 (in a longitudinal direction of the heater 101).

In the fifteenth embodiment, as described above, the heater 101, the driver 102, the detection electrode 118, and so on are equivalently represented in a circuit as shown in FIG. 11 just as in the case with each of the embodiments described above if they are in a state of electrically connecting to each other. In this embodiment, however, the individual signal source 501 is additionally provided in addition to the heater 101. Thus, the present embodiment allows a comparatively large capacitance of the capacitor in the circuit shown in FIG. 11, compared with each of the above embodiments in which the heater 101 is only used as a signal source of detecting that ink is not ejected. Therefore, a detection signal detectable from the detection electrode 118 can be adjusted to a large level at the time of driving the heater 101, so that the detection of ink is performed with a precision higher than that of the others.

In the fifteenth embodiment, furthermore, the individual signal source 501 is connected to a portion that becomes the same potential as that of the upper-connecting portion 203*a* of the heater-driver wiring 203 connected to the end terminal of the heater 101. At that portion, a voltage drop occurs only at the heater 101 because there is no flow of the drive current (strictly speaking, this voltage drop is brought about by the line resistance of each wiring, but not to the extent of that generated by the heater 101). Therefore, the voltage to be applied on the signal source can be maintained, so that sufficiently large ink-detecting signal can be obtained.

According to the fifteenth embodiment, furthermore, the heater-driver wiring 203 is located on a layer below the heater 101, so that an influence of noise from the heater 101 and the heater-driver wiring 203 can be reduced. According to the present embodiment, a larger detection signal can be obtained and in addition an influence of noise can be reduced. Consequently, an appropriate S/N with respect to the ink-detection signal can be obtained.

Sixteenth Preferred Embodiment

Figure 24:
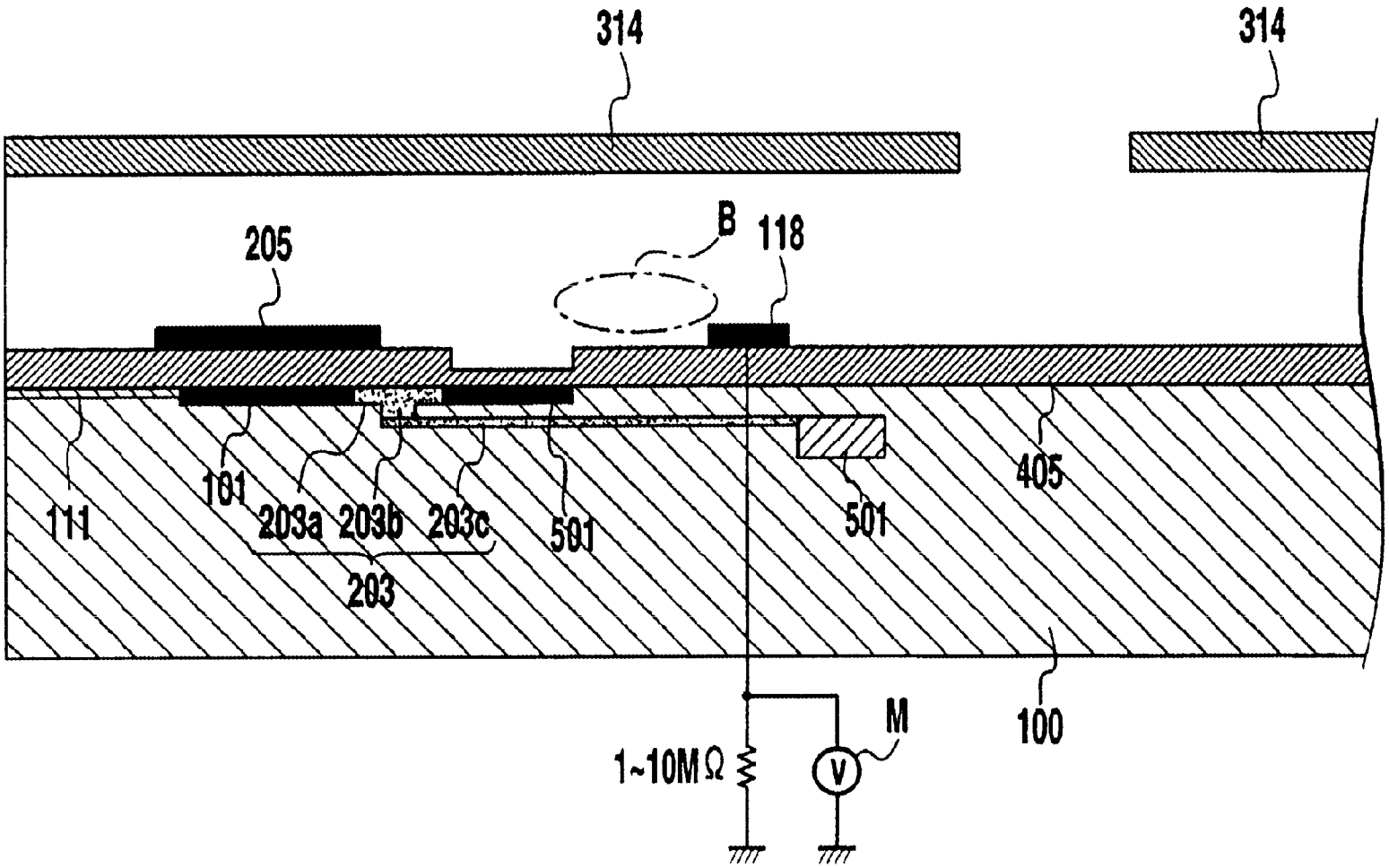
FIG. 24 is a vertical cross-sectional side view of the substrate for the printing head in accordance with the sixteenth preferred embodiment of the present invention.

FIG. 24 illustrates the configuration of the sixteenth preferred embodiment of the present invention. In this embodiment, a thickness of a portion of the insulating protective film 405 in the fifteenth embodiment, facing to the individual signal source 501, is less than a thickness of other portions thereof. Consequently, the distance between the two electrodes of the capacitance in the circuit shown in FIG. 11 can be decreased, resulting in an increase in capacitance. According to the present embodiment, therefore, a larger level of ink-detection signal can be obtained and a signal-to-noise (S/N) ratio can be further increased.

In the sixteenth embodiment, the individual signal source 501 is constructed by the same process and materials as those of constructing the heater 101. An aluminum film used in the heater driver wiring 203 is not used because a thickness of the protective film on the individual signal source is hardly reduced as the growth of hillock or the like is facilitated. In this embodiment, as described above, the individual signal source is constructed by the same material as that of the heater 101. Thus, thickness of the protective film can be reduced, so that an appropriate construction for the signal source becomes available.

Seventeenth Preferred Embodiment

Figure 25:
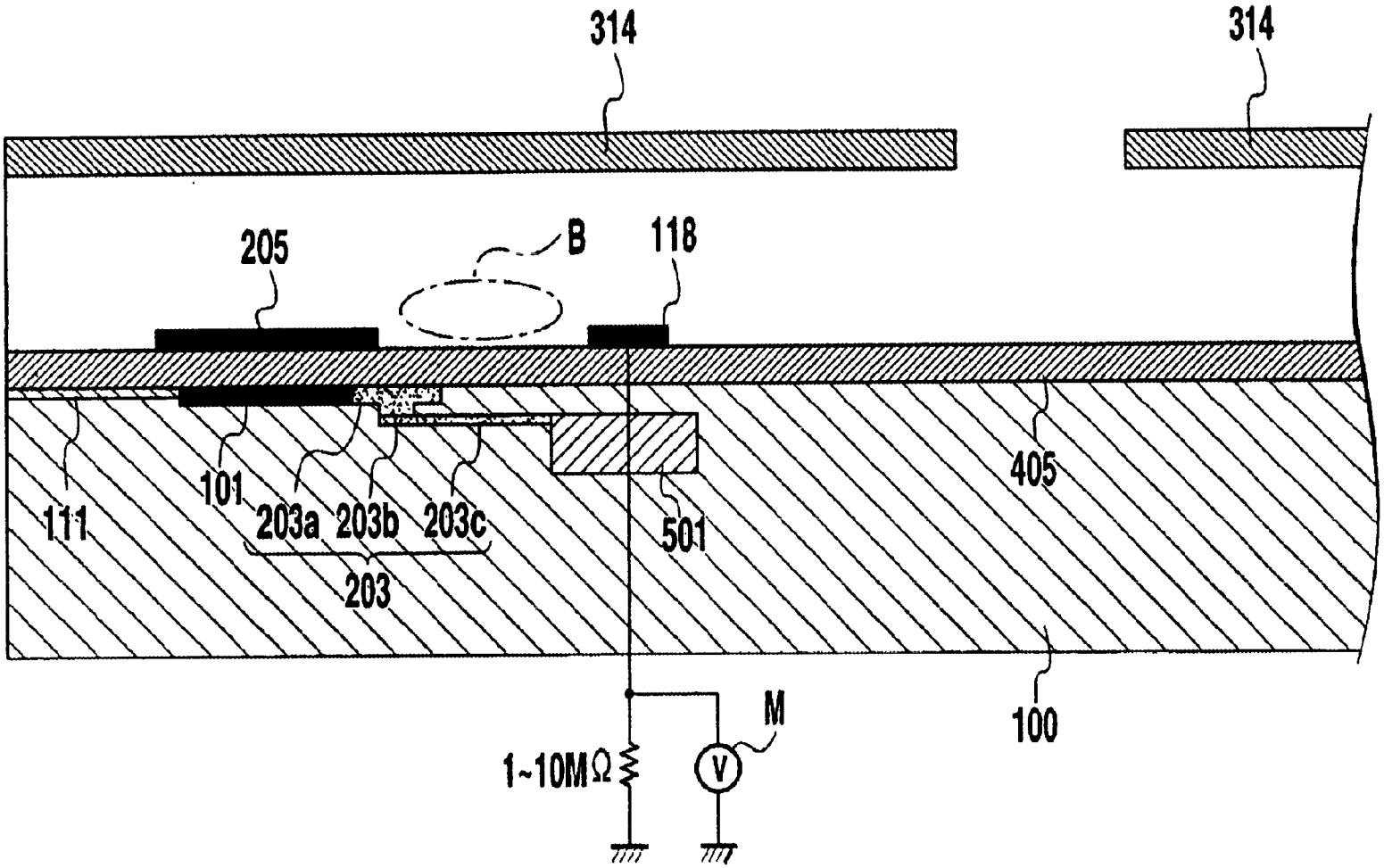
FIG. 25 is a cross-sectional diagram of the substrate for the printing head in accordance with the seventeenth preferred embodiment of the present invention.

In the fifteenth and sixteenth embodiments, the heater-driver wiring 203 is arranged on an underlayer. This kind of configuration is not limited to the individual signal source but also applied to, for example, the first and second embodiments. As shown in the present embodiment shown in FIG. 25, the heater-driver wiring 203 may be arranged on an underlayer beneath the heater 101. In this case, the heater, having the function of a signal source of detecting ink, reduces the influence of noise generated from the driver wiring, resulting in the improvement of the S/N ratio of the ink-detection signal.

Eighteenth Preferred Embodiment

Figure 26:
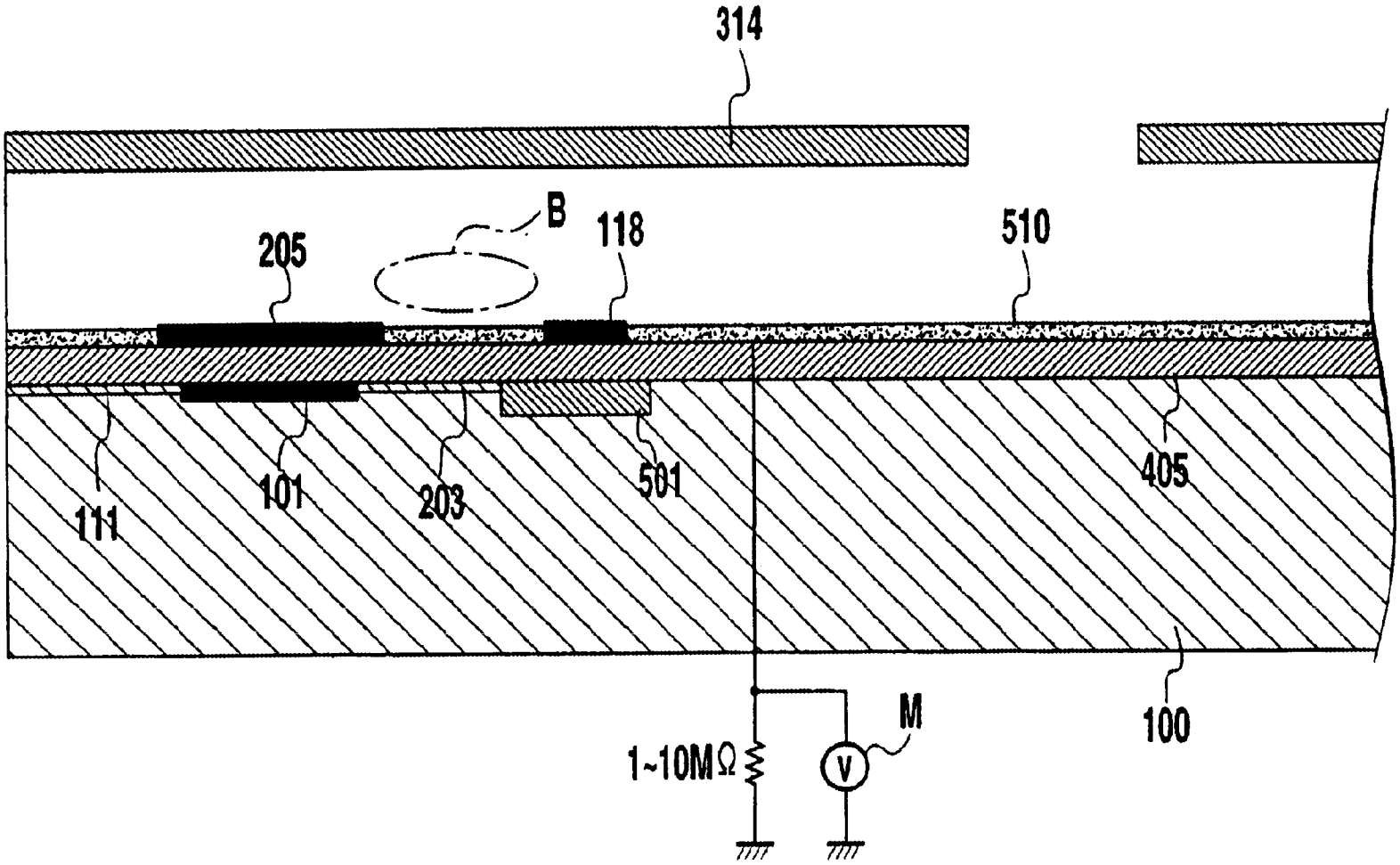
FIG. 26 is a cross-sectional diagram of the substrate for the printing head in accordance with the eighteenth preferred embodiment of the present invention.

FIG. 26 illustrates an eighteenth preferred embodiment of the present invention. In this embodiment, an organic film 510 is formed on the insulating protective film 405 except for areas thereof where output portions such as the anti-cavitation film 205 and the detection electrode 118 are mounted. The organic film 510 has a small dielectric constant, so that it reduces an input of noise signals from components other than the driver or the like, such as the logic circuit and wiring. The organic film 510 may be selected from various kinds of photosensitive resins such as polyimide resin and epoxy resin, acrylate resin, polyetheramide resin, and so on, and coated on the substrate 100 through the protective film 405. In FIG. 26, but not limited thereto, the organic film 510 is adapted to the printing head design of the first embodiment. Likewise, the organic film 510 may be also adapted to any embodiment of the present invention, resulting in similar effects that are intended.

Nineteenth Preferred Embodiment

FIGS. 27 to 30 show the configuration of an ink-jet printing head that allows the detection of ink in nozzles concurrently with a printing movement that ejects ink from the nozzles. In these figures, the illustrations are based on the configuration of the printing head disclosed in the first embodiment of the present invention.

FIG. 27 illustrates an input signal (SA) to the heater 101. In this case, the input signal (SA) is a drive signal to be applied on the heater 101 for ejecting ink from the nozzle. In the figure, the input signal (SA) is impressed at "t0", with an applied voltage of "V0" and a duration (i.e., pulse width) of "Pw". FIG. 28 illustrates the changes in size of a bubble formed in ink on the heater 101. The formation of a bubble begins at the time "Td" after a very short lapse of time from the initiation time "t0". Then, a foaming energy is generated as the bubble is grown, and subsequently ink is ejected from the nozzle by such an energy.

FIGS. 29A to 29C illustrate the process of forming a bubble on the heater 101 in the nozzle for facilitating the understanding of the formation of a bubble with a lapse of time. FIG. 29A illustrates the growing bubble "Z" on the heater 101 at the initiation time "Td". FIG. 29B illustrates the enlarged bubble "Z" at the time "TA" which is almost at midpoint of the duration. FIG. 29C illustrates the shrunk bubble "Z" at the termination time "TB". FIG. 30 illustrates the changes in potential of the detection electrode 118. The potential variation becomes a detection signal "SB" for detecting the presence or absence of ink in the nozzle as described above. The detection signal "SB" varies before and after the initiation time "Td" of the foaming. That is, the behavior of the detection signal "SB" during the time period of "t<Td" and the behavior thereof during the time period of "t>Td" are different from each other because of the following reasons. That is, it is considered that the formation of the bubble on the heater 101 leads to changes in the conditions of contacting ink in the nozzle with the anti-cavitation film 205 on the heater 101. After the initiation time "Td", the contact area between the anti-cavitation film 205 and the ink becomes small as the bubble grows. Thus, the detection signal "SB" is close to GND potential. Following that period of time, the bubble extends over the anti-cavitation film 205, so that the detection signal "SB" becomes to equal to GND potential.

In this embodiment, changes in output waveform of the detection signal "SB" with the growth of a bubble may lead to a decrease in the accuracy of ink detection when ink in the nozzle is detected in response to the detection signal "SB". Especially the foaming phenomenon, including the time period from the time "t0" at which the input signal "SA" is impressed, to the time "Td" at which the formation of a bubble is initiated, the size of the bubble may be influenced by the environmental conditions, the operating conditions, variations in resistance of the heater 101, the types of ink, and other factors. However, these factors are unpredictable in advance, so that it is difficult to adjust them appropriately. Consequently, variations in output waveform of the detection signal "SB" may lead to a decrease in the accuracy of ink detection. For improving the accuracy of ink detection, it is preferable to stabilize the output waveform of the detection signal "SB".

Twentieth Preferred Embodiment

The illustrations in FIGS. 31 to 34 are based on the configuration of the ink-jet printing head in accordance with the first preferred embodiment of the present invention, except that it differs in that the detection of ink in the nozzle is carried out without ejecting ink from the nozzle.

FIG. 31 illustrates an input signal (SA) to the heater 101. In this case, the input signal (SA) applied to on the heater 101 is insufficient to eject ink from the nozzle. In the figure, the input signal (SA) is impressed at "t0", with an applied voltage of "V0" and a duration (i.e., pulse width) of "Pw"". In this embodiment, the duration "Pw"" is shorter than the duration "Pw" shown in FIG. 27. FIG. 32 represents the results of observing the bubble in ink on the heater 101 when the input signal "SA" is impressed. In this embodiment, however, the duration "Pw"" of applying the input signal "SA" on the heater 101 is comparatively short, so that a bubble is not generated. As a natural consequence, FIGS. 33A, 33B and 33C do not represent any bubble at the observation times that correspond to those of "Td", "TA", and "TB" in FIGS. 29A to 29C. Thus, the ink cannot be ejected from the nozzle. FIG. 34 illustrates the changes in potential of the detection electrode 118, which become the detection signal "SB" for detecting ink in the nozzle as described above. In this embodiment, a bubble is not formed on the heater 101, so that the detection signal "SB" is kept stable as shown in FIG. 34. Therefore, the detection signal "SB" is prevented from assuming undesired waveform of the sort shown in FIG. 30. Consequently, the present embodiment makes possible a stable waveform of the detection signal "SB", so that the accuracy of ink detection can be increased.

For detecting ink in the nozzle, the time period of applying the input signal "SA" insufficient to eject ink is set to the detection-operation period which is different from the printing-operation period for ejecting ink. In addition, if the ink ejecting is performed by a drive system called a "double-pulse drive system," ink can be detected during the printing movement. In the double-pulse drive system, a pre-pulse is applied on the heater to previously heat the heater 101 for the purpose of stabilizing the ejecting of ink, where the pre-pulse is insufficient to initiate the ejecting of ink. Following the pre-pulse, a main-pulse is applied to the heater 101, which is an input pulse that initiates the ejecting of ink. Therefore, ink can be detected with a precision never before possible by using the above pre-pulse as the above input signal "SA" in FIG. 35 even though the pre-pulse is not involved in the ink ejecting and is only responsible for preliminary heating.

Twenty-first Preferred Embodiment

FIGS. 35 to 39 illustrate a twenty-first preferred embodiment of the present invention.

FIG. 35 illustrates input signals "P1", "P2", and "P3" incident to the heater 101. In this embodiment, the input signal "P1" is a drive signal to be applied to the heater 101 to eject ink from the nozzle (hereinafter, referred to as "ink-ejecting pulse"). The input pulse "P2" is a signal for correcting the ink detection signal, which is applied to the heater after the input signal "P1" (hereinafter, referred to as "correction pulse"). The input pulse "P3" is a signal for detecting ink, which is applied on the heater 101 after the input pulse "P2" (hereinafter, referred to as "ink-detection pulse"). Each of the pulses "P1", "P2", and "P3" is of a constant voltage of "V0". In addition, the input signal (SA) is impressed at "t0". A duration (i.e., pulse width) of the input signal "P1" is "Pw". The pulse width "Pw" is larger than a pulse width "Pth" which is required for initiating the ejecting of ink (Pw≧Pth), so that the input signal "P1" is applied to the heater 101 to eject ink from the nozzle. The correction pulse "P2" is applied to the heater 101 at the time "t2" after passing the predetermined time period "Tr" from the time of terminating the application of the ink-ejecting pulse "P1". The interval between the pulses (pulse interval) "Pr" is shorter than the pulse width "Pth" required to eject ink. Also, the ink-detection pulse "P3" is applied to the heater 11 after a lapse of sufficient time (several hundred microseconds to several seconds) from the end of the bubble formation initiated by the application of the ink-ejecting pulse "P1". The application time (pulse interval) "Pi" !is smaller than the pulse width "Pth" required for the ink ejecting. In this embodiment, the pulse widths "Pr" and "Pi" are equal to each other, and the relationship among the pulse widths "Pr", "Pi", and "Pth" is as follows.

$$Pr=Pi\leqq Pth$$

FIG. 36 illustrates the changes in size of a bubble formed in ink on the heater 101 when the input signal "SA" has applied. A bubble formation begins at the foaming-initiation time "Td" after a lapse of a short interval of time from the time "to" at which the ink-ejecting pulse "P1" is impressed. Ink can be ejected from the nozzle by a foaming energy of the bubble. The pulses "P2", "P3" to be applied after the pulse "P1" do not effect on the foaming phenomenon. FIGS. 37A to 37C illustrate the process of forming a bubble on the heater 101 in the nozzle for facilitating the understanding of the formation of the bubble with a lapse of time. FIG. 37A illustrates the growing bubble "Z" on the heater 101 at the initiation time "Td". FIG. 37B illustrates the enlarged bubble "Z" at the time "TA" which is almost at midpoint of the duration. FIG. 37C illustrates the shrunk bubble "Z" at the termination time "TB".

FIG. 38 illustrates the changes in potential of the detection electrode 118. The potential variation becomes a detection signal "SB" for detecting the presence or absence of ink. The detection signal "SB" varies before and after the initiation time "Td" of the foaming. That is, the behavior of the detection signal "SB" during the time period of "t<Td" and the behavior thereof during the time period of "t>Td" are different from each other because of the following reasons. That is, it is considered that the formation of a bubble on the heater 101 leads to changes in the conditions of contacting ink in the nozzle with the anti-cavitation film 205 on the heater 101. After the initiation time "Td", the contact area between the anti-cavitation film 205 and the ink becomes small as the bubble grows. Thus, the detection signal "SB" is close to GND potential. Following that period of time, the bubble extends over the anti-cavitation film 205, so that the detection signal "SB" becomes equal to GND potential. After applying the ink-ejecting pulse "P1", at the time "t2" after a lapse of the predetermined time "Tr", the babble on the heater 101 is well grown enough to keep the anti-cavitation film 205 from contact with ink. At this time "T2", there is no electrical connection between the detection electrode 118 and the anti-cavitation film 205. Therefore, the correction pulse "P2" is applied at the time "t2" to generate a detection signal "SBr" at the time "t2". As shown in FIG. 38, the detection signal "SBr" has a waveform that corresponds to one in the absence of ink in the nozzle. Consequently, the detection signal "SBr" is observed on the assumption that the nozzle is in the absence of ink.

The waveform of the detection signal "SBr" may be under the influences of noise at a background level of the whole detection system, individual differences depending on the variations in the detection electrodes 118 and circuit systems in each printing head, the surrounding conditions of the ink detection for each printing head, and so on. Thus, the detection signal "SBr" corresponds to a detection signal obtained under the conditions in which the detection of ink is actually performed in the absence of ink. Accordingly, the present embodiment intentionally obtains a detection signal under the conditions in which no ink remains in the nozzle.

Following a lapse of sufficient time, the ink-detection pulse "P3" is applied on the heater 101, generating a waveform (not shown) as a detection signal "SB" depending on the remaining amount of ink. Therefore, the presence or absence of ink can be detected with reference to the output signal "SB" obtained at the time of applying the ink-detection pulse "P3". In this case, the detection of ink in the nozzle can be performed with more accuracy by referring the detecting results obtained by applying the previous correct pulse "P2", for reference of judgment.

Figure 39:
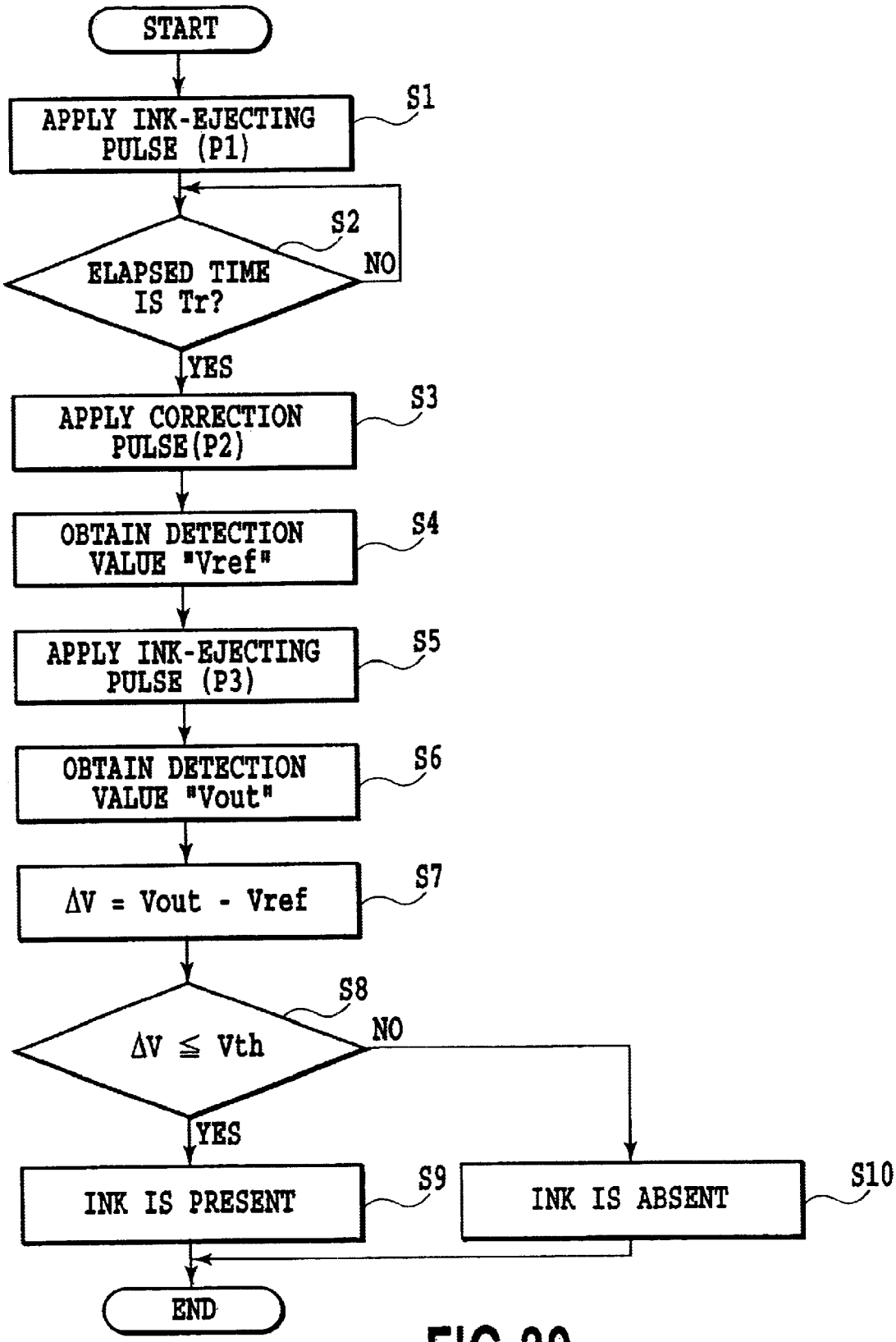
FIG. 39 is a flow chart that illustrates the method for detecting the presence or absence of ink in accordance with twenty-first preferred embodiment of the present invention.

FIG. 39 is a flow chart for explaining the ink detecting method described above.

First, the ink-ejecting pulse "P1" is applied to the heater 101 (step S1). Subsequently, the correction pulse "P2" is applied to the heater 101 after a lapse of the time "Tr" (steps S2, S3). Then, a detection value "Vref" for the correction is obtained from the detection signal "Sbr" (step S4). After terminating the ejecting of ink and the foaming phenomena, the ink-detection pulse "P3" is applied on the heater 101 after a lapse of a sufficient time (step S5). At this time, a detection value "Vout" is obtained from the detection signal (step S6). After that, the obtained detection values "Vref" and "Vout" are subjected to the arithmetic operation of subtraction to obtain the difference "ΔV" (=Vout−Vref) (step S7). The difference "ΔV" is compared with the reference value "Vth" (step S8). If the "ΔV" is below "Vth", it is judged that ink remains in the nozzle (step S9). If the "ΔV" is larger than "Vth", it is judged that no ink remains in the nozzle (step S10).

Accordingly, ink in the nozzle can be detected with a high precision by using the detection value "Vref" obtained by the application of the correction pulse "P2" and reflecting the detecting value "Vref" on the reference value "Vth". Depending on the detecting results, furthermore, a recovery operation can be performed on the nozzles if required. If it is judged that ink does not remain in the nozzle, for example, the recovery operation described above can be performed on the printing head 85 (see FIG. 8). The recovery operation may be the suctioning of ink to be drained as described above, so that the conditions of ink ejecting can be recovered with reliability. In this recovery procedure, another recovery operation using a preliminary ejecting of ink may be performed in addition to the recovery operation using the suctioning of ink. In this case, the condition of ink ejecting is detected by the preliminary ejecting of ink and then the recovery procedure is performed until an ejecting error of a nozzle is sufficiently recovered. In addition, the ink-detection pulse "P3" may be re-applied to the heater 101 to re-detect ink without performing the ink ejecting. Such a recovery procedure can be performed by returning the carriage HC (see FIG. 8) to its home position as described above. As a result of the recovery procedure, the results of detecting the ink ejecting failure may be represented on a display of the printing apparatus or reported to the host device.

In this embodiment, furthermore, the difference "ΔV" between the detection values "Vref" and "Vout" is used for determining the presence or absence of ink in the nozzle. However, the method of utilizing the detection value "Vref" is not limited to such a procedure. The detection value "Vref" may be used as a reference to the results of detecting the presence or absence of ink to improve the accuracy of the detection. Alternatively, the detection value "Vref" may used as a reference to the detecting results of the remaining amount of ink to improve the accuracy of the detection. Therefore, the method for reflecting the detection value "Vref" is not limited to a specific application.

In this embodiment, furthermore, the correction pulse "P2" is applied prior to the application of the ink-detection pulse "P3". However, it is not limited to such an application. In addition, it is not essential to require the correction pulse "P2" for each detection pulse "P3". Just before starting the printing movement, for example, the detection value "Vref" is previously obtained by the application of the correct pulse. Then, the result of the ink detection is obtained by the application of the ink-detection pulse "P3". Subsequently, the detection value "Vrf" may be used as a reference value with respect to the detecting results to make a judgement whether ink remains in the nozzle. In this case, the ink-detection pulse "P3" may be applied during a resting state in the printing movement, which occurs momentarily during the printing movement for one page of information. Alternatively, a pre-pulse to be applied during the printing movement using a double pulse drive system is used as the ink-detection pulse "P3".

In summary, as described above, the present embodiment has the following advantages. That is, at first, the artificial detection signal is obtained on the assumption that the nozzle is in the absence of ink. Then, the actual detection signal is obtained at the time of being actually performed in the absence of ink, which may be under the influences of noise at a background level of the whole detection system, individual differences depending on the variations in the detection electrodes and circuit systems in each printing head, the surrounding conditions of the ink detection for each printing head, and so on. Thus, the artificial detection signal corresponds to the actual detection signal obtained under the conditions in which the detection of ink is actually performed in the absence of ink. Accordingly, the present embodiment intentionally obtains a detection signal under the conditions in which no ink remains in the nozzle by reflecting the above artificial and actual detecting results on the reference of judgement.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording;

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden a temperature rise that exceeds nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated in the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than room temperature and are softened or liquefied at room temperature. This is because in the ink jet system, the ink is generally temperature-adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing ink evaporation: the ink is transformed from solid to liquid state by positively utilizing the thermal energy which would otherwise cause a temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the inkjet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. A substrate for an ink-jet printing head to be provided as one of components that make up an ink-jet printing head that performs printing by ejecting ink from an ejecting port, comprising:

a printing element for supplying energy for ejecting ink from the ejecting port;

a driving element for driving the printing element, the driving element being provided at a position for transmitting a voltage change between the driving element and the printing element to ink on the substrate for the printing head; and a detection electrode, provided at a position remote from the printing element, communicating with a voltage monitor, for detecting the voltage change between the printing element and the driving element via conductive ink on the substrate for the printing head, where the voltage change occurs in response to the driving of the printing element.

2. A substrate for an ink-jet printing head as claimed in claim 1, wherein an insulating protective film is formed on the substrate for the printing head; and the ink is located on the substrate for the printing head with the protective film disposed therebetween.

3. A substrate for an ink-jet printing head as claimed in claim 1, wherein.

the detection electrode is positioned at a predetermined distance from a voltage-variation area, which is between the printing element and the driving element, and is where changes in voltage occur in response to the driving of the printing element.

4. A substrate for an ink-jet printing head as claimed in claim 3, wherein a transmission between i) the voltage-variation area between the printing element and the driving element and ii) the ink is performed by means of a capacity coupling between the voltage-variation area and the ink.

5. A substrate for an ink-jet printing head as claimed in claim 4, wherein a protective film is formed so that the capacity coupling between the voltage-variation area and the ink is partially changed, and the detection electrode is positioned between the printing head and the driving element at a predetermined distance from a portion where the capacity coupling is large, and a portion where the capacity coupling is small is positioned between the detection electrode and the portion where the capacity coupling is large.

6. A substrate for an inkjet printing head as claimed in claim 5, wherein the portion where the capacity coupling is large is a thin portion of the protective film positioned on the printing element.

7. A substrate for an ink-jet printing head as claimed in claim 1, wherein the detection electrode is provided as a common electrode shared among a plurality of printing elements.

8. A substrate for an ink-jet printing head as claimed in claim 1, wherein the detection electrode is a provided as a common electrode shared among all of a plurality of printing elements on the substrate for the printing head.

9. A substrate for an ink-jet printing head as claimed in claim 1, wherein the printing element is a heating element that generates a bubble in the ink for ejecting the ink from the ejecting port.

10. A substrate for an ink-jet printing head as claimed in claim 9, further comprising a protective film including an anti-cavitation film that prevents an impact of a cavitation from being generated when the bubble in the ink disappears.

11. A substrate for an ink-jet printing head as claimed in claim 10, wherein the anti-cavitation film is a tantalum film.

12. A substrate for an ink-jet printing head as claimed in claim 10, wherein the anti-cavitation film is separated into a predetermined number of sections, where each of the separated film sections corresponds to a predetermined number of printing elements.

13. A substrate for an ink-jet printing head as claimed in claim 10, wherein a portion of the protective film on the printing element is set to a capacitance per unit area which is larger than those of other portions, and the anti-cavitation film is formed on the portion of the protective film on the printing element.

14. A substrate for an ink-jet printing head as claimed in claim 10, wherein a portion of the protective film on the printing element is thinner than other portions of the protective film.

15. A substrate for an ink-jet printing head as claimed in claim 1, wherein a control circuit for selectively driving a plurality of printing elements is formed on the substrate for the printing head.

16. A substrate for an ink-jet printing head as claimed in claim 15, wherein the control circuit includes a shift register that produces an output of incident serial printing data in parallel.

17. A substrate for an inkjet printing head as claimed in claim 15, wherein the control circuit includes a latch circuit that temporary stores parallel printing data.

18. An ink-jet printing head, comprising:

a substrate for an ink-jet printing head as claimed in claim 1, and a top plate that forms nozzles corresponding to a predetermined number of printing elements when the substrate for the printing head is connected to the top plate.

19. An ink-jet printing head as claimed in claim 18, wherein an anti-cavitation film is provided as a plurality of anti-cavitation film sections, where each anti-cavitation film section corresponds to one of the nozzles so that the anti-cavitation film sections are separated from each other.

20. An ink-jet printing head as claimed in claim 18, wherein the top plate forms a common liquid chamber that communicates with a plurality of the nozzles when connected with the substrate for the printing head, and at least part of the detection electrode is positioned inside the common liquid chamber.

21. An ink-jet cartridge comprising:

an ink-jet printing head as claimed in claim 18; and an ink tank that stores ink to be supplied to the ink-jet printing head and is connectable with the ink-jet printing head.

22. An ink-jet printing apparatus comprising:

means on which an ink-jet printing head as claimed in claim 18 is mountable to perform printing on a printing medium.

23. An ink-jet printing apparatus as claimed in claim 22, further comprising:

means for supplying a drive signal for the printing element; and detection means for detecting a state of ink in the ink-jet printing head.

24. An ink-jet printing apparatus as claimed in claim 23, further comprising:

means for controlling printing depending on results of detecting the state of ink by the detection means.

25. An ink-jet printing apparatus as claimed in claim 23, wherein the detection means reads the changes in voltage of the detection electrode, which is shared with a plurality of the printing elements, in step with a drive timing per one of the printing elements.

26. An ink-jet printing apparatus as claimed in claim 23, wherein the detection means reads the changes in voltage of the detection electrode, which is shared with a plurality of the printing elements, in step with a drive timing per a plurality of the printing elements.

* * * * *

UNITED STATES PATENT AND TRADEMARK OFFICE

CERTIFICATE OF CORRECTION

PATENT NO. : 6,652,053 B2
DATED : November 25, 2003
INVENTOR(S) : Imanaka et al.

It is certified that error appears in the above-identified patent and that said Letters Patent is hereby corrected as shown below:

Title page,
Item [75], Inventors, "Yoshiyuki Imanaka, Kasawaki (JP);" should read -- Yoshiyuki Imanaka, Kawasaki (JP); --.

Figure 21:
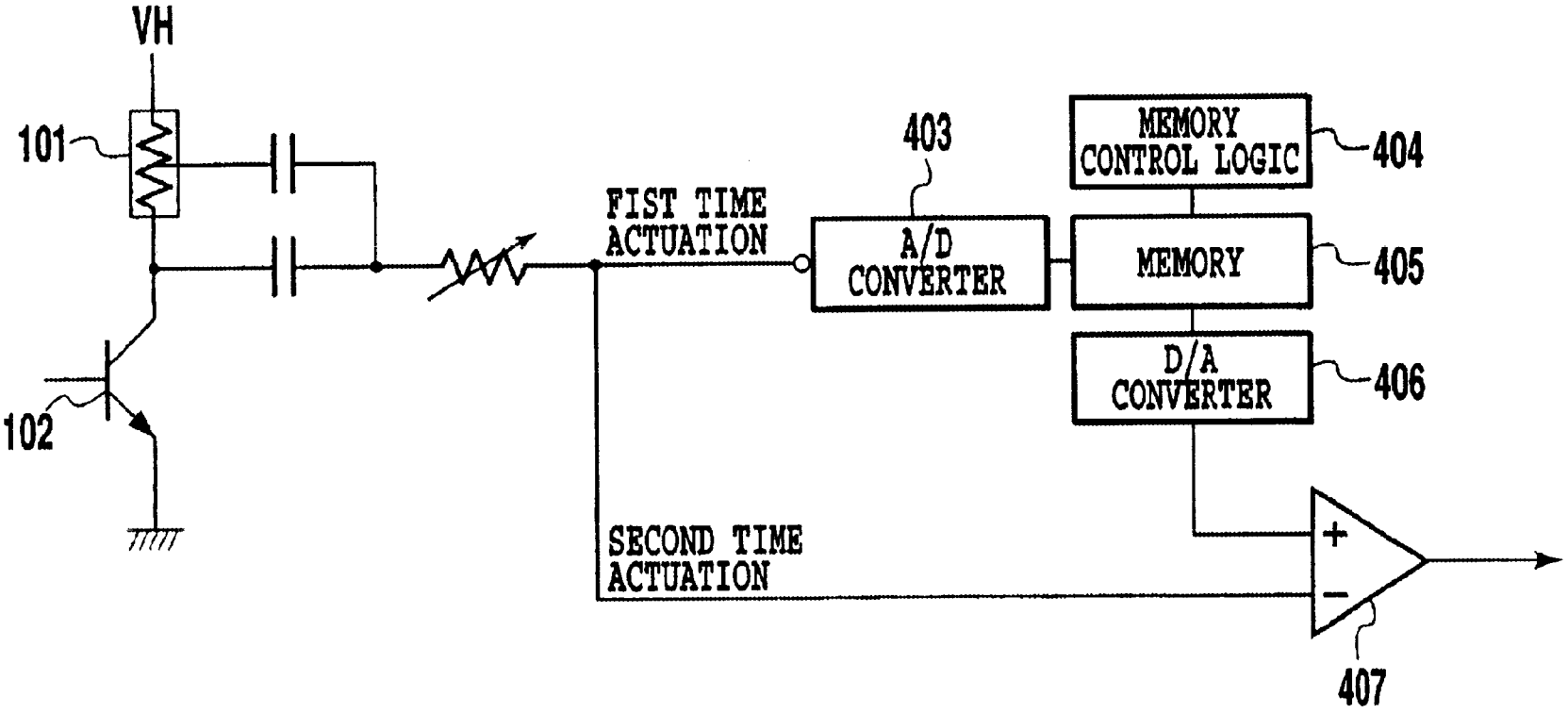
FIG. 21 is a schematic circuit diagram that partially illustrates an equivalent circuit for the ink detection in accordance with the thirteenth preferred embodiment of the present invention.

Drawings,
Sheet 21, Fig. 21, "FIST" should read -- FIRST --.

Column 2,
Line 11, "soon." should read -- so on. --.
Line 39, "reference." should read -- reference --.

Column 3,
Line 27, "ejecting" should read -- eject --.

Column 4,
Line 59, "inkjet" should read -- ink-jet --.

Column 6,
Lines 2 and 53, "inkjet" should read -- ink-jet --.

Column 7,
Line 16, "inkjet" should read -- ink-jet --.

Column 9,
Line 16, "a anti-" should read -- an anti- --.

Column 10,
Line 47, "inkjet" should read -- ink-jet --.

Column 12,
Line 47, "makes" should read -- make --.

Column 15,
Line 26, "However;" should read -- However, --.

Column 16,
Line 38, "presence of" should read -- presence or --.

UNITED STATES PATENT AND TRADEMARK OFFICE

CERTIFICATE OF CORRECTION

PATENT NO. : 6,652,053 B2
DATED : November 25, 2003
INVENTOR(S) : Imanaka et al.

It is certified that error appears in the above-identified patent and that said Letters Patent is hereby corrected as shown below:

Column 23,
Line 29, “reference FIG. 16” should read -- reference to FIG. 16 --.

Column 24,
Line 39, “provide d” should read -- provided --.

Column 25,
Line 40, “invention,” should read -- invention. --.

Column 32,
Line 17, “to equal” should read -- equal --.

Column 33,
Line 48, “!is” should read -- is --.
Line 60, ““to”” should read -- “t0” --.
Line 63, “do not effect” should read -- have no effect --.

Column 34,
Line 23, “babble” should read -- bubble --.
Line 53, “the detecting” should read -- to the detecting --.

Column 35,
Line 40, “may used” should read -- may be used --.

Column 36,
Line 33, “sudden a” should read -- a sudden --.

Column 38,
Line 34, “wherein.” should read -- wherein --.

Column 39,
Line 3, “a provided” should read -- provided --.
Line 46, “inkjet” should read -- ink-jet --.

UNITED STATES PATENT AND TRADEMARK OFFICE

CERTIFICATE OF CORRECTION

PATENT NO. : 6,652,053 B2
DATED : November 25, 2003
INVENTOR(S) : Imanaka et al.

It is certified that error appears in the above-identified patent and that said Letters Patent is hereby corrected as shown below:

Column 48,
Line 48, “temporary “ should read -- temporarily --.

Signed and Sealed this

Seventeenth Day of August, 2004

JON W. DUDAS
*Acting Director of the United States Patent and Trademark Office*